US005975665A

United States Patent [19]

Torigoe et al.

[11] Patent Number: 5,975,665

[45] Date of Patent: Nov. 2, 1999

[54] INK JET RECORDING APPARATUS HAVING RESIDUAL QUANTITY DETECTION UNIT AND RESIDUAL QUANTITY DETECTION METHOD THEREOF

[75] Inventors: Makoto Torigoe, Tokyo; Masashi Kamada, Kawasaki; Noribumi Koitabashi, Yokohama; Toshiharu Inui, Yokohama; Fumiyuki Mikami, Yokohama; Takayuki Ninomiya, Ichikawa; Yasuhiro Unosawa, Tokyo; Kazuhiko Morimura, Yokohama; Hitoshi Nishikori, Kawasaki; Masaya Uetuki, Yokohama, all of Japan

[73] Assignee: Canon Kabushiki Kaisha, Tokyo, Japan

[21] Appl. No.: 08/542,783

[22] Filed: Oct. 13, 1995

[30] Foreign Application Priority Data

| | | | |
|---|---|---|---|
| Oct. 14, 1994 | [JP] | Japan | 6-249390 |
| Oct. 14, 1994 | [JP] | Japan | 6-249848 |
| Oct. 14, 1994 | [JP] | Japan | 6-249850 |
| Oct. 14, 1994 | [JP] | Japan | 6-249852 |
| Oct. 14, 1994 | [JP] | Japan | 6-249872 |

[51] Int. Cl.[6] ..... B41J 2/195

[52] U.S. Cl. ..... 347/7; 347/86

[58] Field of Search ..... 347/7, 85, 86

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,723,129 | 2/1988 | Endo et al. | 346/1.1 |
| 4,740,796 | 4/1988 | Endo et al. | 346/1.1 |
| 4,771,295 | 9/1988 | Baker et al. | 346/1.1 |
| 4,977,413 | 12/1990 | Yamanaka et al. | 346/140 R |
| 5,025,271 | 6/1991 | Baker et al. | 346/140 R |
| 5,079,570 | 1/1992 | Mohr et al. | 346/140 R |
| 5,373,366 | 12/1994 | Bowers | 356/435 |
| 5,534,708 | 7/1996 | Ellinger et al. | 250/377 |
| 5,616,929 | 4/1997 | Hara | 250/573 |
| 5,631,674 | 5/1997 | Shinada et al. | 347/37 |
| 5,652,610 | 7/1997 | Kawai et al. | 347/87 |
| 5,712,667 | 1/1998 | Sato | 347/7 |

FOREIGN PATENT DOCUMENTS

| | | | |
|---|---|---|---|
| 0287098 | 10/1988 | European Pat. Off. | B41J 3/04 |
| 0573274 | 12/1993 | European Pat. Off. | B41J 2/175 |
| 0610041 | 8/1994 | European Pat. Off. | B41J 2/175 |
| 3408302 | 9/1985 | Germany | B41J 27/00 |
| 59-123670 | 7/1984 | Japan . | |
| 59-194853 | 11/1984 | Japan . | |
| 60-172546 | 9/1985 | Japan | B41J 3/04 |
| 62-21549 | 1/1987 | Japan | B41J 3/04 |
| 52-207650 | 9/1987 | Japan | B41J 3/04 |
| 63-087242 | 4/1988 | Japan . | |
| 63-115756 | 5/1988 | Japan | B41J 3/04 |
| 01017465 | 3/1989 | Japan . | |
| 06040043 | 2/1994 | Japan . | |

*Primary Examiner*—Safet Metjahic
*Assistant Examiner*—John Chizmar
*Attorney, Agent, or Firm*—Fitzpatrick, Cella, Harper & Scinto

[57] ABSTRACT

According to the present invention, there is provided an ink jet recording apparatus for recording an image on a recording medium by discharging ink to the surface of the recording medium, wherein ink is reserved in an ink tank including a negative pressure generating member, such as an absorber and a foaming member, and a function of accurately detecting the residual quantity such that depletion to a predetermined level can be detected is realized. Light emitted by a photointerrupter is allowed to pass through a portion of a wall surface of the ink tank made of transparent plastic or the like which is transmissible with respect to detection light emitted by the photointerrupter to detect change in the light reflectance in the boundary portion between the wall surface and the ink absorber. In accordance with reflectance obtained in a case where no ink exists in the detected portion and that obtained in a case where ink exists, the residual quantity of ink can be detected.

47 Claims, 44 Drawing Sheets

| FIG. 11A |
| --- |
| FIG. 11B |

| FIG. 13A |
| --- |
| FIG. 13B |

| FIG. 19A |
| --- |
| FIG. 19B |

INK JET RECORDING APPARATUS HAVING RESIDUAL QUANTITY DETECTION UNIT AND RESIDUAL QUANTITY DETECTION METHOD THEREOF

BACKGROUND OF THE INVENTION

1. Field of the Invention

The present invention relates to an ink depletion detection apparatus for detecting the empty state of ink in an ink reservation container or the like of an ink jet recording apparatus or a residual quantity detection apparatus for detecting the residual quantity of ink in the same.

More particularly, the present invention relates to an ink residual quantity detection apparatus for detecting the quantity of residual ink accommodated in an ink reservation container consisting of a plurality of accommodating members capable of accommodating different inks in different states.

2. Related Background Art

A recording apparatus having functions to serve as a printer, a copying machine and a facsimile machine or a recording apparatus for use as an output unit for a combined electronic apparatuses including a computer, a word processor and the like has a structure capable of recording an image on a recording medium, such as paper or a thin plastic plate, in accordance with image information. The recording apparatuses are classified into ink jet recording apparatuses, wire dot recording apparatuses, thermal recording apparatuses and laser beam recording apparatuses in terms of the recording method.

The recording apparatus employing the ink jet recording method (the ink jet recording apparatus) records an image by discharging ink from a recording means (a recording head) to a recording medium. The ink jet recording apparatus have a variety of advantages in that the size of the recording means can be reduced, a precise image can be recorded at high speed, an image can be recorded on plain paper without special treatments, the running cost can be reduced, noise can be prevented because the non-impact recording method is employed, and a color image can easily be recorded by using a multiplicity of color inks.

In particular, the ink jet recording means, which uses thermal energy to discharge ink, can easily be manufactured into a form that comprises a means having dense liquid passage arrangement (configuration of discharge ports) by performing the semiconductor manufacturing process, which includes etching, evaporation and sputtering, to form an electricity-to-heat converter on the substrate, electrodes, liquid passage walls, ceiling plate and the like. Thus, the size of the recording means can be reduced further satisfactorily.

The ink jet recording apparatus has an ink reservation unit for reserving ink to be supplied to the recording head, the ink reservation unit being mounted fixedly on a predetermined position in the ink jet recording apparatus or mounted on the carriage together with the recording head. In the former case, an ink supply passage, such as an ink tube, is formed between the recording head and the ink reservation unit in such a manner that the ink supply passage is able to follow the movement of the carriage. In the latter case, the ink supply passage between the recording head and the ink reservation unit can relatively be shortened. Accordingly, the foregoing structure, in which the ink reservation unit is mounted on the carriage, is suitable to reduce the size of the ink jet recording apparatus and simplify the structure of the same.

The foregoing structure, in which both recording head and the ink reservation unit (ink tank) are mounted on the carriage, in the category thereof, includes a structure, in which both recording head and the ink tank are integrally formed, and a structure in which the recording head and the ink tank are separately mounted.

With the structure, in which the recording head and the ink tank are integrally formed, a cartridge having the ink tank and the recording head formed integrally is changed to a new cartridge when ink in the ink tank has been consumed. Cartridges of the foregoing type have been used widely in recent years because they can easily be handled. However, the running cost cannot be reduced because the costly head must be changed whenever ink has been consumed.

With the latter structure having the recording head and the ink tank which are mounted separately, only the ink tank reserving ink is changed when the ink has been consumed but the head is required to be changed only after its lifetime.

If the recording head is used in a usual manner, use of the recording head is not inhibited during its lifetime before ink in the ink tank is used completely. Therefore, the recording head must be changed by the number of times which is smaller than the number of times required for the ink tank to be changed. Since only the relatively low cost ink tank is usually changed, the running cost can be reduced. However, the foregoing structure comprising the recording head and the ink tank, which are mounted separately, requires the portion for establishing the connection between the ink tank and the recording head to be manufactured-precisely in order to prevent ink leakage.

The recording apparatus adapted to the ink jet recording method must be capable of satisfactorily supplying ink in a quantity to be discharged through the recording head during the recording operation, and as well as must have an ink supply system capable of preventing ink leakage through the discharge port in a period in which the recording operation is not performed.

The foregoing problem of ink leakage through the discharge port is a peculiar problem for the ink jet recording apparatus. In order to overcome the foregoing problem, the pressure at the discharge port has been usually lowered as compared with the atmospheric pressure. To realize the foregoing state of pressure, the ink jet recording apparatus has a negative pressure generating mechanism provided for the ink supply system thereof. Note that the "negative pressure" is back pressure with respect to the direction, in which ink is supplied to the discharge port, and a state of pressure, in which the pressure at the discharge port is lowered than the atmospheric pressure, is meant.

If the ink accommodating portion is in the interchangeable form, there arise necessities that the ink accommodating portion can be attached/detached smoothly without ink leakage so as to reliably supply ink to the recording head, in addition to the foregoing requirements.

An example of the structure of the ink container serving as the ink accommodating portion for use in the ink jet recording apparatus has been disclosed in Japanese Patent Laid-Open No. 63-87242 (hereinafter called a first conventional example). According to the first conventional example, a structure of an ink jet recording carriage has been disclosed which comprises an ink container substantially completely filled with a foaming material and a plurality of ink discharge orifices.

In the ink container of the foregoing type, negative pressure can be generated due to the capillary force of a porous medium, such as polyurethane foam which is the foaming material for reserving ink and ink can be held (ink leakage from the ink container can be prevented).

However, the foregoing first conventional example requires the foaming material to be substantially completely enclosed in the ink accommodating portion, whereby limiting the quantity of chargeable ink. Furthermore, the quantity of residual ink in the foaming material is large as compared with the ink container accommodating only ink. Thus, there arises a problem in that the efficiency in use of the ink is unsatisfactory.

In order to enlarge the quantity of chargeable ink in the structure comprising a foaming material to serve as the negative pressure generating means in the ink reservation means, a structure has been disclosed in Japanese Patent Laid-Open No. 6-40043. According to the foregoing disclosure, an ink reservation container comprising a portion for accommodating a negative pressure generating member and an ink accommodating portion for accommodating ink, which are divided from each other, is employed so that ink except a portion, which adheres to the wall of the ink accommodating portion, can substantially completed be used. Thus, the capacity of the ink reservation container can be enlarged. Furthermore, the accommodated negative pressure generating member prevents ink leakage from the recording head so that the performance of supplying ink is stably maintained for a long time.

In any type of the foregoing ink jet recording apparatuses, it is preferable that the ink reservation means be changed at appropriate timing. Furthermore, there is a necessity of providing a means for accurately detecting the quantity of ink left in the ink reservation means and a means for appropriately detecting the moment at which ink will be consumed.

If ink in the ink reservation means is empty, the discharge means for discharging ink through the recording head generates the discharge energy in the state where the ink reservation means does not accommodate ink. In particular, a so-called bubble jet ink recording apparatus, which comprises a thermal energy generating means, such as an electricity-to-heat conversion device, as a discharge means to use pressure generated due to status change caused by the heat of ink so as to discharge ink, encounters undesirable rise in the temperature of the recording head and damage of the recording head if the thermal energy generating means is operated in the state where no ink is left.

In an ink jet recording apparatus comprising a mechanical pressure generating means, such as a piezoelectric device, to serve as a discharge means for discharging ink, operation of the discharge means in a state where no ink is left causes the mechanical pressure generating means to continuously generate pressure without load acting during the ink discharge. As a result, the discharge means and durability deteriorate.

Hitherto, there have been disclosed a structure for detecting ink empty state (state where ink has been consumed) in the ink reservation container for an ink jet recording apparatus as in Japanese Patent Laid-Open No. 54-133733 which comprises an optical device for detecting the light transmission state in an ink tank, as in Japanese Patent Publication No. 1-17465 in which the empty state is detected by electrically conducting an electrode member, and as in Japanese Patent Laid-Open No. 59-194853 in which the number of discharge pulses is counted to estimate the quantity of consumed ink (hereinafter called a "dot counter method").

However, the foregoing conventional ink empty state detection apparatus (the ink residual quantity detection apparatus) cannot accurately detect the residual quantity of ink when adapted to the structure in which a foaming material serving as the negative pressure generating member is enclosed in the ink reservation means or the structure of the ink reservation container in which the portion for accommodating the negative pressure generating member and the ink accommodating portion are separated from each other.

Among the conventional structures, the structure for detecting the light transmission state of the ink tank by using an optical device and the structure for detecting the empty state by detecting an electrode member encounters difficulty in detecting ink empty in the ink tank accommodating the negative pressure generating member because of the structure of the ink reservation container. Even if the residual quantity of ink left in only the ink accommodating portion of the structure, in which the portion for accommodating the negative pressure generating member and the ink accommodating portion are separated from each other, is detected, a considerably large quantity of ink is left in the portion for accommodating the negative pressure generating member whereby allowing the foregoing structure to be used only to alarm somewhat reduction in the quantity of ink.

The structure for detecting the residual quantity by electrically conducting an electrode member sometimes encounters adverse influence upon ink supply if a desired negative pressure cannot be realized in a case where the disposed electrode compresses the negative pressure generating member.

The dot counter method cannot prevent an error because the quantity of use becomes different depending upon scattering in the quantity of discharge per one discharge operation, scattering in the quantity of ink initially charged into the ink tank and the difference in the quantity of use due to the environment for use. The foregoing error is sometimes the half of the overall quantity of ink, thus resulting in that issue of an alarm indicating reduction in the residual quantity or interruption of the operation of the recording apparatus must be performed in a state where substantially the half quantity of ink is left in order to reliably perform the same. If the alarm or interruption is performed at a timing at which a considerably large quantity of ink is left, the purpose of detecting the residual quantity cannot be achieved or ink will be used wastefully. If the residual quantity is detected accurately by the dot count method, the cost cannot be reduced. Since the capacity of the ink reservation container has been enlarged recently, the residual quantity of ink cannot accurately be detected.

In view of the foregoing, the present invention employs a structure for detecting reflected light of light made incident upon the ink tank. However, the structure for detecting reflected light has the following problems to be overcome.

As a sensor for emitting light and detecting reflected light, a photointerrupter is usually employed in which an LED serving as a light emission means and a phototransistor serving as a light receiving means are accommodated in one package. Since the lifetime of a photointerrupter is usually shorter than that of a printer, the LED is turned on only when it is used to shorten the time, in which electric power is supplied to the photointerrupter.

Since both light emission quantity of the LED and the sensitivity of the phototransistor of a photointerrupter scatter, the combined photocurrent output characteristic of the LED and the phototransistor scatters by about two times to four times between the upper limit and the lower limit. In a case where the photointerrupter is used to serve as the ink empty detection apparatus, the output from the photointerrupter must be adjusted to be included in a predetermined range, that is, so called calibration must be performed.

The calibration is performed by, for example, in such a manner that a reflecting portion for calibration having a predetermined reflectance is provided, the reflecting portion is irradiated with light emitted from an LED, light reflected by the reflecting portion is detected by a phototransistor, and a variable resistor for limiting the LED current is so adjusted that the output from the phototransistor is included in a predetermined range.

However, the foregoing calibration operation has a plurality of problems.

For example, the operation for calibrating the output from a photointerrupter 6 by adjusting a variable resistor 87 for limiting the LED current cannot easily be automated, whereby increasing the manufacturing processes.

If an excessive error takes place in adjusting the output from the photointerrupter during the foregoing operation, there is a risk of erroneous result in detecting ink depletion. Accordingly, accurate adjustment must be performed, whereby further increasing the manufacturing labor.

Since the foregoing operation is performed in a process for adjusting the printer to be performed in a manufacturing plant, change in the quantity of light emitted from the LED 5 occurring due to time lapse or change in the output from the photointerrupter 6 occurring due to contamination of the same after the printer has been shipped changes the output from the photointerrupter 6. Thus, depletion of ink cannot accurately be detected.

The structure using the photointerrupter to detect the residual quantity of ink in the ink tank has problems to be overcome to detect it further accurately. The reason for this is that the ink residual quantity detection apparatus that irradiates the ink tank with light and measures the difference in the quantity of reflected light to discriminate empty of ink has the following problem: LEDs for emitting light must emit light in the same quantity (the LEDs generally emit light in different quantities). Therefore, the quantities of light emitted from LEDs must be measured to select an LED determined to emit light in a quantity included in a predetermined range. The reason for this is that the difference in the quantity of light emitted by the LED causes the quantity of light received by the light receiving device to be different. Furthermore, the foregoing difference affects the change in the output from the light receiving device, with which the ink empty is discriminated. A similar phenomenon applies to the light receiving device. Thus, the output value must be constant with respect to the quantity of received light. Therefore, the light receiving device must receive light in a predetermined quantity and have a constant output characteristic. The foregoing necessity of selecting a light emitting device and light receiving device enlarges the cost.

In addition to the requirements for the devices, the system for operating the photointerrupter must be subjected to an error adjustment process. In the foregoing system, there are involved the voltage level for operating the LED portion of the photointerrupter, allowable manufacturing error in the value of the current limiting resistor for limiting the electric current that flows in the LED, allowable error in the current-to-voltage conversion resistor in the light receiving portion and conversion error occurring in an AD convertor. The foregoing errors must be adjusted for each ink jet printer. It leads to a fact that the adjustment operation to be performed in the manufacturing plant increases and thus the cost of the printer is enlarged.

Since the conventional ink jet recording apparatus has the structure that the distance from recording paper to the recording head is changed to correspond to the thickness of the recording paper, there arises a problem in that the change in the distance from the recording paper to the recording head must be considered when the sensitivity of the photointerrupter is corrected.

A printer, which has a plurality of detection mechanisms, such as a mechanism for detecting the distance from the carriage to the paper, in addition to the mechanism for detecting the residual quantity of ink, inevitably has a complicated internal structure, and the overall cost of the printer cannot be reduced. In particular, a printer having a simple structure cannot easily be provided with a plurality of detection mechanisms of the foregoing type. However, sensors serving as the foregoing detection mechanism are required to prevent defective recording operation or a critical failure for the printer. Accordingly, a low cost sensor apparatus has been required.

SUMMARY OF THE INVENTION

In view of the problems experienced with the conventional function for detecting the residual quantity of ink in an ink tank of a type including a negative pressure generating member, such as an absorber and a foaming member, an object of the present invention is to realize a function of accurately detecting the residual quantity of ink in such a manner that ink depletion to a predetermined level can be detected.

In order to achieve the foregoing object, the present invention has a structure provided with a means for detecting change in the light reflectance in the boundary portion between the wall surface of the ink tank and the ink absorber through a portion of the wall surface of the ink tank to detect the residual quantity of ink in accordance with the reflectance in a case where ink exists in the foregoing portion and that in a case where no ink exists.

Another object of the present invention is to provide an apparatus for detecting the residual quantity of liquid in a tank in which a means for optically detecting the residual quantity of liquid, such as ink, can automatically be adjusted and an ink jet recording apparatus.

In order to achieve the foregoing object, according to one aspect of the present invention, there is provided an apparatus for detecting the residual quantity of liquid in a tank having a structure such that a detection means that applies light from a light emitting portion thereof through a light transmissible wall surface of an ink tank including an ink absorber to detect the quantity of light reflected by a boundary portion between the wall surface and the ink absorber to detect the residual quantity of liquid in the tank, wherein an adjustment means capable of adjusting the quantity of light which is emitted by the light emitting portion is provided.

According to the present invention, there is provided an ink jet recording apparatus arranged in view of the problems experienced with the conventional function for detecting the residual quantity of ink in an ink tank of a type including a negative pressure generating member, such as an absorber and a foaming member, and having a means capable of realizing a function of accurately detecting the residual quantity of ink in such a manner that ink depletion to a predetermined level can be detected and as well as having a function of detecting the distance from the carriage to paper.

Another object of the present invention is to realize a function of detecting the residual quantity of ink, the sensitivity of which can easily be corrected and which is able to accurately detect the residual quantity of ink in such a manner that ink depletion to a predetermined level can be detected.

In order to achieve the foregoing object, according to the present invention, there is provided an ink jet recording apparatus having recording means that discharges ink to form an image on a recording medium, an ink tank for supplying ink to the recording means, detection means for detecting whether or not ink exists in the ink tank or the residual quantity of ink, and control means for controlling the detection means, wherein the detection means is a photointerrupter provided independently from the carriage and having a light emitting device and a light receiving device, the carriage has an opening portion for allowing light output from the light emitting device to pass through and a reflecting plate for reflecting the output light, and the control means corrects the sensitivity of the detection means in such a manner that the distance from the carriage to the recording head is constant.

An object of the present invention is to provide a method of detecting the residual quantity of ink and an apparatus capable of accurately detecting the residual quantity in such a manner that depletion to a predetermined level can be detected without a malfunction or deterioration in the detection accuracy occurring due to scattering in the outputs from a means (a sensor) for detecting the light reflectance, scattering occurring due to the mounting accuracy or scattering in manufacturing the ink tank.

An object of the present invention is to provide a method and an apparatus for detecting the residual quantity of ink which is capable of accurately detecting the residual quantity regardless of the position of a carriage of an ink jet recording apparatus in which the position of the carriage can be selected from a plurality of positions to be adaptable to the thickness of a recording medium. Furthermore, an object of the present invention is to provide a method and an apparatus for detecting the residual quantity of ink with which, in a case where change to a new ink tank is performed after depletion of ink has been indicated by a display or issuing an alarm sound, the display or the issue of the alarm sound can be suspended automatically without a suspending means.

In order to achieve the foregoing objects, the present invention has a structure such that detection light from a photointerrupter 6 is allowed to pass through a portion of the wall surface of an ink tank made of transparent plastic or the like which is transmissible with respect to detection light from the photointerrupter 6 to detect change in the light reflectance of the boundary portion between the wall surface and an ink absorber 7*a*, data obtained by the detection means by detecting the quantity of reflected light at a predetermined timing, a result of the n-th (n is an integer which satisfies $n \geqq 2$) output and a result of the (n−1)-th output or results of outputs to (n−1)-th output to a comparison are subjected to a comparison, if change larger than a predetermined degree is confirmed, detection that ink in the ink tank has been reduced is made.

Other and further objects, features and advantages of the invention will be evident from the following detailed description of the preferred embodiments in conjunction with the attached drawings.

BRIEF DESCRIPTION OF THE DRAWINGS

FIGS. 20, 21 and 22 show the structure of an ink sensor according to the embodiment of the present invention, in which FIG. 20 shows a state where the carriage is at a capping position, FIG. 21 shows a state where carriage is at a position to record an image on a relatively thin recording medium, and FIG. 22 shows a state where the same is at a position to record an image on a relatively thick recording medium;

DESCRIPTION OF THE PREFERRED EMBODIMENTS

Figure 1:
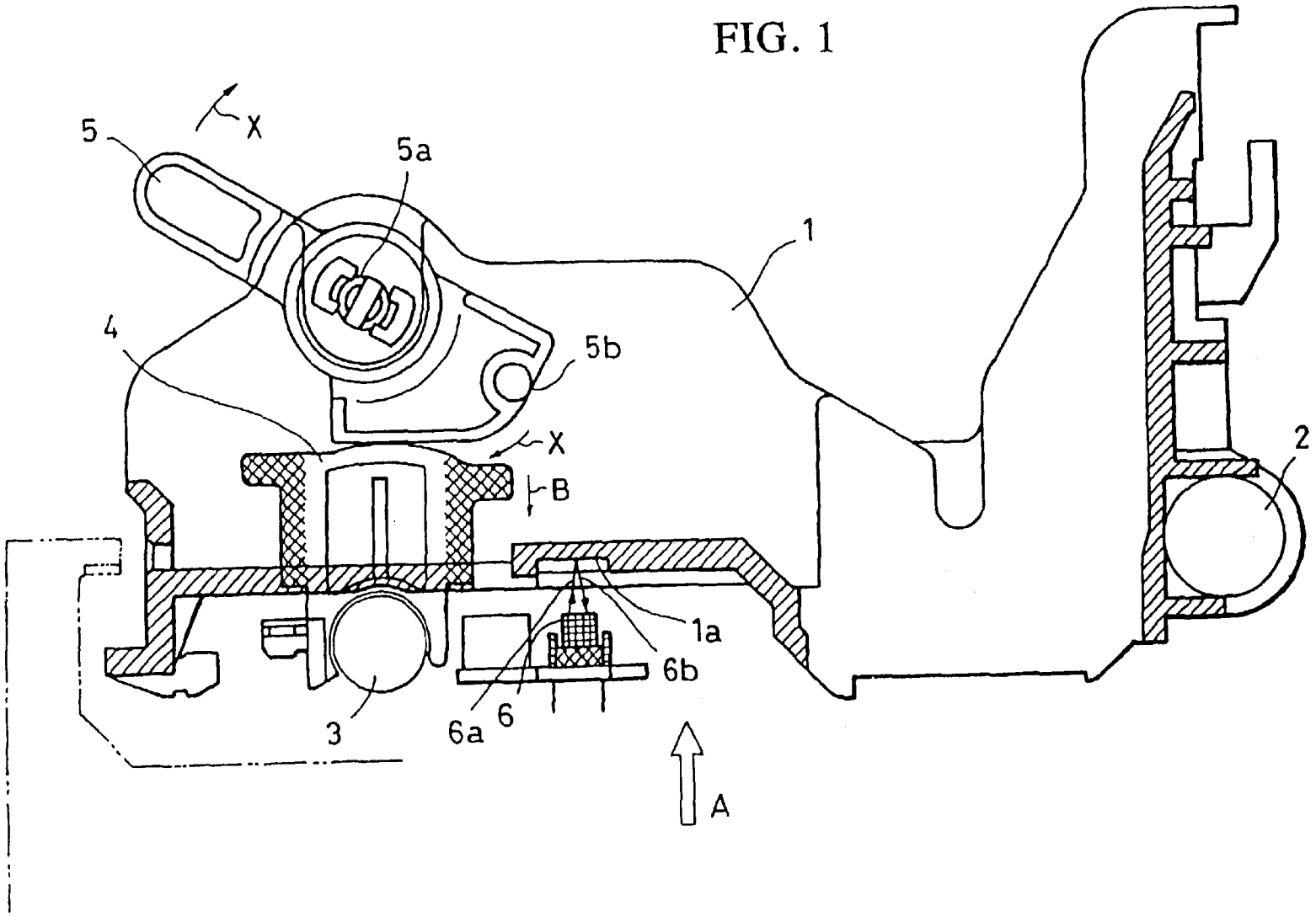
FIG. 1 is a side view showing a carriage according to an embodiment of the present invention.

Referring to the drawings, embodiments of the present invention will now be described.

First Embodiment

Figure 4:
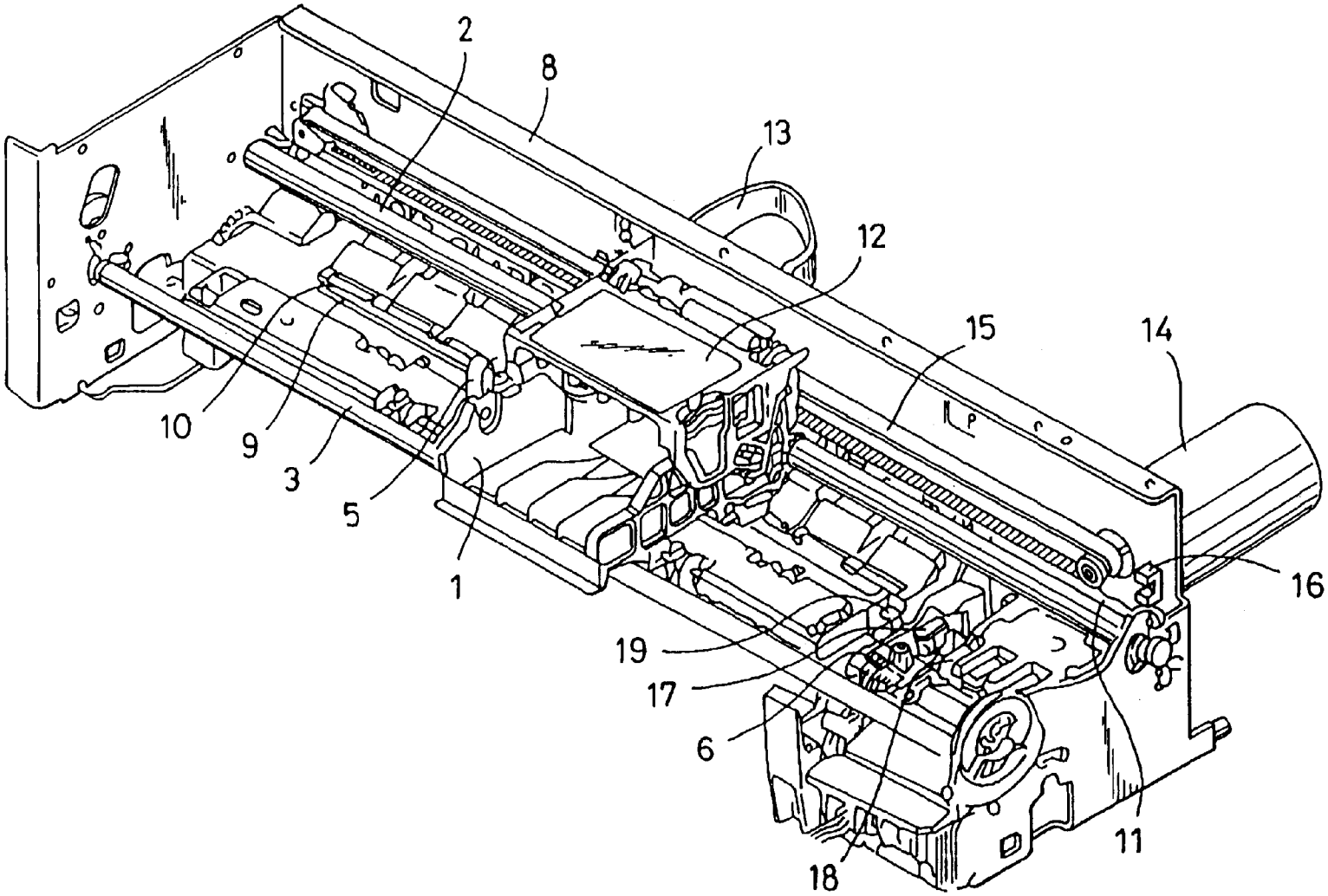
FIG. 4 is a schematic view showing the overall apparatus according to the embodiment of the present invention.

FIG. 4 is a schematic perspective view showing the structure of an ink jet recording apparatus according to the present invention. The ink jet recording apparatus shown in FIG. 4 has a structure formed on the basis of the ink jet recording apparatus disclosed in Japanese Patent Laid-Open No. 6-40043 and the structure according to the present invention is added.

Referring to FIG. 4, reference numeral 8 represents a chassis to which components are attached, 9 represents a paper feeding roller disposed in the longitudinal direction of the ink jet recording apparatus and arranged to move recording paper (not shown), and reference numeral 10 represents a pinch roller disposed in parallel to the paper feeding roller 9 and arranged to press the recording paper against the paper feeding roller 9. Reference numeral 2 represents a guide shaft disposed opposite to the paper feeding roller 9 and as well as in parallel to the same. Reference numeral 11 represents a scale portion of a linear encoder disposed opposite to the guide shaft 2 and as well as in parallel to the same.

Reference numeral 1 represents a carriage which is moved along the guide shaft 2. Reference numeral 12 represents a head cover for securing an ink jet head (not shown) to the carriage 1, and 13 represents a flexible substrate with which a recording data signal can be transmitted from a control portion of the apparatus to the ink jet head mounted on the carriage 1 and an output signal can be transmitted from a sensor (not shown) of the magnetic linear encoder to the control portion of the apparatus.

Reference numeral 3 represents a support shaft disposed in parallel to the guide shaft 2 and arranged to maintain the attitude of the carriage 1 which is capable of rotating around the guide shaft 2. Reference numeral 14 represents a carriage motor for moving the carriage 1 along the guide shaft 2 for performing scanning, and 15 represents a timing belt for transmitting the rotational force of the carriage motor 14 to the carriage 1. Reference numeral 16 represents a transmission type photointerrupter disposed in the scanning region for the carriage 1 to set the reference position for the scanning operation to be performed by the carriage 1.

Reference numeral 17 represents a suction cap for preventing defective discharge of the ink jet head and recovering the suction operation. Reference numeral 18 represents a protective cap for protecting a discharge port (hereinafter called a "nozzle") of the ink jet head from being dried during standby of the ink jet head. Reference numeral 5 represents a paper-position switch lever disposed on the carriage 1 to switch the clearance between the recording paper and the ink jet head in accordance with the thickness of the recording paper. Reference numeral 6 represents a reflective photointerrupter disposed adjacent to the home position for the carriage 1 to serve as an ink sensor. Reference numeral 19 represents a sub-discharge port for receiving ink droplet during previous discharge to be performed prior to performing the printing operation in order to prevent clogging of the nozzle portion of the ink jet head.

Figure 2:
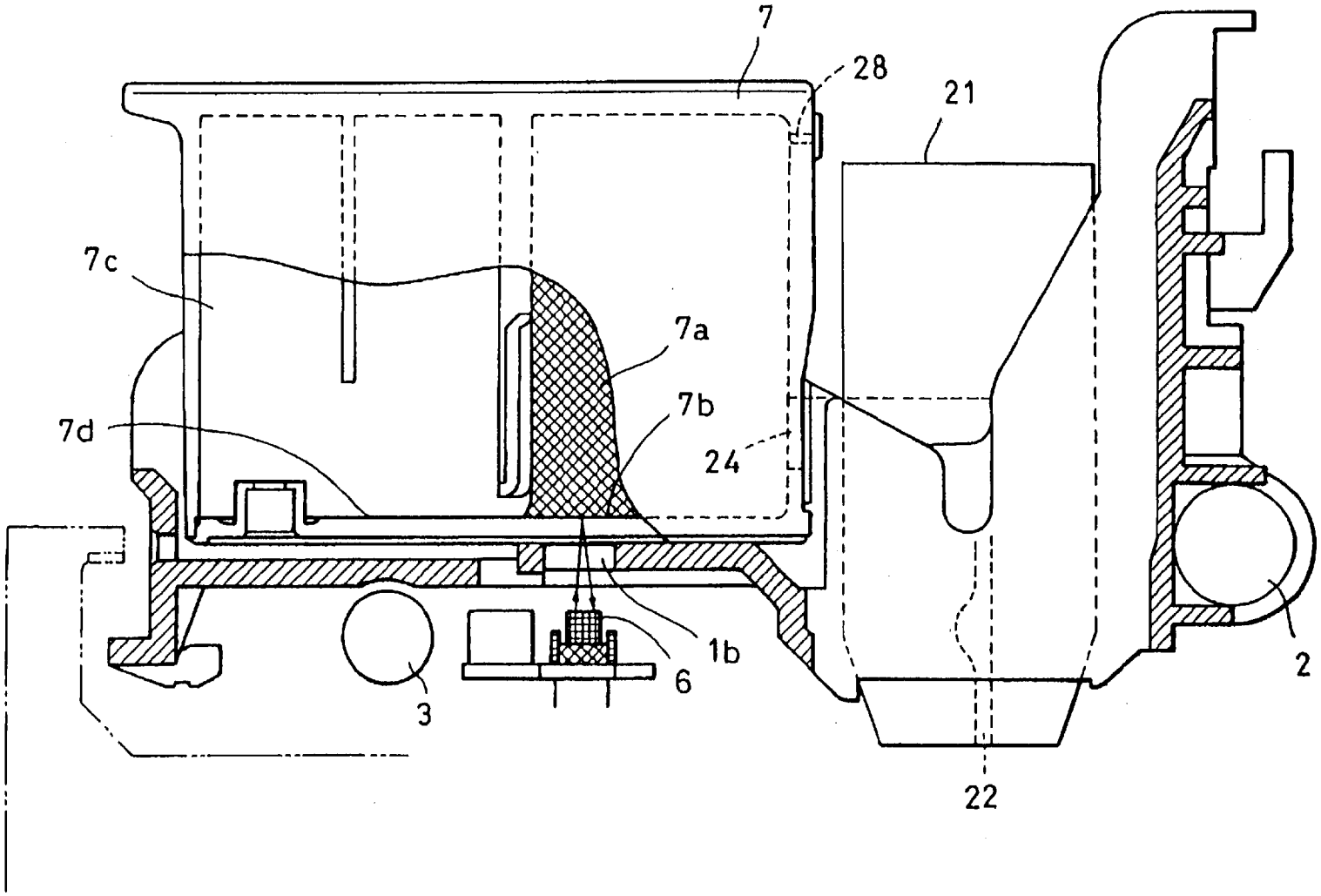
FIG. 2 is a diagram showing a state where an ink tank and a head are mounted on the carriage shown in FIG. 1.
Figure 3:
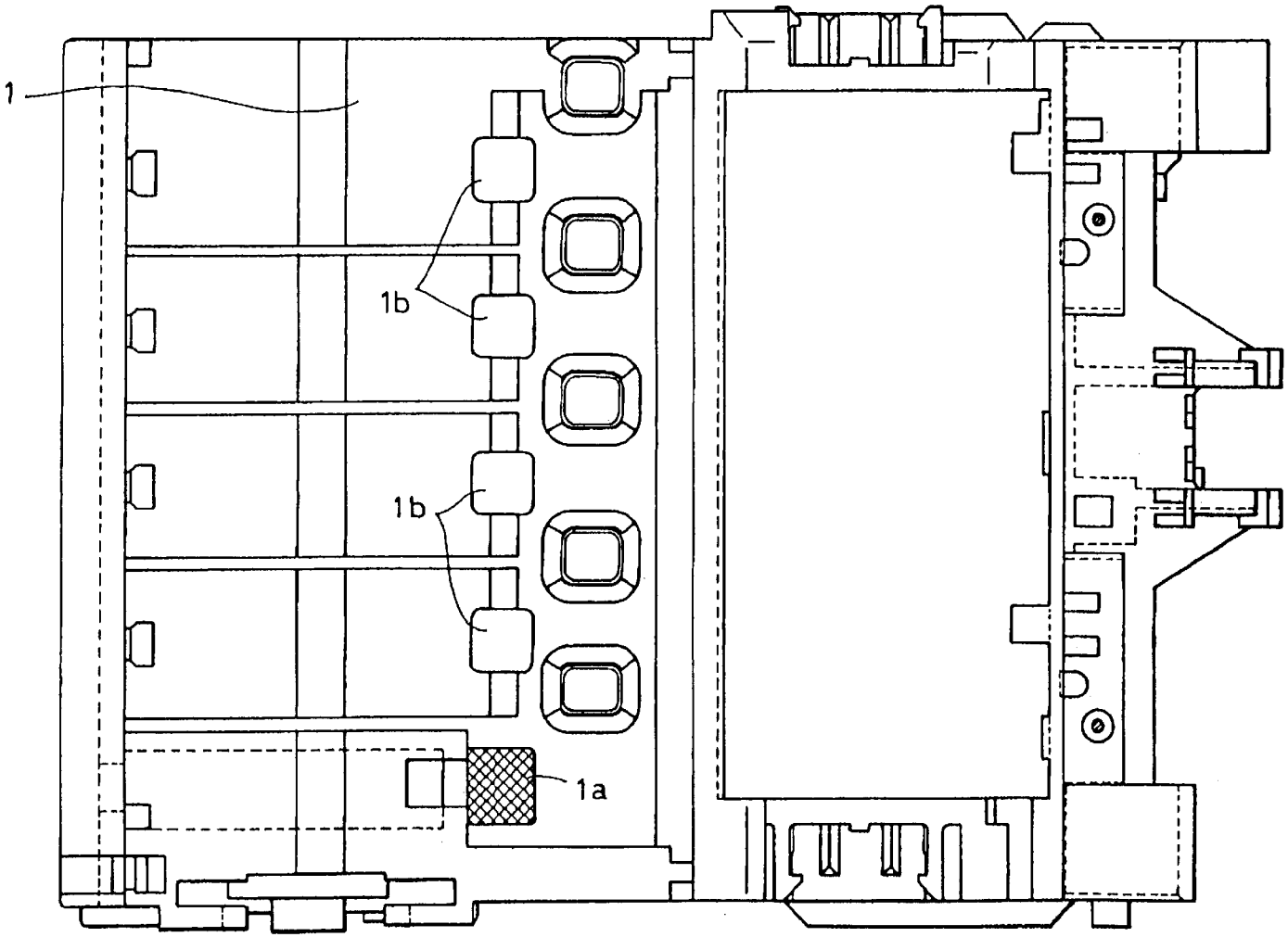
FIG. 3 is a schematic view showing the carriage when viewed from a bottom portion.

FIG. 1 is a side view showing the carriage 1, FIG. 2 is a diagram showing a state where the ink tank is mounted on the carriage 1 shown in FIG. 1, and FIG. 3 is a view A of the carriage 1 shown in FIG. 1.

Referring to FIGS. 1, 2 and 3, the relationship between the carriage 1 and the photointerrupter 6 in terms of the position and the principle for detecting the residual quantity of ink will now be described.

Referring to FIGS. 2 and 3, reference numeral 1*b* represents an aperture formed in the bottom of the carriage 1 to allow light from the photointerrupter 6 to pass through.

Referring to FIG. 2, reference numeral 21 represents a printing head for discharging ink through a nozzle 22 formed at the leading end thereof. Reference numeral 7 represents an ink tank mounted on the carriage 1. Reference numeral 7*a* represents an absorber disposed in the ink tank 7 to serve as a negative pressure generating member. Reference numeral 7*b* represents a boundary portion between the absorber 7*a* in the ink tank 7 and an outer wall 7*e* of the ink tank 7. Reference numeral 7*c* represents an ink accommodating portion (hereinafter called as "a raw ink accommodating portion") for accommodating, in the ink tank 7, ink in a state where ink is not mixed with another member, that is, in a raw state (hereinafter called "raw ink"). Reference numeral 7*d* represents a boundary portion between the raw ink in the ink tank 7 and the outer wall 7*e* of the ink tank 7. The material of the ink tank 7 is transparent plastic or the like having transmissivity with respect to detection light of the photointerrupter 6. Reference numeral 24 represents a supply port for supplying ink to the printing head 21. Reference numeral 28 represents an air communication port for gas-liquid conversion as the ink is consumed.

The printing head 21 and the ink tank 7 are, while being integrated with each other, mounted on the carriage 1 to be slid on the shafts 2 and 3 so as to be scanned in the vertical direction of the drawing sheet.

Figure 5:
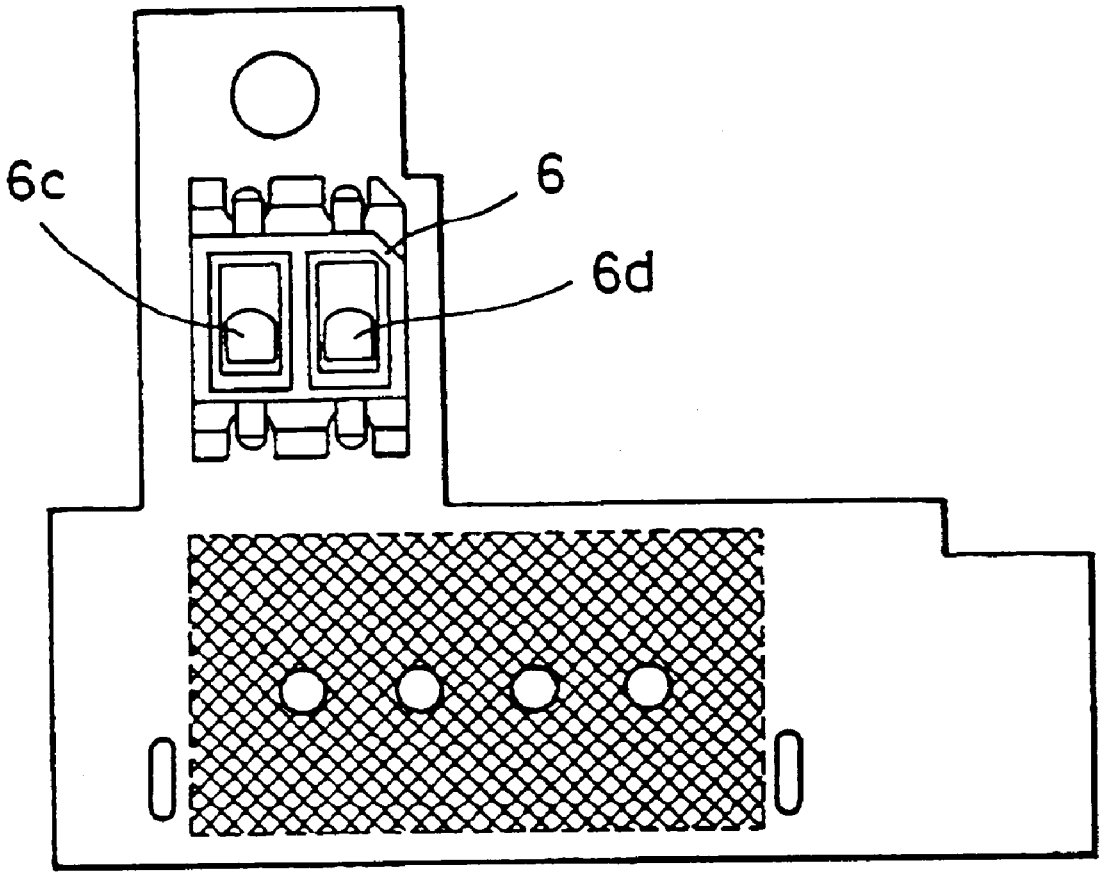
FIG. 5 is a diagram showing the structure of a sensor for detecting the residual quantity according to the embodiment of the present invention.

FIG. 5 is a plan view showing the substrate on which the photointerrupter 6 is mounted. Reference numeral 6*c* represents a light emitting portion, and 6*d* represents a light receiving portion. Reference numeral 6*a* represents a light passage (hereinafter called as a "return light passage") through which light 6*b* emitted by the light emitting portion 6*c* and then reflected returns, light being then received by the light receiving portion 6*d* shown in FIG. 5. The foregoing light passage have the reflection surface which may be the surface of the drawing sheet on which FIG. 1 is illustrated or which may be the surface perpendicular to the foregoing drawing sheet. If the attitude of the carriage 1 is changed considerably when the paper-position switch lever 5 is operated, it is preferable that the surface perpendicular to the drawing sheet, on which FIG. 1 is illustrated, to eliminate the influence of the attitude difference. Although the light passage is drawn in the form of straight lines to simplify the illustration, it is actually light beams each having a certain width.

The photointerrupter 6 is disposed to correspond to a position of the absorber 7*a* in the ink tank 7 which is somewhat adjacent to the raw ink accommodating portion 7*c*. The foregoing position affects the residual number of printable sheets at a moment at which the photointerrupter 6 detects detection light. As for the vertical position of the photointerrupter 6, it is preferable that the boundary portion 7*b* between the wall surface of the ink tank 7 and the absorber 7*a* be located adjacent to the focal position of the photointerrupter 6. If the boundary portion 7*b* is out of the focal position of the photointerrupter 6, the detection light expands excessively and light is reflected and scatters at the edge of the aperture 1*b* of the carriage 1, whereby lowering the S/N ratio in detection.

In this embodiment, description will be performed about a color ink jet recording apparatus having a structure that a plurality of different color inks can be discharged as shown in FIG. 4. A plurality of different color inks are accommodated in corresponding ink tanks mounted on the carriage 1. Therefore, ink absorbed by the absorber 7*a* is any of black, cyan, magenta or yellow which are usually used in a color printer. Ink sequentially flows from the absorber 7*a*, the supply port 24 and a passage 30 in the printing head 21, and then ink is supplied with heat from a heating means (hereinafter called as a "heaters") 31 serving as a discharge means provided for the nozzle 22. Thus, the thermal energy, which has been supplied rapidly, causes ink to foam so that ink is discharged through the discharge port at the leading end of the nozzle 22. Thus-discharged ink adheres to a medium, such as paper, so that an image is printed.

The photointerrupter 6 is formed by integrating the LED, which is the light emitting device 6*c*, and the light receiving device 6*d*. The LED emits infrared rays having permeability with respect to all of the four colors, and also the light receiving device 6*d* has a sufficient sensitivity with respect to the wavelength of the LED.

The photointerrupter 6 is disposed individually from the carriage 1 to irradiate the bottom surface of the absorber 7*a* with infrared rays through the aperture 1*b* formed in the carriage 1 and the wall 7*e* of the ink tank 7 so as to detect reflected light 6*b* by the light receiving device 6*d* thereof. The foregoing structure, in which the photointerrupter 6 serving as the detection system is individually disposed apart from the carriage 1 enables the power supply line and signal line from the apparatus body to the carriage 1, which is the movable portion to be omitted from the structure. Thus, the structure can be simplified and the cost can be reduced.

Figure 6:
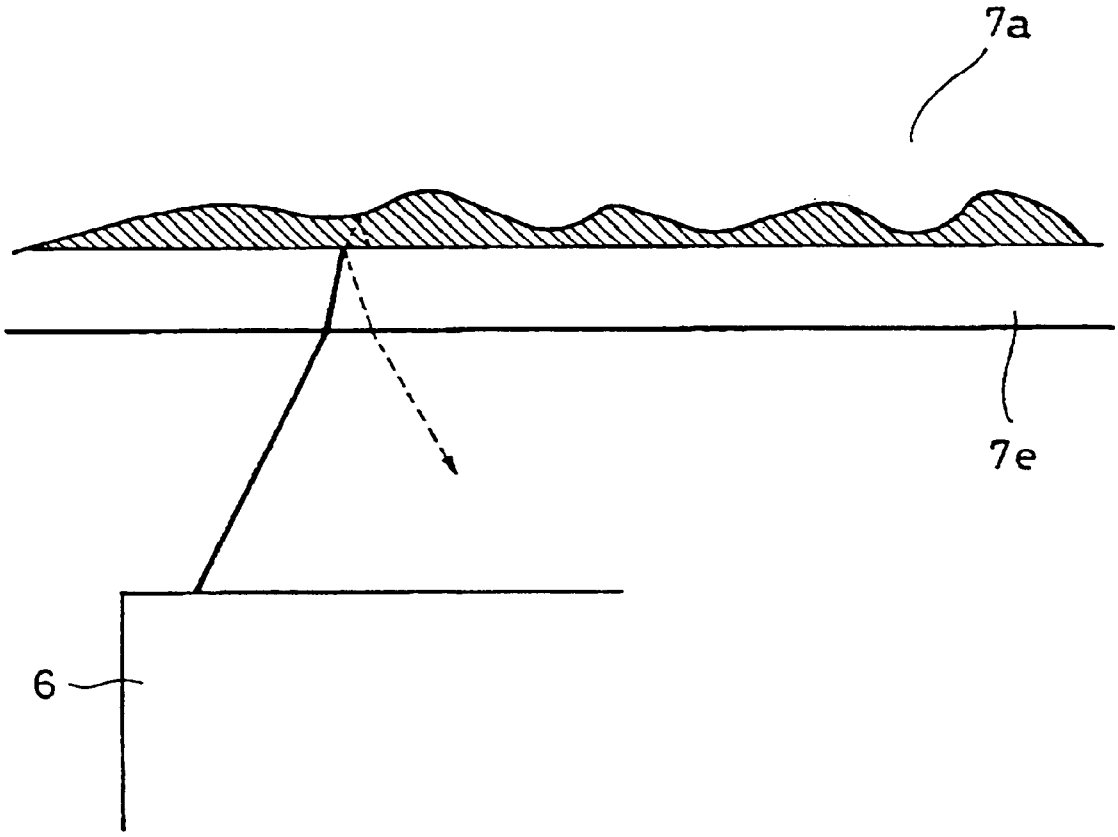
FIGS. 6 and 7 show a principle of detecting the residual quantity of ink according to the present invention.
Figure 7:
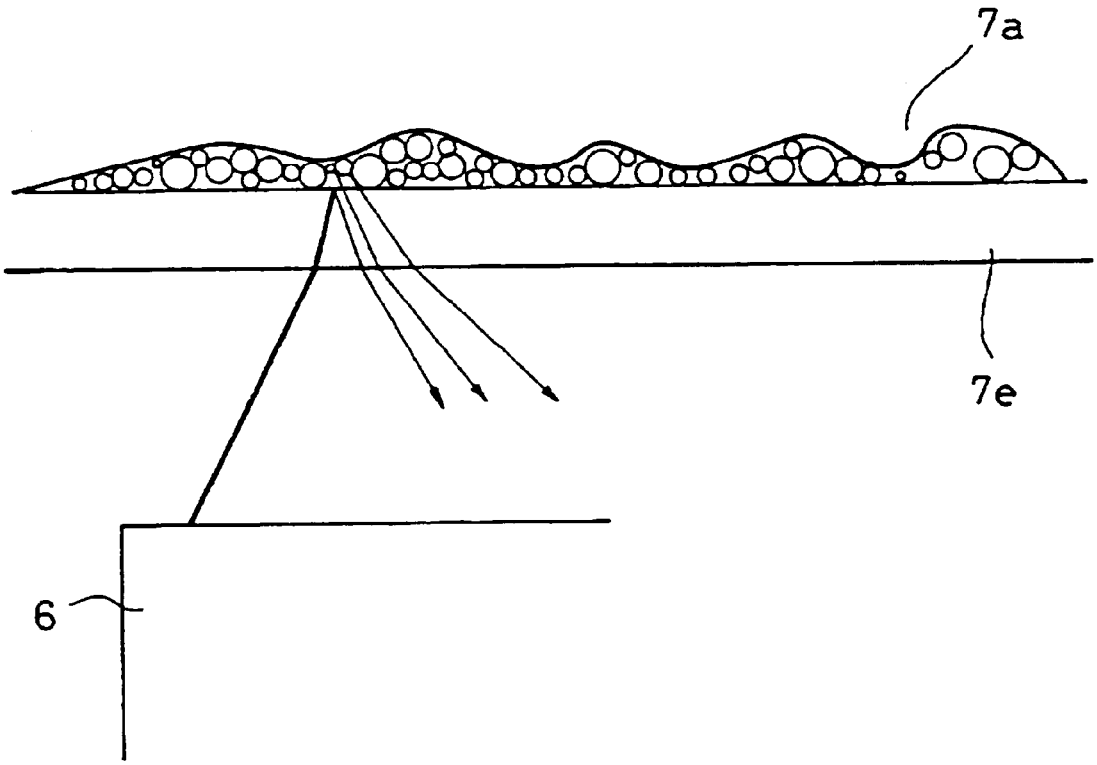
Figure 8:
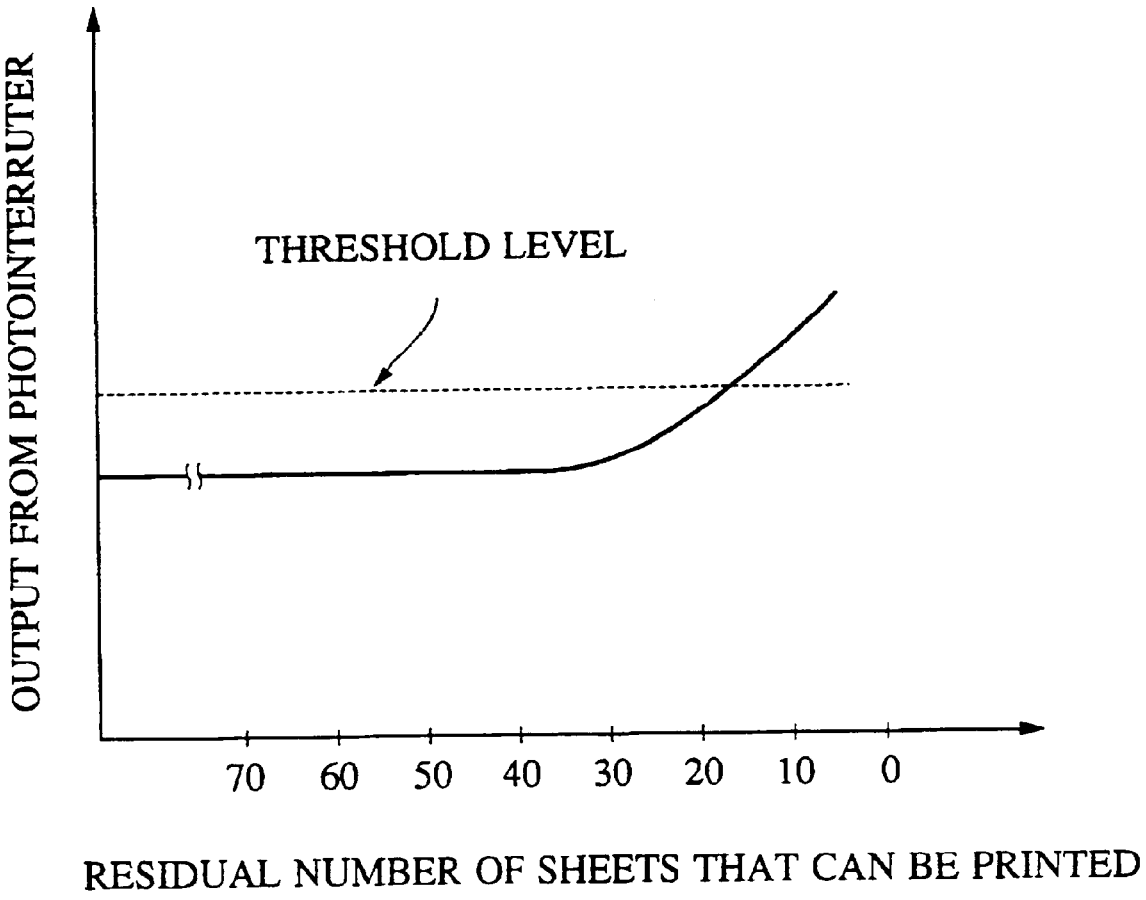
FIG. 8 shows the output from a photointerrupter according to the embodiment of the present invention.

FIG. 6 is an enlarged view of a portion of the lower surface of the absorber 7*a* irradiated with light from the photointerrupter 6 in a case where a sufficiently large quantity of ink is enclosed in the ink tank 7. FIG. 7 is an enlarged view showing a state where the same portion in a case where ink is empty. FIG. 8 is a graph showing change in the output from the light receiving portion 6*d* of the photointerrupter 6 occurring in accordance with the quantity of residual ink.

The principle for detecting the residual quantity of ink employed in the present invention will now be described.

In general, Fresnel's formulas showing the amplitude reflectance of light on the boundary surface between mediums 1 and 2 having different refractivities are as follows:

*p*-polarization component:

$$rp = \frac{n2 \cdot \cos\theta 1 - n1 \cdot \cos\theta 2}{n2 \cdot \cos\theta 1 + n1 \cdot \cos\theta 2}$$

*s*-polarization component:

$$rp = \frac{n1 \cdot \cos\theta 1 - n2 \cdot \cos\theta 2}{n1 \cdot \cos\theta 1 + n2 \cdot \cos\theta 2}$$

where n1: refractivity of medium 1 n2: refractivity of medium 2

θ1: angle made by a light beam in the medium 1 from normal line

θ2: angle made by a light beam in the medium 2 from normal line (the foregoing four factors have a relationship expressed by n1·sin θ1=n2·sin θ2).

In this embodiment, assuming that light emitted from the light emitting portion 6*c* of the photointerrupter 6 is made incident upon the ink tank 7 at substantially perpendicular angle, an assumption can be made that cos θ=1. Squaring the foregoing formula to express with energy reflectance in place of the amplitude reflectance, the following formula is given:

$$R = \frac{(n1 - n2)^2}{(n1 + n2)^2}$$

If a sufficiently large quantity of ink is accommodated in the ink tank 7, the gap between the wall surface 7*e* of the ink tank 7 and the absorber 7*a* is filled with ink, as shown in FIG. 6. Since the ink tank 7 and the absorber 7*a* are made of plastic having a refractivity of about 1.5 and the ink has a refractivity of about 1.4, each of the inner wall of the ink tank 7 and the surface of the absorber 7*a* has a poor reflectance of about 0.1%.

As ink is consumed, air is, as shown in FIG. 7, introduced into the gap between the wall surface 7*e* of the ink tank 7 and the absorber 7*a* through the air communication port 8 shown in FIG. 6. Each of the inner wall of the ink tank 7 and the surface of the absorber 7*a* has a reflectance of about 4% in the case of empty of ink. That is, if no ink exists, the quantity of reflected light increases to about 40 times (however, influences of light except light reflected by the boundary portion 7*c*, such as light reflected by the outer bottom surface of the ink tank 7 and electric noise inhibit detection of the foregoing difference in the output).

Although detection at the boundary portion 7*d* between the ink tank 7 and the raw ink accommodating portion 7*c* is performed by the photointerrupter 6, the difference in the reflectance arises. In comparison to the foregoing case, the number of the reflecting factors are different as follows:

TABLE 1

| Reflecting Factor | Absorber | Raw Ink Portion |
|---|---|---|
| Ink Tank to Ink | V | V |
| Absorber to Ink | V | — |
| Scattering in Absorber | V | — |
| Total | 3 | 1 |

Thus, detection at the absorber enables a large number of reflecting factors, which is three times that in the other cases. As a result, the quantity of reflected light can be enlarged, whereby enabling accurate detection while eliminating noise, as described above.

Air introduced into the space between the absorber 7*a* and the ink tank 7 usually exists in the form of a multiplicity of small bubbles as shown in FIG. 7 when it passes through the absorber 7*a*. Also foregoing light scattering effect increases the quantity of reflected light.

Although foregoing reflectance is attained in the case where cos θ=1, the reflectance is made considerably different depending upon the existence of ink in other cases. Since the output from the light receiving portion 6*d* of the photointerrupter 6 is, in any case, made considerably different in accordance with the difference in the reflectance, the existence of ink in the ink tank 7 can be detected in accordance with the difference in the output.

In actual, the photointerrupter 6, with light, irradiates a portion having a certain area in place of irradiating a point even if its focal point is irradiated with light. As ink in the region having the certain area runs out, the output from the photointerrupter 6 is continuously changed.

In FIG. 8, the axis of abscissa stands for the residual number of printable sheets until ink runs out and no ink is discharged, whereas the axis of ordinate stands for the output from the photointerrupter 6. In accordance with the curve indicating change in the output, a discrimination is performed that ink in the ink tank 7 has been reduced considerably if the value exceeds a predetermined threshold (a residual quantity enabling about 15 sheets to be printed is determined to be the threshold). The alarm LED on the display panel of the body of the ink jet recording apparatus is turned on so that user is able to recognize depletion of ink.

The number of residual number of printable sheets indicated when the depletion of ink is displayed can be increased or decreased by changing the threshold level. As can be understood from FIG. 8, the number smaller than that at which the output is made (the residual number of sheets of 30 in the case of FIG. 8) cannot easily be displayed. The number of printable sheets when the output is performed can be changed by shifting the detection position performed by the photointerrupter 6. Thus, the alarm can be issued to correspond to a desired number of printable sheets.

To reliably prevent defective printing operation, the printing operation may be interrupted in place of issuing the alarm or simultaneously with issuing of the alarm. In the foregoing case, the temporal interruption results in an improvement in the effect of the alarm.

As described above, this embodiment has the structure that light emitted by the light emitting portion 6*c* and reflected by the ink tank 7 having the absorber 7*a* serving as the negative pressure generating member is detected by the light receiving portion 6*d*, and depletion of ink in the ink tank 7 can be detected in accordance with the output level.

The absorber 7*a* serves as a negative pressure control member for controlling the negative pressure of ink supplied from the ink tank 7 and also serves as a reflection control member for controlling reflected light of light emitted by the light emitting portion 6*c* so that depletion of ink in the ink tank 7 including the absorber 7*a* is accurately detected.

In this embodiment, four ink tanks 7 corresponding to four colors adapted to a color printer are arranged laterally. Therefore, movement of the carriage 1 causes the ink tanks 7 for the respective colors to sequentially face the photointerrupter 6 so that the residual quantity of ink in each tank 7 is detected. Since changes in the outputs corresponding to all colors must be respectively followed, corresponding memory means are required. Although it is preferable that display indicating depletion of ink be performed for each of the four colors in the foregoing case, display of depletion of any one of the four colors may be performed in order to prevent the display panel of the body of the ink jet recording apparatus from being complicated.

When the present invention is adapted to a color printer to detect the residual quantities of inks in ink tanks corresponding to the four colors by one photointerrupter, the position in the ink tank, at which the negative pressure generating member is disposed, is detected. Therefore, movement of ink can substantially be prevented when the carriage is moved, whereby enabling the residual quantity of ink in each ink tank to be detected.

In this embodiment, detection is performed through the bottom surface of the ink tank 7. However, the present invention is not limited to the structure in which detection is performed through the bottom surface of the ink tank 7. The detection may be performed through the side surface or the upper surface.

However, it is preferable that detection be performed through the bottom surface of the ink tank 7.

The density in the absorber 7*a* is not usually uniform, and ink is removed in the form of spots when ink is depleted. Therefore, even if ink exists, the photointerrupter 6 accidentally detects a portion, from which ink has been depleted or a contrary case will take place. Therefore, even if the same levels are detected, the residual number of printable sheets are made different. If the worst comes to worst, ink can be depleted without issue of the alarm.

Since ink can easily be accumulated on the bottom surface of the ink tank 7 due to the gravity, the influence of the density distribution in the absorber 7*a* can be eliminated. Therefore, detection performed through the bottom surface of the ink tank 7 enables the residual quantity of ink to be detected accurately.

As described, the present invention enables depletion of ink to be detected in accordance with the change in the reflectance at a position at which detection is performed. The actual reflectance may be calculated to use the detected actual reflectance as a reference for detecting the depletion of ink. The quantity of light emitted by the photointerrupter can be detected in response to a signal supplied to the light emitting portion 6*c*. In accordance with the quantity of emitted light and the quantity of light received by the light receiving portion 6*d*, the reflectance can be calculated. Even if the quantity of light emitted by the LED forming the light emitting portion 6*c* disperses, the discrimination of the depletion of ink is performed in accordance with the change in the reflectance. Therefore, the result of the detection is not substantially affected.

Second Embodiment

A second embodiment of the present invention will now be described with reference to the drawings.

This embodiment is able to overcome a problem experienced with the structure for detecting the residual quantity of ink according to the first embodiment taking place due to scattering in the quantity of light emitted by the light emitting means and the sensitivity of the light receiving means forming the photointerrupter.

Figure 15:
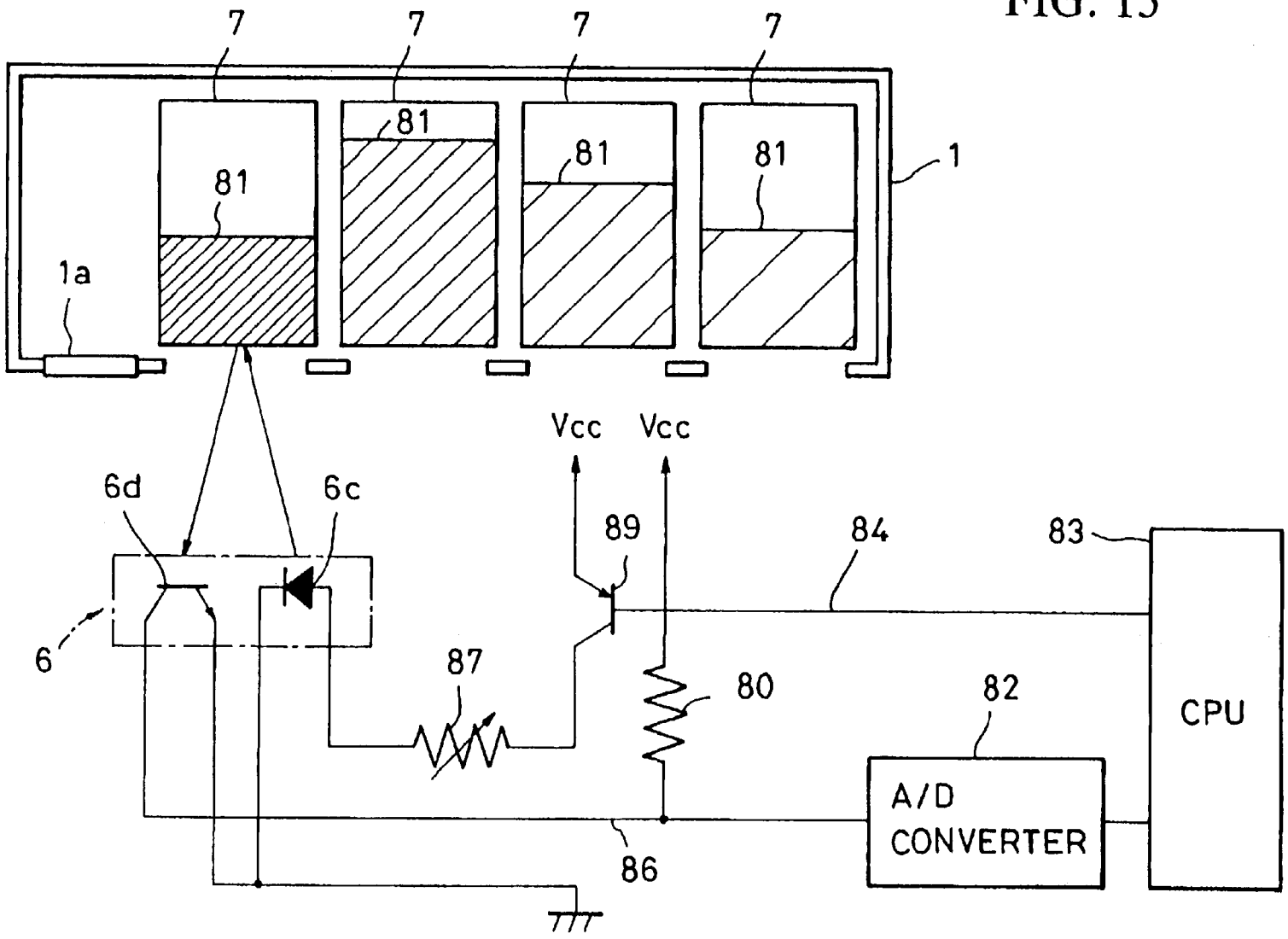
FIG. 15 is a block diagram showing the schematic structure of the residual quantity detection apparatus according to the embodiment of the present invention.

FIG. 15 is a schematic view of a residual quantity detection apparatus employing a method in which light is made incident on the transparent ink tank according to the first embodiment to detect reflected light. Referring to FIG. 15, reference numeral 7 represents each of four ink tanks, 1 represents a carriage 1 on which each ink tank 7 is mounted, and 1*a* represents a reflecting portion for calibration provided for the carriage 1. Reference numeral 81 represents each of four types of inks accommodated in the corresponding ink tanks 7. An ink jet recording head capable of discharging ink 81 in each ink tank 7 is mounted on the carriage 1 so that the carriage 1 is moved in the horizontal direction when viewed in FIG. 18 in a state where the recording head discharges the ink 81. Thus, an image can be recorded on a recording medium such as paper.

Reference numeral 6*c* represents an LED (Light Emitting Diode) serving as the light emitting portion, 6*d* represents a phototransistor serving as a light receiving portion, 87 represents a variable resistor for limiting an LED current, 89 represents a transistor for turning on/off the LED 6*c*, 80 represents a load resistor for the phototransistor 6*d*, 82 represents an A/D converter, 83 represents a LED on/off signal, and 86 represents a raw output voltage from the phototransistor.

When the LED on/off transistor 89 is turned on in response to the LED on/off signal 84 supplied from the CPU 82, the LED 6*c* is turned on. If ink 81 exists in the transparent ink tank 7, light is not reflected by the boundary portion between the ink 81 and the inner surface of the ink tank 7. Therefore, the difference between the activation voltage and the dark voltage of the output voltage 86 from the phototransistor 6*d*, that is, the difference (hereinafter simply called as an "output from the phototransistor 6*d*") between the output voltage 86 (the activation voltage) obtained when the LED 6*c* is turned on and the output voltage 86 (the dark voltage) obtained when the LED 6*c* is turned off is small. If no ink 81 exists in the ink tank 7, light is reflected between the boundary portion between the ink 81 and the ink tank 7. Therefore, the output from the phototransistor 6*d* is enlarged. Therefore, existence of ink 81 can be detected by detecting the output voltage 86 by the A/D converter 82.

Referring to a flow chart shown in FIG. 16, the method of detecting whether or not ink exists will now be described.

Initially, in step S61 the carriage 1 is moved by the carriage moving mechanism (not shown) in order to irradiate the ink tank 7 with light emitted by the LED 6*c*. In step S62 the output voltage 86 is detected in a state where the LED 6*c* is turned off. The output (the dark voltage) in the case where the LED 6*c* is expressed as Voff. In step S63 the output voltage 86 is detected in a state where the LED 6*c* is turned on. The thus-detected output voltage (called as activation voltage) is expressed as Von.

In step S64 output V (Voff−Von) is calculated.

In step S65 whether or not output V is larger than a predetermined reference voltage Vth is discriminated. If the output V is larger than Vth, a discrimination is performed that ink exists. If the output V is smaller than Vth, a discrimination is performed that no ink exists.

In step S66 operation, such as display, corresponding to the result of detection whether or not ink exists is performed.

As the LED 6*c* and the phototransistor 6*d*, the photointerrupter 6 including the light emitting portion and the light receiving portion in one package is usually employed. Since the lifetime of the photointerrupter 6 is usually shorter than that of the printer, the LED 6*c* is turned on by the LED on/off transistor 89 only when the ink existence is detected to shorten the time in which the photointerrupter 6 is supplied with electric power.

Since both light emission quantity of the LED 6*c* and the sensitivity of the phototransistor 6*d* of a photointerrupter 6 scatter, the combined photocurrent output characteristic of the LED 6*c* and the phototransistor 6*d* scatters by about two times to four times between the upper limit and the lower limit. In a case where the photointerrupter 6 is used to serve as the ink empty detection apparatus, the output from the photointerrupter 6 must be adjusted to be included in a predetermined range, that is, so called calibration must be performed.

The calibration is performed, for example, in such a manner that a reflecting portion 1*a* for calibration having a predetermined reflectance is provided for the carriage 1, the carriage 1 is shifted by a carriage moving mechanism (not shown) to cause the reflecting portion 1*a* to be irradiated with light from the LED 6*c*, and light reflected by the reflecting portion 1*a* is detected by the phototransistor 6*d*. To cause the output from the phototransistor 6*d* to be included in a predetermined range, a variable resistor 87 for limiting the LED current is adjusted.

However, the foregoing conventional example suffers from the following problems. The calibration operation cannot easily be automated as described above, the number of manufacturing processes increases to perform accurate adjustment, and the output changes due to change in the quantity of light emitted by the LED 5 as the time lapses and due to contamination of the photointerrupter 6. As a result, there arises a problem in that accurate detection cannot easily be performed.

This embodiment is able to overcome the foregoing problem and the detection means is enabled to automatically adjusted.

This embodiment is adapted to an ink jet recording apparatus which is arranged similarly to that according to the first embodiment, and descriptions of the basic structure of the apparatus and the principle for detecting the residual quantity are omitted here.

Figure 9:
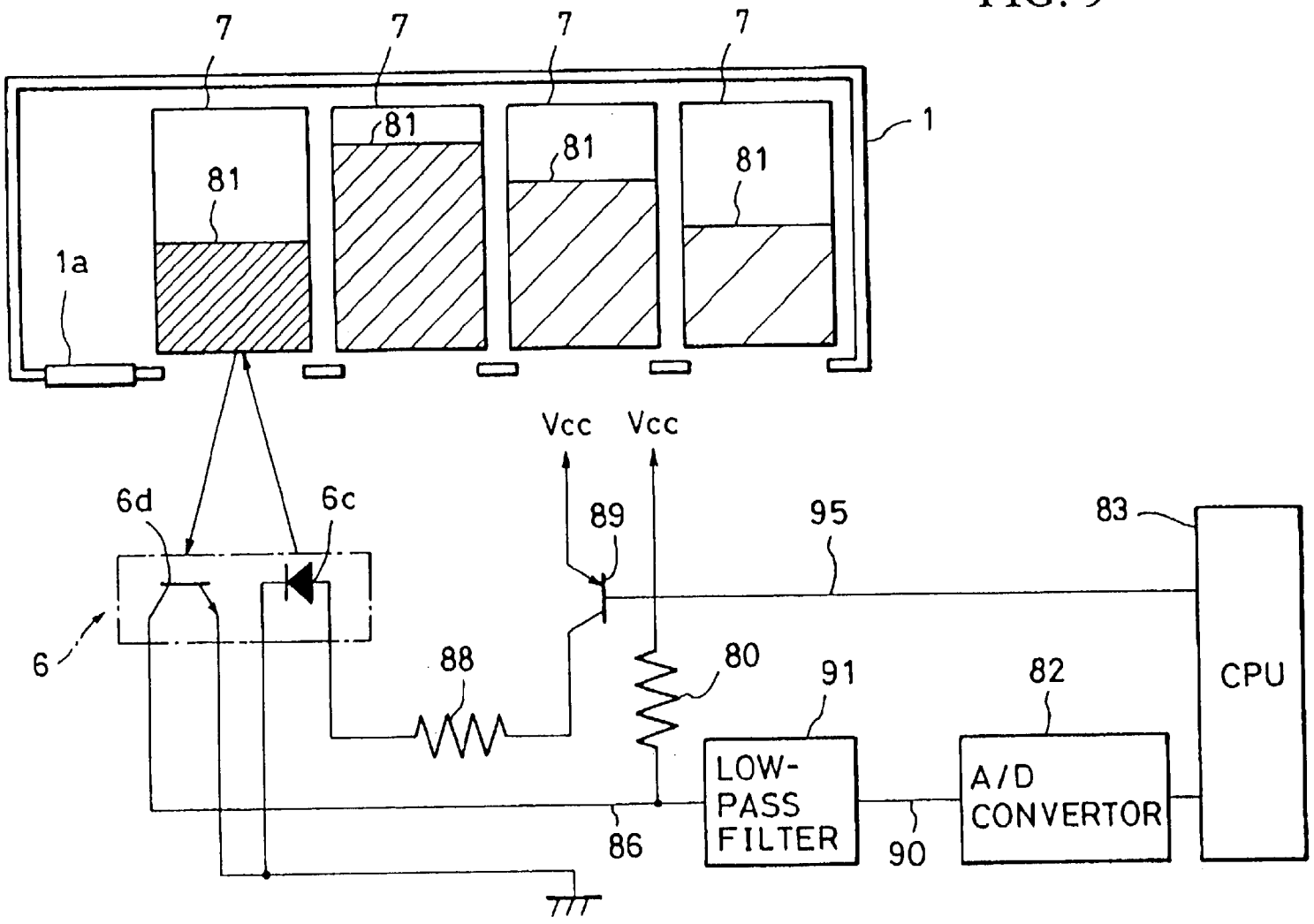
FIG. 9 is a schematic block diagram showing a residual quantity detection apparatus according to the embodiment of the present invention.

FIG. 9 is a schematic view showing the structure of an ink existence detection apparatus according to this embodiment and adapted to a color ink jet recording apparatus.

Reference numeral 7 represents an ink tank, 1 represents a carriage, on which the ink tank 7 is mounted, 1*a* represents a reflecting portion for calibration provided for the carriage 1, 81 represents ink, 6*c* represents an LED serving as a light emitting portion, 6*d* represents a phototransistor serving as a light receiving portion, 87 represents an LED current limiting resistor, 89 represents an LED on/off transistor, 80 represents a phototransistor load resistor, 91 represents a low-pass filter, 82 represents an A/D converter, 83 represents a CPU, 95 represents a PWM signal for turning on/off the LED 6*c*, 86 represents a raw output voltage from the phototransistor 6*d*, and 90 represents output voltage through the low pass filter 91.

Figure 10:
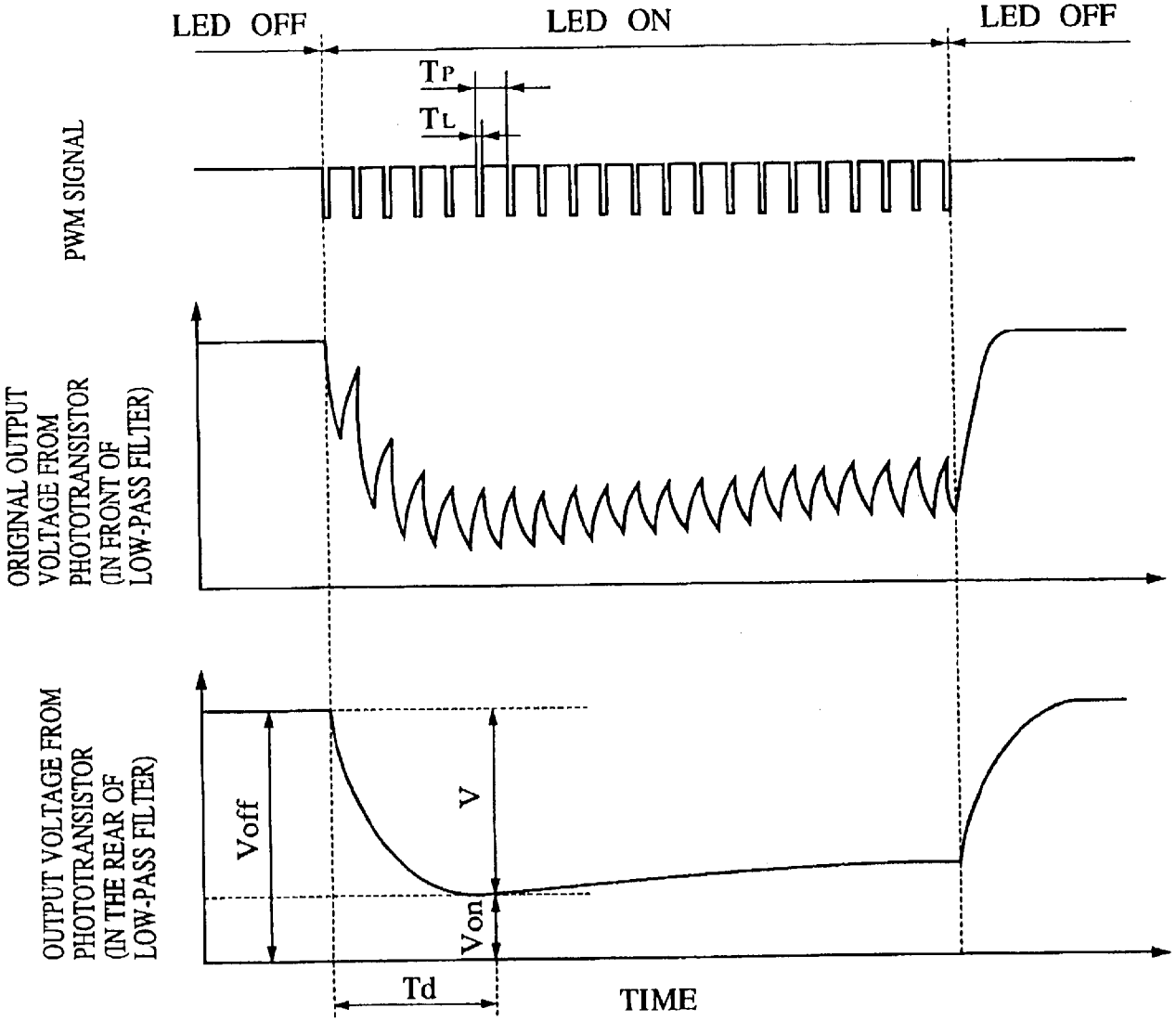
FIG. 10 is a timing chart of the operation of the residual quantity detection apparatus shown in FIG. 9.

FIG. 10 is a timing chart showing the relationship among the PWM signal 95, the duty ratio, turning of the LED 6*c* on/off, the raw output voltage 86 from the phototransistor 6*d*, and the output voltage 90 through the low-pass filter 91, where Tp: PWM period TL: time in which LED is turned on TD: time taken from turning LED on to measurement Voff: output voltage in a state where LED is turned off Von: output voltage in a state where LED is turned on V: output Duty Ratio=TL/TP In response to the PWM signal 95, the transistor 89 is turned on and off in a cycle of several KHz to several hundreds of KHz to turn the LED 6*c* on. In a case where ink 4 exists in the transparent ink tank 7, light is not reflected by the boundary portion between ink 81 and the transparent ink tank 7. Therefore, output from the phototransistor 6*d* is small, while the output is large if ink 81 does not exist because light is not reflected by the boundary portion between ink 81 and the transparent ink tank 7. Therefore, detection of the output voltage 90 by the A/D converter 82 enables the existence of ink to be detected. The low-pass filter 91 is provided to remove the period component of the PWM signal 95 superimposed on the raw output voltage 86.

Referring to a flow chart shown in FIG. 11, the calibration method will now be described.

In step S1 irradiation of the reflection portion 1*a* for calibration with light emitted by the LED 6*c* is realized by moving the carriage 1 by a carriage moving mechanism (not shown).

In step S2 the output voltage 90, which is Voff, in a state where the LED 6*c* is turned off, is detected.

In step S3 whether or not Voff is higher than a certain voltage level $V_{max0}$ is discriminated. If Voff is lower than $V_{max0}$, a discrimination is performed that an electric current leaked from the phototransistor is larger than a predetermined value. Thus, the operation is shifted to step S15 in which a discrimination is performed that a defect has occurred. In the foregoing case, disconnection or defect of the sensor due to failure of the LED can be considered.

The foregoing $V_{max0}$ is output voltage obtainable from the maximum value of the electric current leaked from the phototransistor and holds a formula (Vcc−maximum leakage electric current×current limiting resistance).

In step S4 the duty ratio stored in a non-volatile RAM is used as the initial duty ratio of the PWM signal 95.

In the flow chart above, Duty represents the duty ratio of the PWM signal, and D0 represents the duty ratio stored in the non-volatile RAM (the duty ratio for use in detecting existence of ink).

In step S5 the duty ratio of the PWX signal 95 is set.

In step S6 the output voltage of the LED 6*c* is detected in a case where the LED 6*c* is turned on, the detecting output voltage 90 being used as Von.

Figure 16:
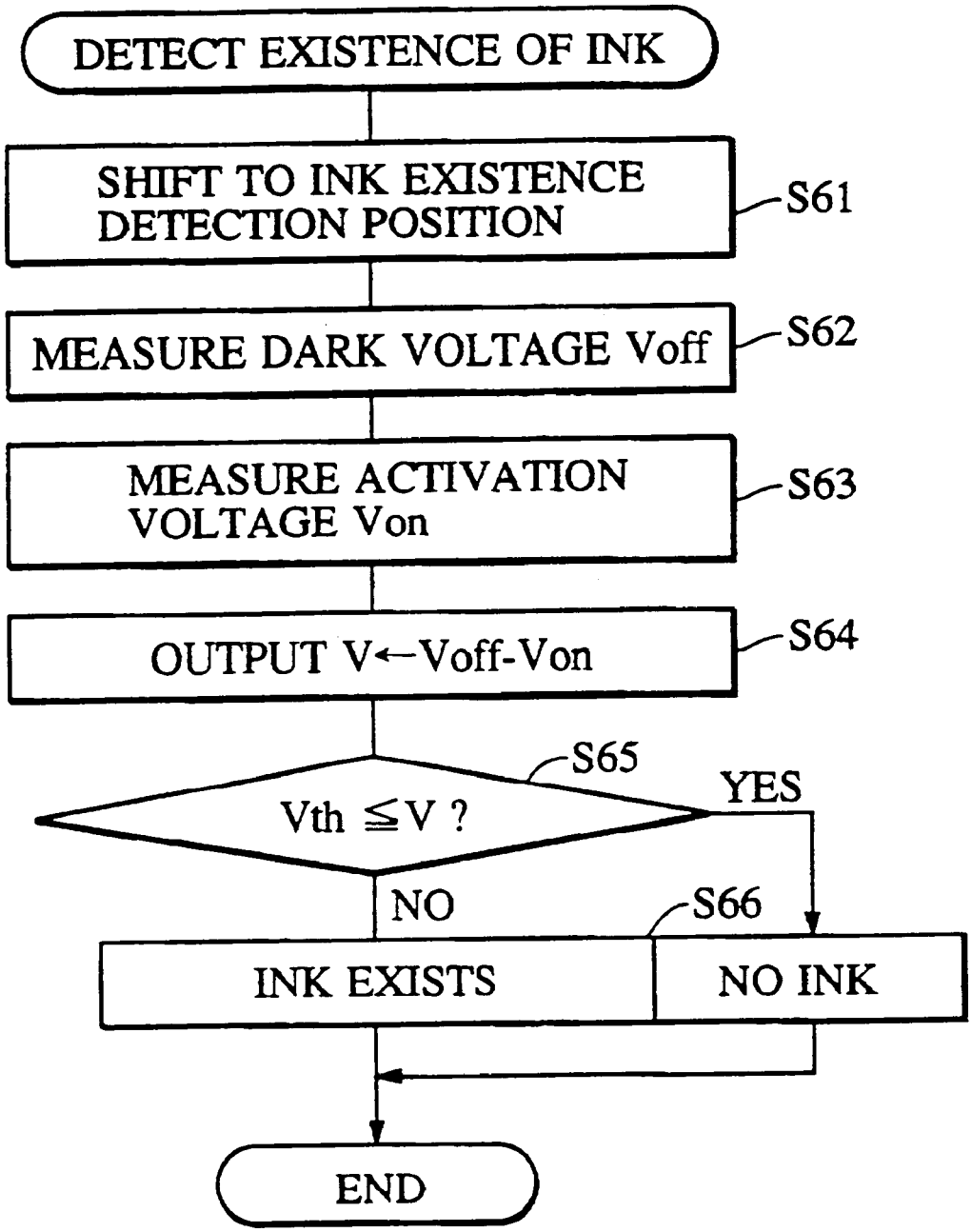
FIG. 16 is a flow chart of a method of detecting the residual quantity employed by the residual quantity detection apparatus shown in FIG. 15.

In step S7 the output V is calculated which is similar to v shown in step S56 shown in FIG. 16.

In step S8 whether or not V is higher than a certain $V_{min0}$ is discriminated. If V is lower than $V_{min0}$, a discrimination is performed that the LED 6*c* or the phototransistor 6*d* has been broken down or disconnected. Thus, a discrimination is performed that a defect has taken place, and the operation shifts to step S15. In the foregoing case, disconnection or defect of the sensor due to failure of the LED can be considered.

In the flow chart above $V_{min0}$ is a threshold with which whether or not a failure has taken place is discriminated.

If an affirmative discrimination has been performed in step S8, the operation proceeds to step S9 in which whether or not the output V is included in a certain voltage range is discriminated. If the output V is included in the foregoing range, a discrimination is performed that the duty ratio of the PWM signal 95 has been adjusted. Then, the operation is removed from the loop and shifted to step S13. In step S9 whether or not the output V satisfies Vmin1<V<Vmax1 is discriminated, where Vmin1 represents the lower limit of the adjusted output and Vmax1 represents the upper limit of the adjusted output. If a negative discrimination is performed in step S9, the operation proceeds to step S10 in which the duty ratio of a next PWM signal 95 is calculated from the output V and a target output.

The duty ratio Duty of the next PWM signal 95 can be determined by the product of the duty ratio Duty of the present PWM signal 95 and (target output Vtarget/present output V), where Vtarget indicates a target output during calibration.

In step S11 whether or not the duty ratio is included in a certain range is discriminated. If the duty ratio is out of the foregoing range, a discrimination is performed that the combined photoelectric current output characteristic does not satisfy a required characteristic or contamination of the reflection portion 1*a* for calibration or the LED 6*c* or the phototransistor 6*d* caused the reflectance to be changed excessively to perform accurate detection. Thus, the operation proceeds to step S15 in which a discrimination is performed that a defect has occurred.

The discrimination as to whether or not the duty ratio is included in a certain range is performed by subjecting the lower limit Dmin of adjusted duty ratio and the upper limit Dmax of the adjusted duty ratio to a comparison.

If a discrimination has been made in step S11 that the duty ratio is included in the certain range, whether or not the number of retries of the loop for adjusting the duty ratio is too many is discriminated in step S12. If the number of retries is allowable, the operation returns to step S5. If the number of retrials is larger than a certain number, the operation proceeds to step S15 in which a discrimination is performed that a defect has taken place. In step S13 the duty ratio calibrated this time is used as the duty ratio for use in detecting whether or not ink exists. The final output in the present calibration is used as parameter Vcal for calculating the output ratio.

In step S14 the duty ratio for use in detecting existence of ink and the parameter for calculating the output ratio are stored in a non-volatile storage device (not shown).

If Vcal and D0 have been stored in step S14, the state of the ink existence detection apparatus is set in step S15.

Figure 12:
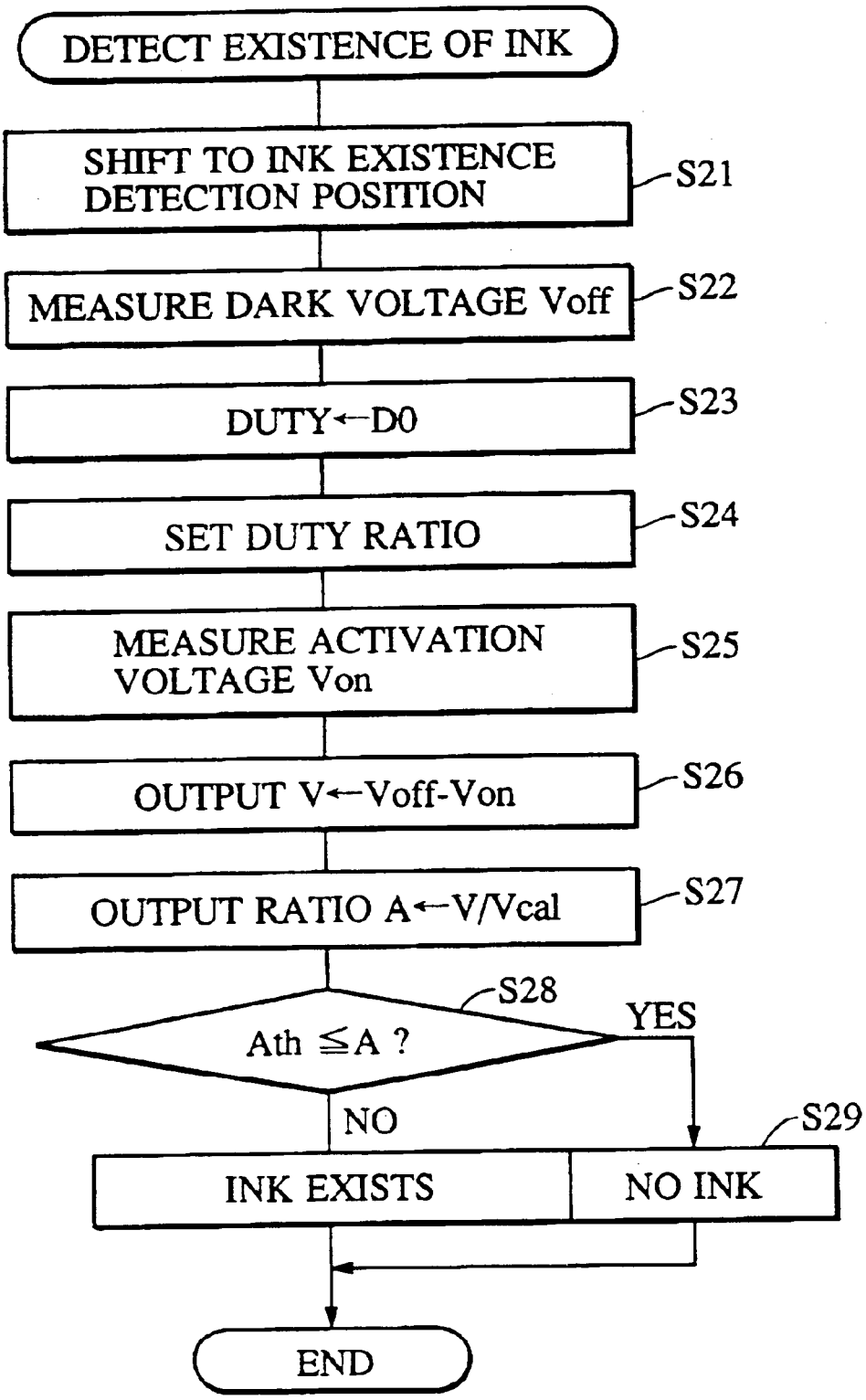
FIG. 12 is a flow chart of a method of detecting existence of ink adapted to the residual quantity detection apparatus shown in FIG. 9.

Referring to a flow chart shown in FIG. 12, the method of detecting existence of ink will now be described.

In step S21 irradiation of the ink tank 7 with light emitted by the LED 6*c* is realized by moving the carriage 1 by a carriage moving mechanism (not shown).

In step S22 the output voltage 90 is detected in a state where the LED 6*c* is turned off, the thus-obtained voltage level being Voff.

In step S23 the duty ratio D0 stored in the non-volatile RAM is used as the initial duty ratio Duty of the PWM signal 95.

In step S24 the duty ratio of the PWM signal 95 is set.

In step S25 the-output voltage 90 is detected in a state where the LED 6*c* is turned on, the thus-obtained voltage level being Von.

In step S26 the output is calculated (V=Voff−Von).

In step S27 output ratio A is calculated (A=V/Vcal).

In step S28 whether or not the output ratio A is larger than a certain value Ath is discriminated. If the output ratio A is smaller than Ath (if a negative discrimination is performed), a discrimination is performed that ink exists. If the output ratio A is larger than Ath (if an affirmative discrimination is performed), a discrimination is performed that no ink exists. In the flow chart above, Ath is the threshold for the output ratio with which the discrimination as to whether or not ink exists is performed.

In step S29 the result of the detection performed in step S28 as to whether or not ink exists is set.

By calculating the ratio of the output during the detection of existence of ink with respect to the output during calibration, the change in the output occurring due to change in the quantity of light emitted by the LED 6*c* as the time lapses and due to change in the output caused from contamination of the photointerrupter 6 can be canceled. Since the lower limit of the adjusted output and the upper limit of the same can be set widely with respect to the target output, the number of looping during the calibration can be decreased.

Third Embodiment

Figure 13A:
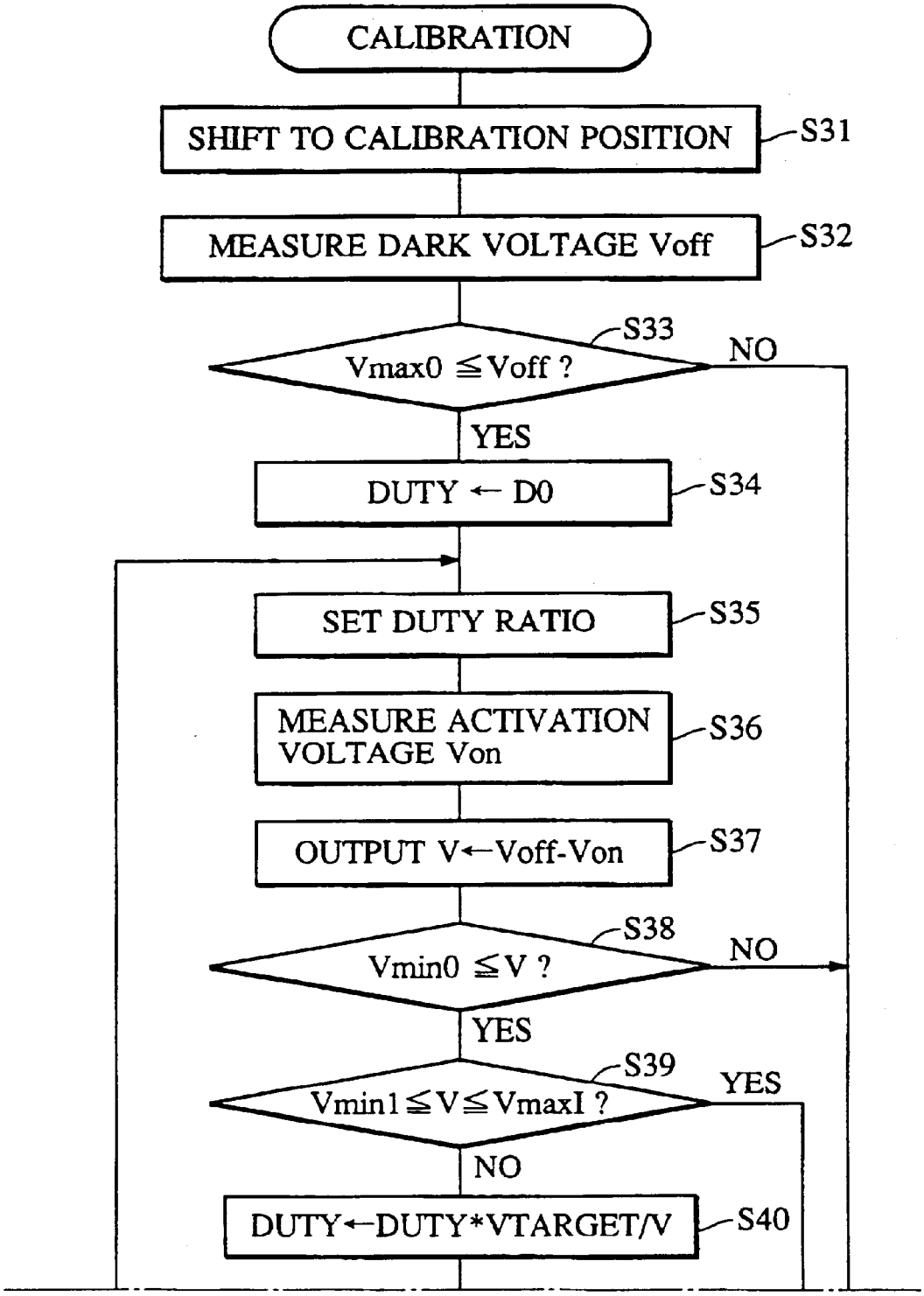
FIG. 13 is a block diagram showing that FIGS. 13A and 13B are to be read as connected flowcharts; of the calibration method according to the embodiment of the present invention.
Figure 13:
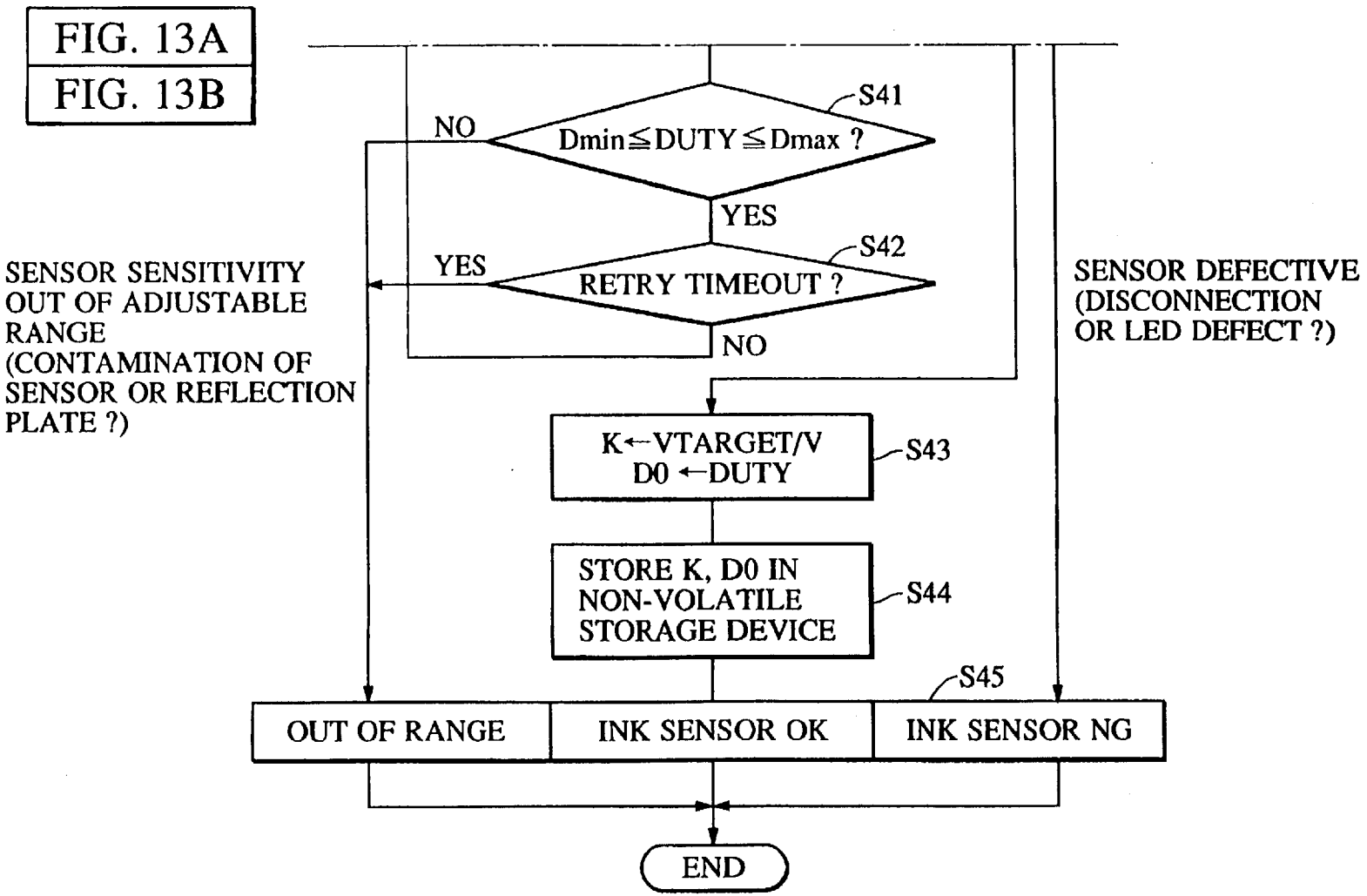

FIG. 13 is a flow chart showing the calibration method according to a third embodiment of the present invention. The structure of the circuit is the same as that according to the second embodiment. Processes to be performed in steps S31 to S42 shown in FIG. 13 are the same as those to be performed in steps S1 to S12 according to the second embodiment and shown in FIG. 11. Therefore, the description will be performed from step 543.

In step S43 the duty ratio for use in detecting existence of ink is subjected to a comparison with the duty ratio calibrated this time, and the correction coefficient K (K=Vtarget/V) is calculated.

In step S44 the duty ratio and a correction coefficient for use in detecting the existence of ink are stored in an non-volatile RAM (not shown).

In step S45 the state of the ink existence detection apparatus is set.

Figure 14:
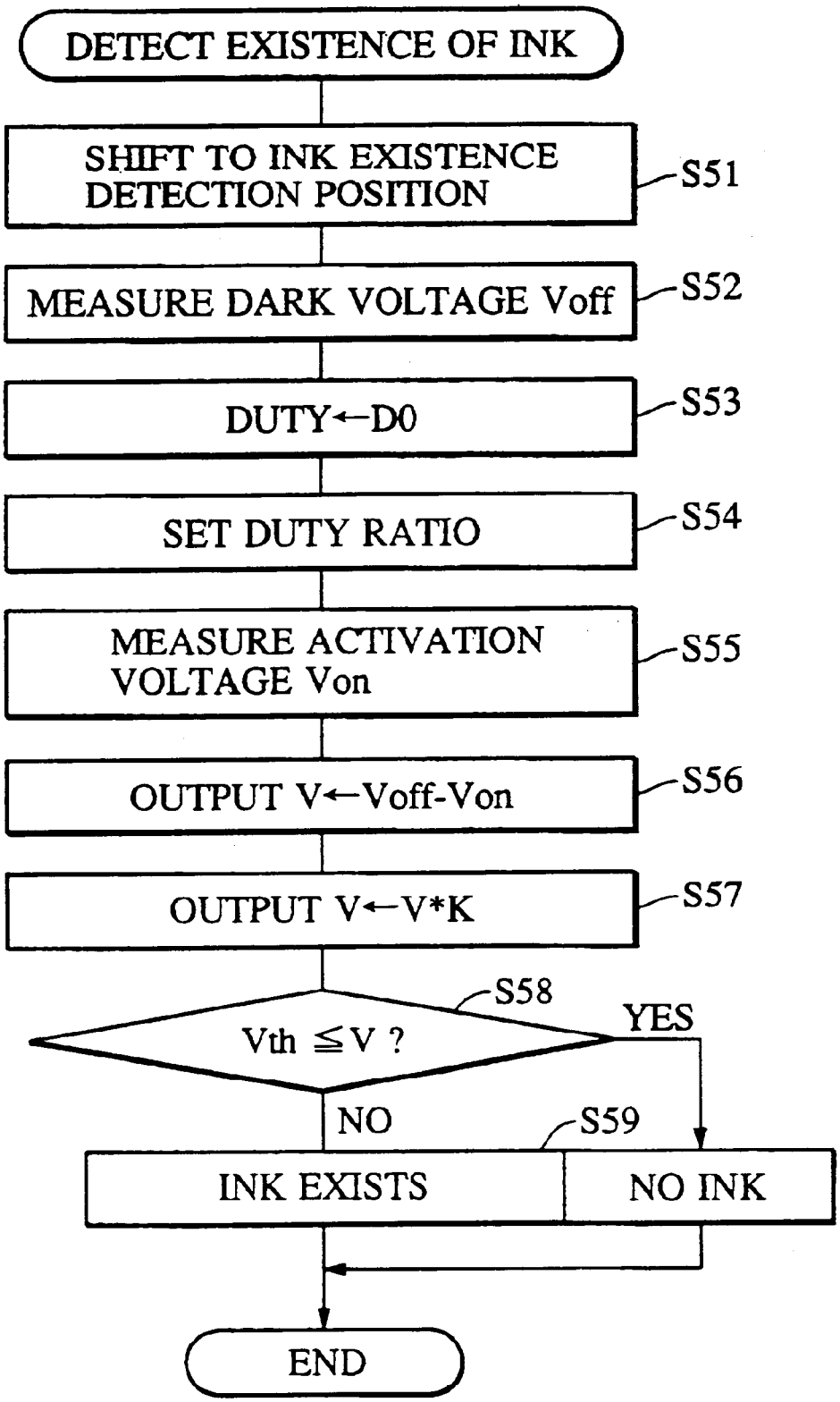
FIG. 14 is a flow chart of a method of detecting existence of ink by means of the residual quantity detection apparatus according to the embodiment of the present invention.

Referring to a flow chart shown in FIG. 14, the method of detecting the existence of ink will now be described. Since the processes in steps S51 to S56 are the same as those in steps S21 to S26 of the ink existence detection method according to the second embodiment, the description will be made from step S57.

In step S57 a value obtained by multiplying the output by the correction coefficient is employed as the output.

In step S58 whether or not the output V is higher than Vth (the threshold of the output ratio with which a discrimination whether or not ink exists) is discriminated. If V is smaller than Vth, a discrimination is performed that ink exists. If V is larger than Vth, a discrimination is performed that no ink exists.

In step S59 the result of detection of the ink existence is set.

By multiplying the output at the time of the detection of the ink existence by the correction coefficient, the output during the detection of the ink existence when the output at the time of the calibration coincides with the target output during the calibration can be calculated. Thus, the change in the output occurring due to change in the quantity of light emitted by the LED 6*c* as the time lapses and due to change in the output caused from contamination of the photointerrupter 6 can be canceled. Since the lower limit of the adjusted output and the upper limit of the same can be set widely with respect to the target output during calibration, the number of looping during the calibration can be decreased. Since the output can be corrected by simply multiplying the output during the detection of ink existence by the correction coefficient K in this embodiment, the division as has been required in the second embodiment is not required. Thus, the load for the software can be reduced.

Fourth Embodiment

A fourth embodiment of the present invention will now be described.

The conventional ink jet recording apparatus has the structure that the distance from the recording paper and the recording head is changed in accordance with the thickness of the paper. Accordingly, there arises a problem in that the displacement in the distance from the recording paper and the recording head must be considered when the sensitivity of the photointerrupter is corrected. In view of the foregoing, this embodiment is made.

Therefore, an object of this embodiment is to realize a function of detecting the residual quantity of ink which is capable of easily correcting the sensitivity and which is capable of precisely detecting a desired quantity of residual ink.

This embodiment can be adapted to the ink jet recording apparatus and the structure for detecting the residual quantity according to the first embodiment shown in FIGS. 1 to 8. The structure of the ink jet recording apparatus and the principle of detecting the residual quantity are omitted from the description.

The correction of the sensitivity of the photointerrupter 6 shown in FIGS. 1, 2, 5 and the like will now be described.

Figure 20:
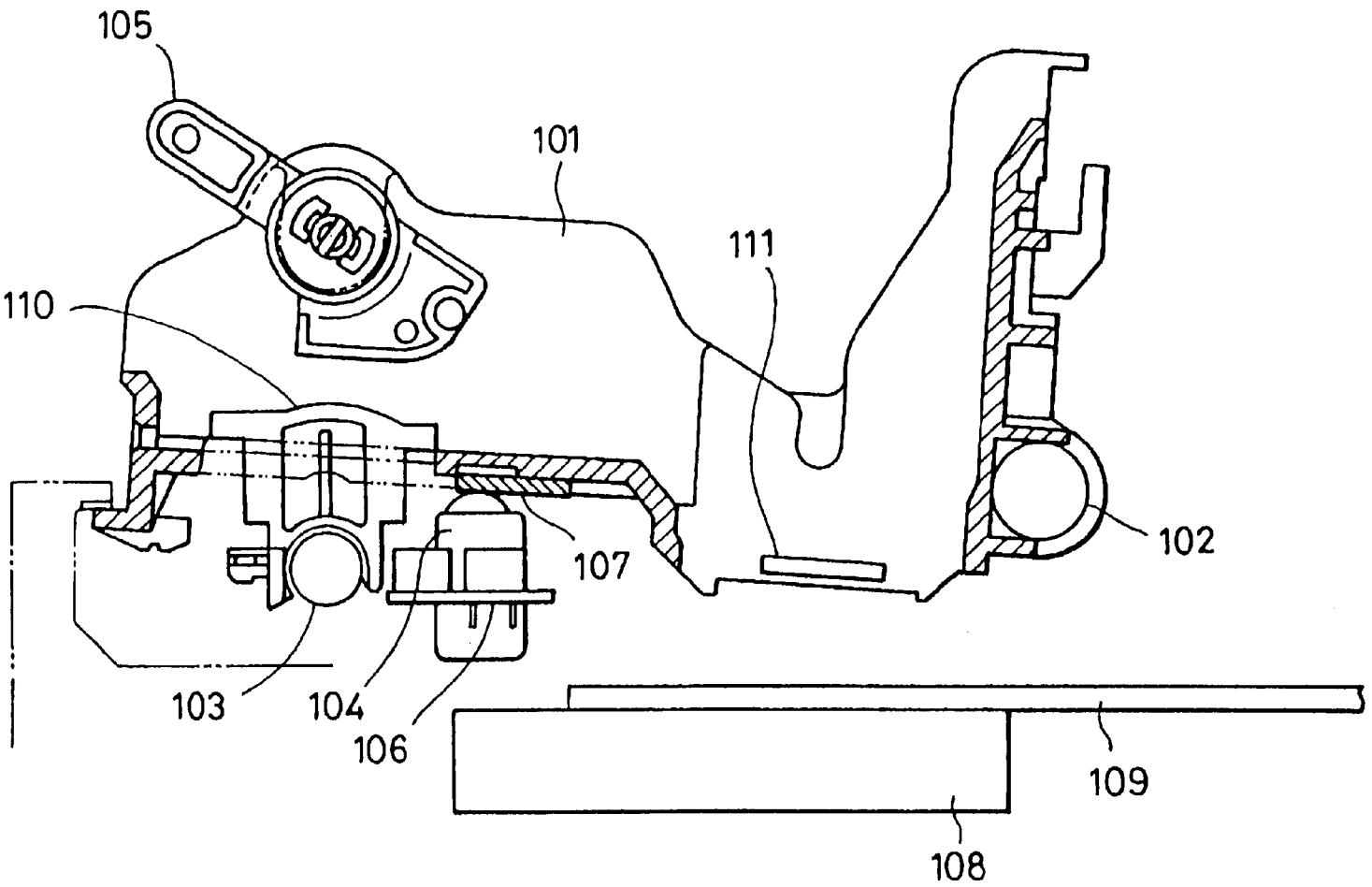

FIG. 20 is a diagram showing a state where a carriage 101 is brought to a position (the capping position) at which capping is performed by a suction cap 17 disposed at an end of the movement passage for the recording head. Referring the FIG. 20, the carriage 101 is moved upwards by a carriage fixing pin 104 in such a manner that a guide shaft 102 is used as the axis.

At the capping position, the photointerrupter 106 is located below a reflecting plate 107 disposed in the bottom portion of the carriage 101. Therefore, light emitted by the photointerrupter 106 is reflected by the reflecting plate 107 so that light returns to the photointerrupter 106. During the printing operation, the carriage fixing pin 104 is moved downwards. The carriage 101 is so supported by the guide shaft 102 and a support shaft 103 as to perform reciprocating operation in the sub-scanning direction for a recording medium 109. The recording medium 109 is moved below the carriage 101.

Figure 21:
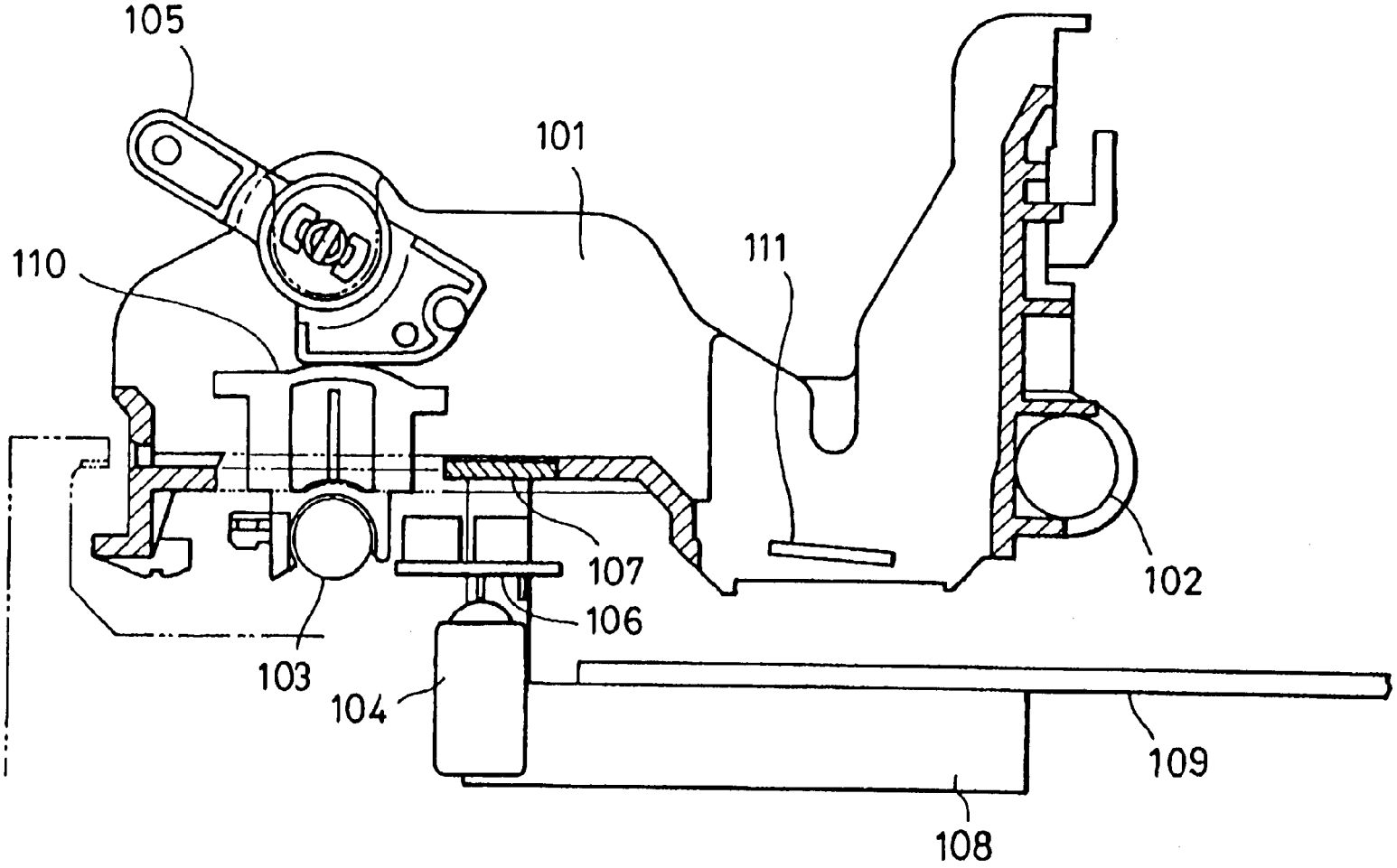

FIG. 21 is a diagram showing a state of the carriage 101 located at a thin-paper position. An paper-distance adjustment lever 105 is located at the same position as the capping position shown in FIG. 20. However, the carriage 101 is not inclined as has been shown in FIG. 20. The reason for this is that the carriage fixing pin 104 is moved downwards and a member for supporting the rear portion of the carriage 101 is changed from the carriage fixing pin 104 to the support shaft 103.

Figure 22:
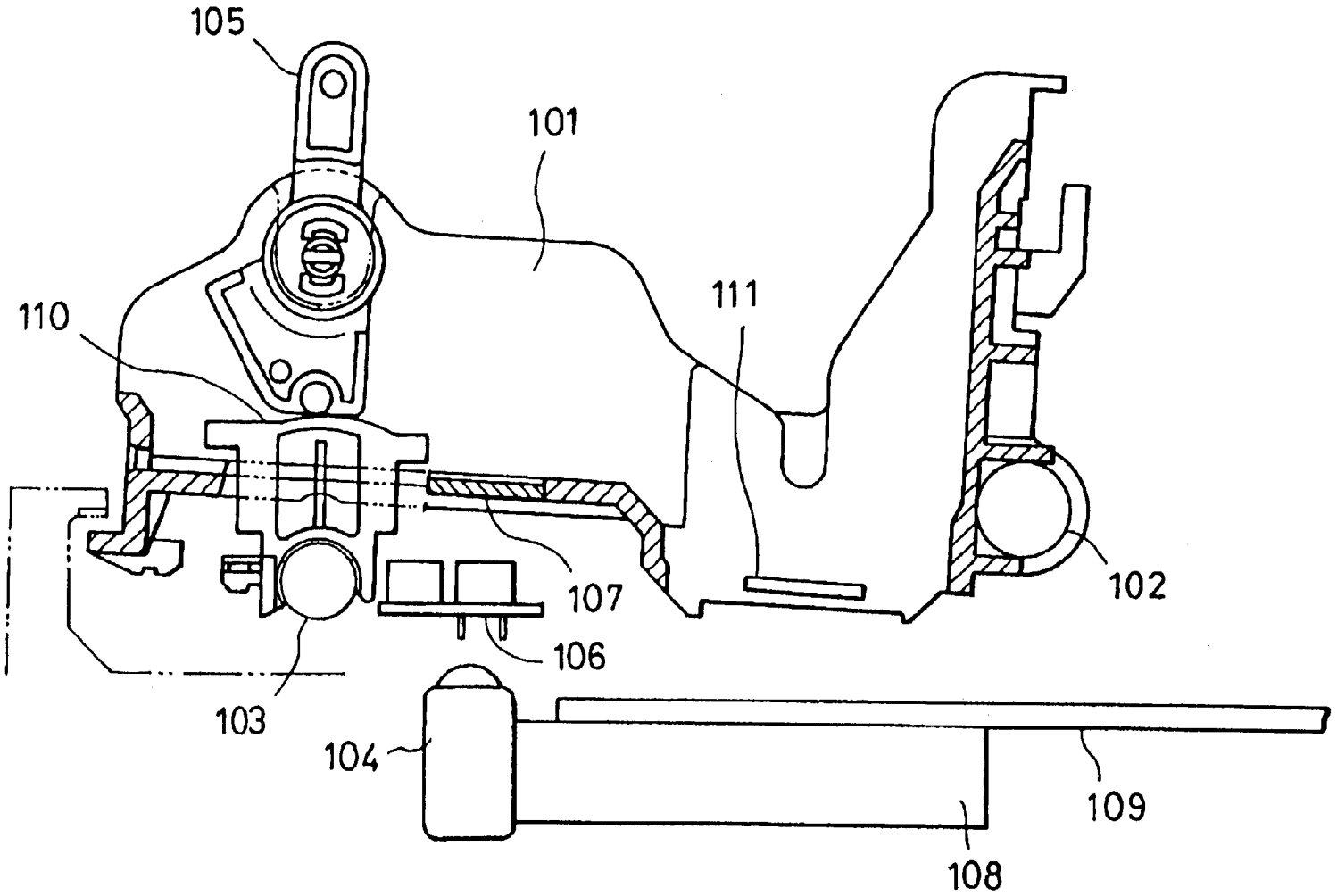

FIG. 22 is a diagram showing the state of the carriage 101 at the thick-paper position. At the thick-paper position, the paper-distance adjustment lever 105 is stood erect. The relationship among the paper-distance adjustment lever 105, a carriage support plate 110 and the support shaft 103 will now be described. The lower portion of the carriage support plate 110 is always in contact with the support shaft 103 due to the dead weight of the carriage support plate 110. The paper-distance adjustment lever 105 has a structure that the distance from the carriage support plate 110 can be changed by changing the rotational angle of the paper-distance adjustment lever 105. Furthermore, the paper-distance adjustment lever 105 is connected to the carriage 101 at the rotational center of the paper-distance adjustment lever 105.

Therefore, if the paper-distance adjustment lever 105 is inclined as shown in FIG. 21, the weight of the carriage 101 is added to the paper-distance adjustment lever 105. Since the distance from the rotational shaft of the paper-distance adjustment lever 105 and the carriage support plate 110 is changed depending upon the angle of inclination of the paper-distance adjustment lever 105, the rotation of the paper-distance adjustment lever 105 vertically moves the carriage 101 with respect to the support shaft 103. The rotation is performed relative to the guide shaft 102. Thus, the distance from the recording nozzle 111 to the recording medium 109 is changed. Also the distance from the photointerrupter 106 to the reflecting plate 107 is changed. As shown in FIG. 20, the distance from the photointerrupter 106 to the reflecting plate 107 is constant at the capping position with respect to the carriage position shown in FIGS. 21 and 22.

Figure 23:
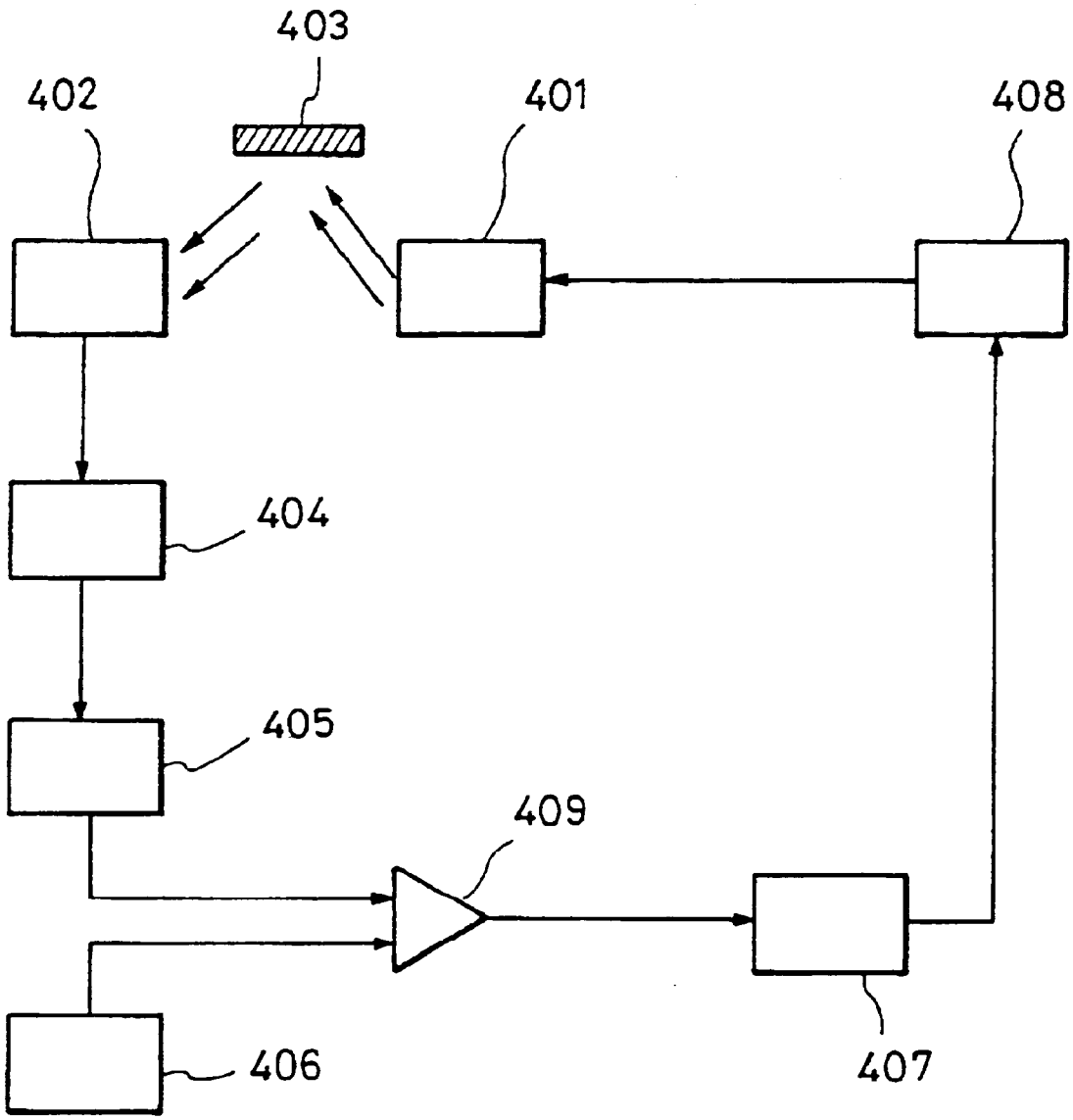
FIG. 23 is a block diagram showing correction of the sensitivity of the sensor according to the embodiment of the present invention.

FIG. 23 is a block diagram showing the structure including the photointerrupter. The carriage is, as shown in FIG. 20, at the capping position, and the distance from the reflecting plate to the photointerrupter is constant at this time. An expected output in the foregoing state is, as a digital value, set as a set value 406 which is a target value for the sensitivity correction. The set value 406 and the present output value are subjected to a comparison by a comparator 409. The error obtained due to the comparison is supplied to a transmitter 407, the transmission frequency of which is changed. In response to an output signal from the transmitter 407, an electric-current switch 408 for controlling an electric-current to be supplied to a light emitting portion 401 of the photointerrupter is turned on/off. Light emitted from a light emitting portion of the photointerrupter intermittently operated due to the foregoing process is reflected by a reflecting plate 403 so that reflected light 6*b* reaches a light receiving portion 402 so as to be photoelectrically converted. An intermittent electric current generated by a light receiving device is allowed to pass through a low-pass filter 404 so as to be converted from intermittent voltage to DC voltage. The obtained DC voltage level is supplied to an A/D converter 405 so as to be subjected to a comparison with the set value 406. By repeating the foregoing sequence, the sensitivity of the photointerrupter can be corrected and as well as the sensitivity including the characteristic of each printer system can be corrected.

Figure 24:
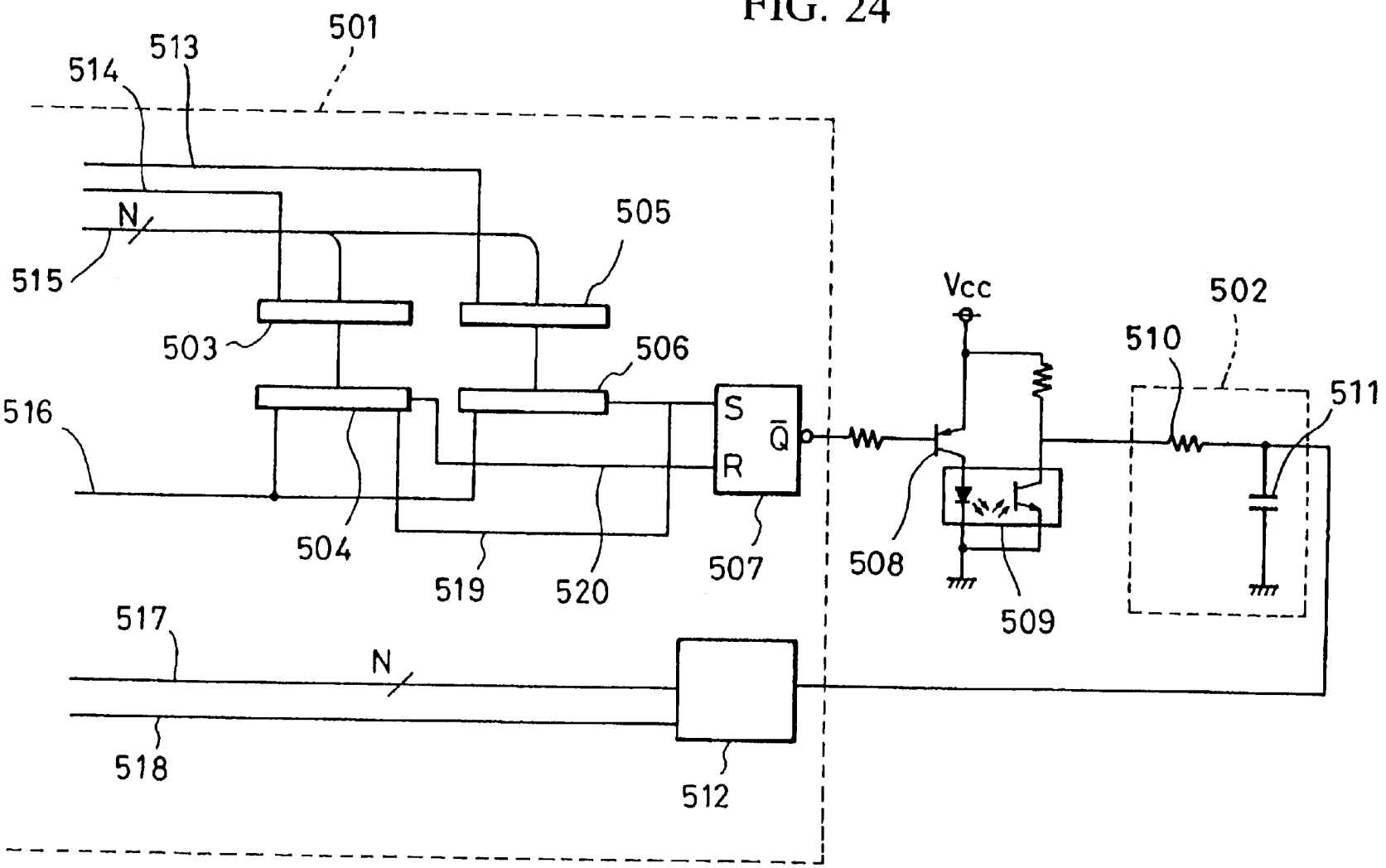
FIG. 24 is a block diagram showing a structure for controlling correction of the sensitivity of the sensor according to the embodiment of the present invention.
Figure 25:
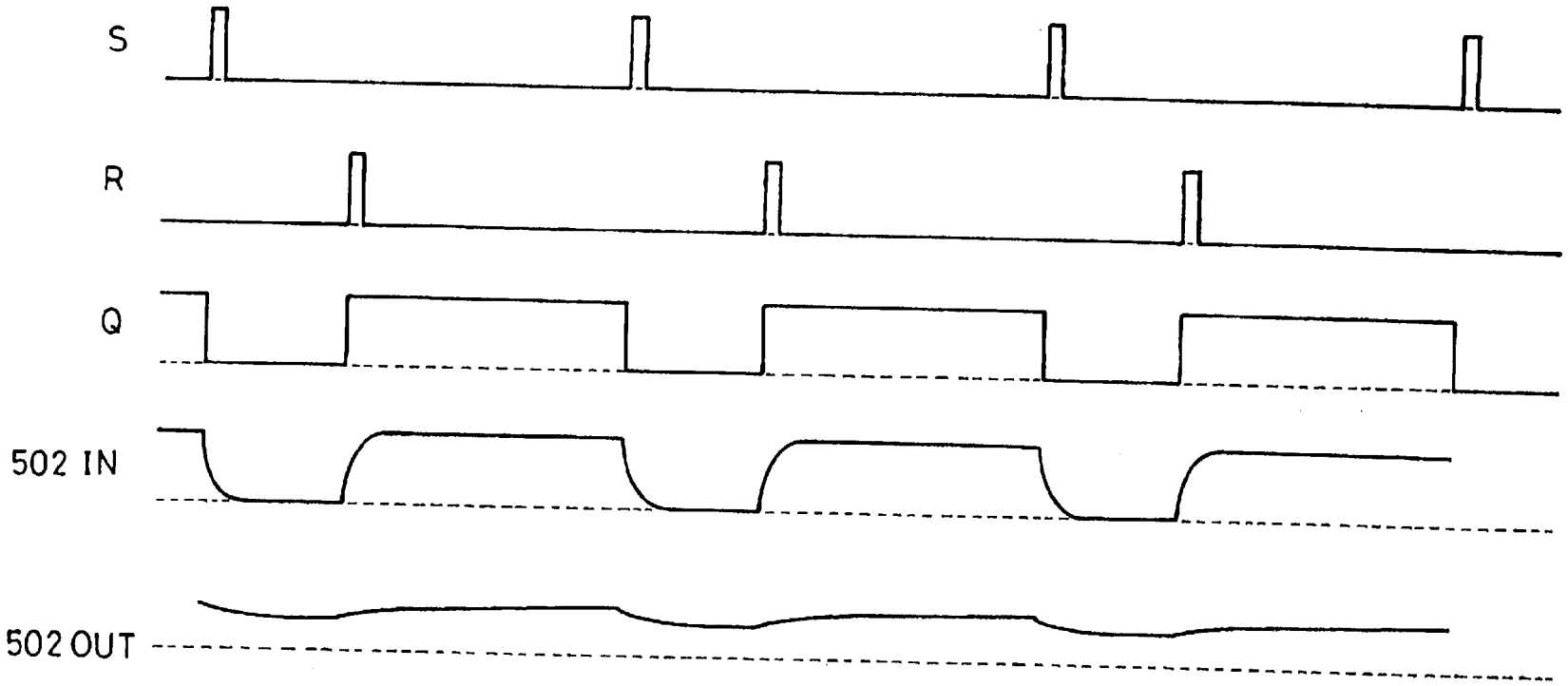
FIG. 25 is a timing chart of correction of the sensitivity of the sensor according to the embodiment of the present invention.

FIG. 24 is a diagram showing a structure for controlling the sensitivity correction. The sensitivity correction is performed when the carriage is at the capping position. Referring to FIG. 24, reference numeral 516 represents a clock signal. A region surrounded by a dashed line 501 is circuits for a timer and an A/D converter provided in a microcomputer. In the structure shown in FIG. 24, when the quantity of light emitted by the photointerrupter is reduced, the output voltage from a low-pass filter 502 is raised. When the quantity of light emitted by the photointerrupter is enlarged, the output voltage from the low-pass filter 502 is lowered. Initially, the A/D converter 512 reads the present state to digitize the read state. Data sampled by the A/D converter 512 is allowed to pass through a reading data bus 517 and is read by a CPU in synchronization with an A/D converter reading signal 518. Data read by the CPU is subjected to a set value, which is a target, by software. If the present output from the photointerrupter is low as a result of the comparison with the target value, control is performed in such a manner that the quantity of light emitted by the light emitting portion of the photointerrupter is reduced. If the present output from the photointerrupter is high, control is performed in such a manner that the quantity of light emitted by the light emitting portion of the photointerrupter is enlarged. The method shown in FIG. 24 has the arrangement that the quantity of light from the photointerrupter is adjusted by changing the duty of pulses generated at predetermined cycles. The cycles of the pulses are written in a period timing register 505 and is loaded when the value of a period counter 506, which is a down counter, is zero. When the count of the period counter 506 is zero, a pulse is transmitted to a line 519. The foregoing pulse is supplied to a setting terminal of a set/reset flip flop 507, the pulse as well as resetting an off-counter 504. The off-counter 504, which has been reset, loads off-timing data from a off-timing setting register 503 and starts count down. When the count of the off-counter 504 is zero, the off-counter 504 transmits a pulse to a line 520 and then stops the operation until a pulse is again supplied to the line 519. The pulse transmitted to the line 520 is supplied to a reset terminal of the set/reset flip flop 507. The foregoing relationship is shown in FIG. 25. Note that a line 515 represents a writing data bus for writing data to the register, a line 513 represents a writing synchronization signal for writing data in the period timing register, and a line 514 represents a writing synchronization signal for writing data in the off-timing setting register. In response to the thus-produced pulse signals, the output from the set/reset flip flop 507 turns on/off a transistor 508 so as to control an electric current to be supplied to the LED of a photointerrupter 509. In this embodiment, when the off-timing period is lengthened, the electric current to be supplied to the LED of the photointerrupter 509 is enlarged. A signal photoelectrically converted in the light receiving portion of the photointerrupter 509 is supplied to a low-pass filter 502 consisting of a resistor 510 and a capacitor 511 so as to be formed into a smoothed signal which is again supplied to the A/D converter 512.

Fifth Embodiment

A fifth embodiment of the present invention will now be described. As described in the foregoing embodiments, the photointerrupter 6 does not irradiate a point with light but, with light, irradiates a portion having a certain area. Since gradual depletion of ink in the foregoing region is detected, the output from the photointerrupter 6 is continuously changed.

Figure 26A:
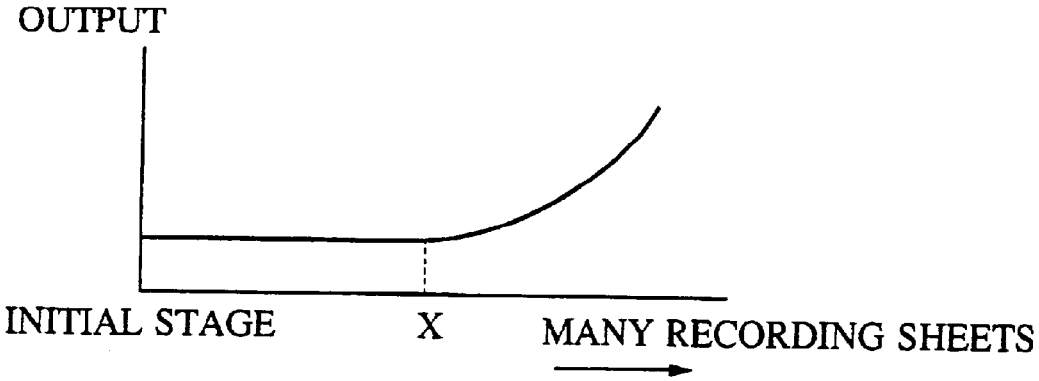
FIGS. 26A and 26B are graphs showing change in the reflectance of light occurring due to depletion of ink.
Figure 26B:
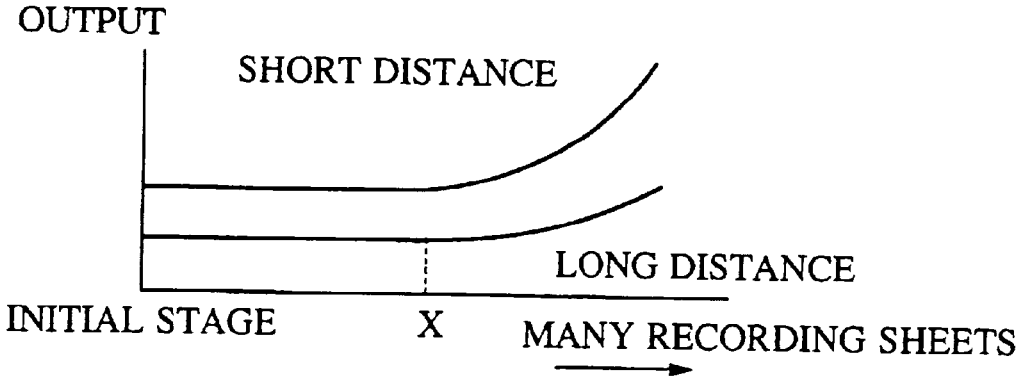

FIG. 26A schematically illustrates the foregoing state such that the output (the axis of ordinate) from the photointerrupter 6 is shown when recording is performed from an initial stage to a moment at which ink in the ink tank 7 is depleted (the axis of abscissa). After X sheets have been recorded, ink in the region irradiated with light emitted from the photointerrupter 6 is reduced so that the output from the photointerrupter 6 is enlarged.

Therefore, change in the output from the photointerrupter 6 after X sheets have been recorded is detected, whereby enabling the residual quantity to be detected.

Figure 40:
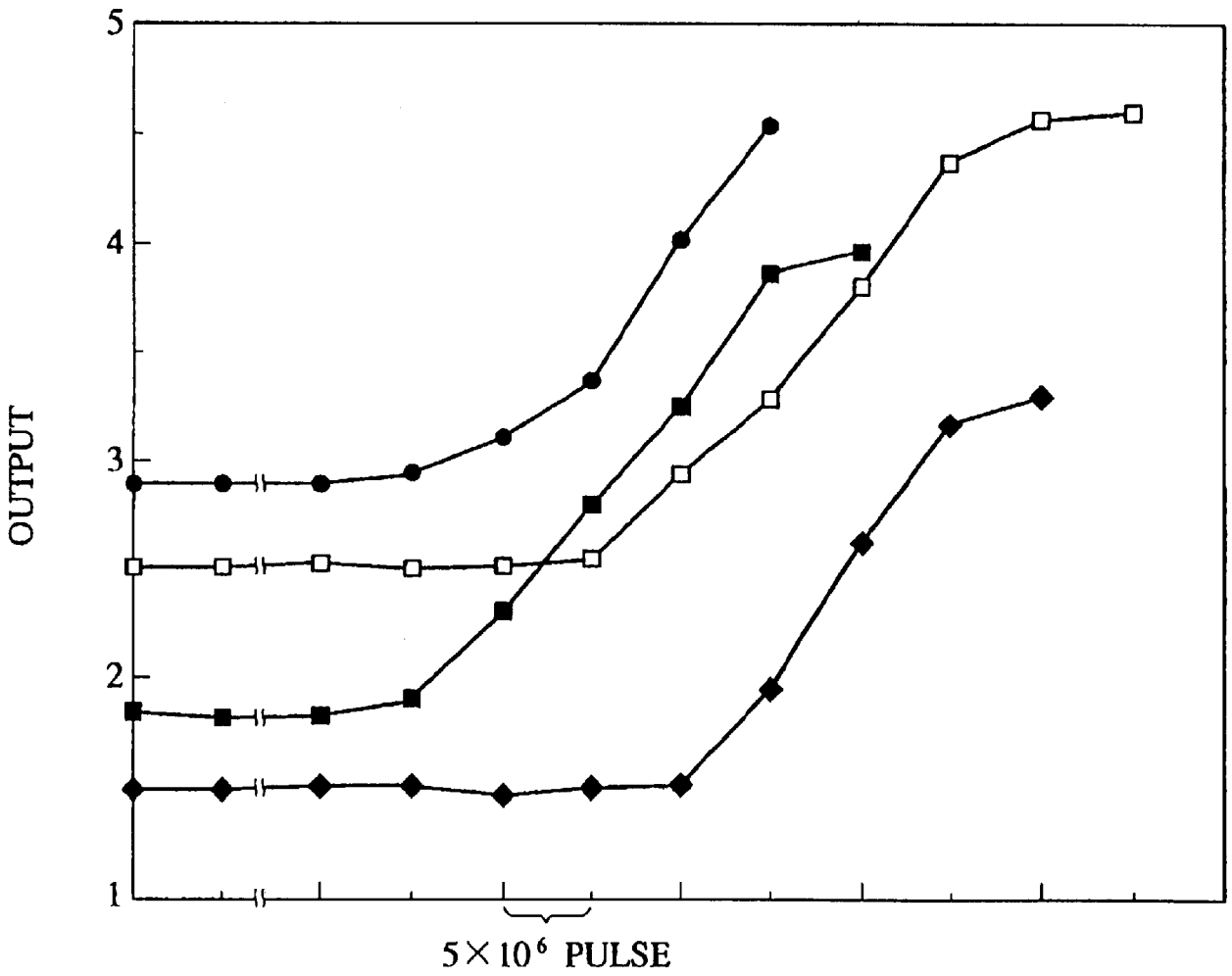
FIG. 40 is a graph showing the output characteristic of each ink tank when the residual quantity is detected by the photointerrupter from a bottom portion of the ink tank.

FIG. 40 shows actual output characteristics with respect to the ink tank according to the first to fourth embodiments, in which results of measurements of outputs at each 5×106 pulses when a predetermined image has been recorded by using four different ink tanks are plotted. The outputs indicated by the axis of ordinate are values obtained by subtracting outputs (activation voltage) from the photointerrupter when the LED is turned on from the outputs (dark voltage) from the photointerrupter when the LED Is turned off.

As can be understood from FIG. 40, since the output values from the ink tanks are different from one another, the residual quantity of ink cannot easily be detected in such a manner that the threshold for the output value is determined.

However, measurement of the quantity of change in the output from each ink tank enables the residual quantity of ink to be detected further accurately.

Since the method of detecting the residual quantity according to the first embodiment uses change in the reflectance of light occurring due to whether or not ink exists in the absorber, the residual quantity of ink can accurately be detected even if the ink tank is an ink tank of a type including an ink absorber.

This embodiment is an improvement in the foregoing method of detecting the residual quantity with which a method and an apparatus for detecting the residual quantity of ink is provided which is capable of preventing a malfunction and deterioration in the detection accuracy due to scattering in the outputs from a means (a sensor) for detecting a light reflectance, scattering occurring due to the mounting accuracy or the scattering in manufacturing the ink tanks and which is able to accurately detect a desired residual quantity of ink.

Figure 27:
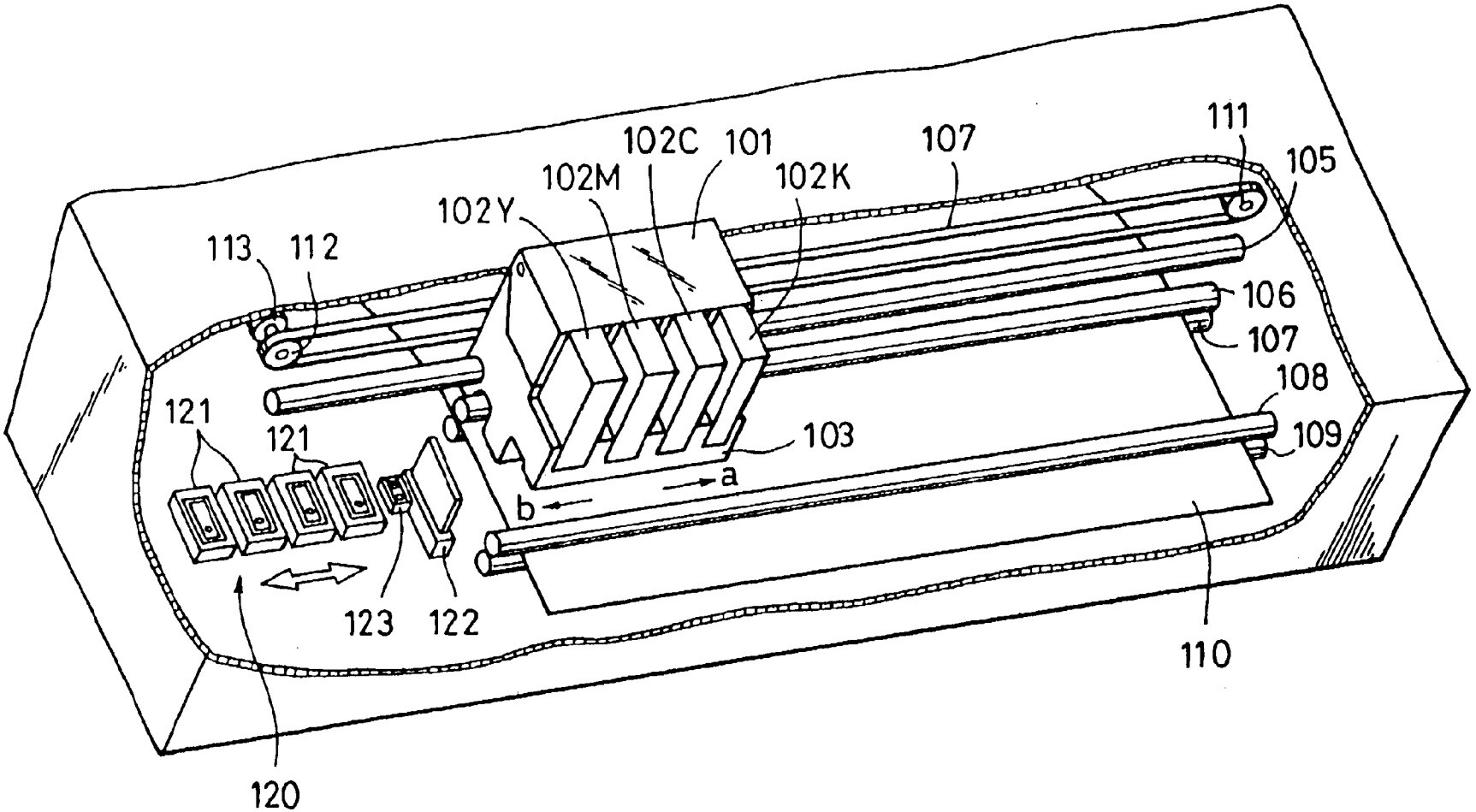
FIG. 27 is a schematic view of a printer for use in the embodiment of the present invention.

FIG. 27 is a schematic view showing a recording portion of a color ink jet printer to which the present invention can be adapted.

Reference numeral 101 represents a recording head having a plurality of nozzle lines that discharge ink droplets to form dots on a recording medium 110, the recording head 101 being made detachable with respect to a carriage 103 by a recording head fixing lever to be described later. As described later, the recording head according to this embodiment has a structure formed by integrating recording heads for four colors, that is, yellow (Y), magenta (M), cyan (C) and black (K or Bk), so that different color ink drops are mixed and a color image is formed on the recording medium 110.

The carriage 103 is moved on a guide shaft 105 in directions indicated by arrows a and b by a carriage drive motor 113 through a motor pulley 112, a follower pulley 111 and a timing belt 107.

A recording medium 110 is moved by two sets of conveyance rollers 106, 107, 108 and 109. Note that the reverse side of the recording paper 110 is supported by a platen (not shown) to form a flat recording surface at a position at which the recording paper 110 faces the nozzle of the recording head.

Image data is supplied from an electric circuit of the printer body to the recording head 101 through a flexible cable (not shown).

A recovery-system unit 120 is disposed at the home position for the recording head 101. The recovery-system unit 120 comprises four caps 121 disposed to correspond to the color nozzle lines of the recording head 101 and a pump unit (not shown) connected to each cap through a tube and the like. The caps 121 are able to move vertically when the carriage 103 approaches. When the carriage 103 is at the home position, the caps 121 are brought into contact with the corresponding color nozzle lines of the recording head 101 to cap the nozzle lines. As a result of capping above, thickening or solidification occurring due to evaporation of ink in the nozzle can be prevented so that defect in discharge is prevented.

When the recording head is changed or if the defect in discharge from the recording head takes place, the pump unit is operated in the foregoing capping state to generate negative pressure, whereby sucking ink from the nozzle to introduce new ink.

The recovery-system unit 120 is provided with a wiper blade 122 disposed between the caps 121 and the recording-paper conveyance portion to wipe and clean the leading end of the recording head 101.

Between the caps 121 and the wiper blade 122, there is disposed a photointerrupter 123 to irradiate, with light, the bottom surface of an absorber of an ink tank 102 connected to a recording head to be described later so as to detect depletion of ink in the ink tank 102. By scanning the carriage 103, the light reflectance of the color ink tanks can be measured.

Figure 28:
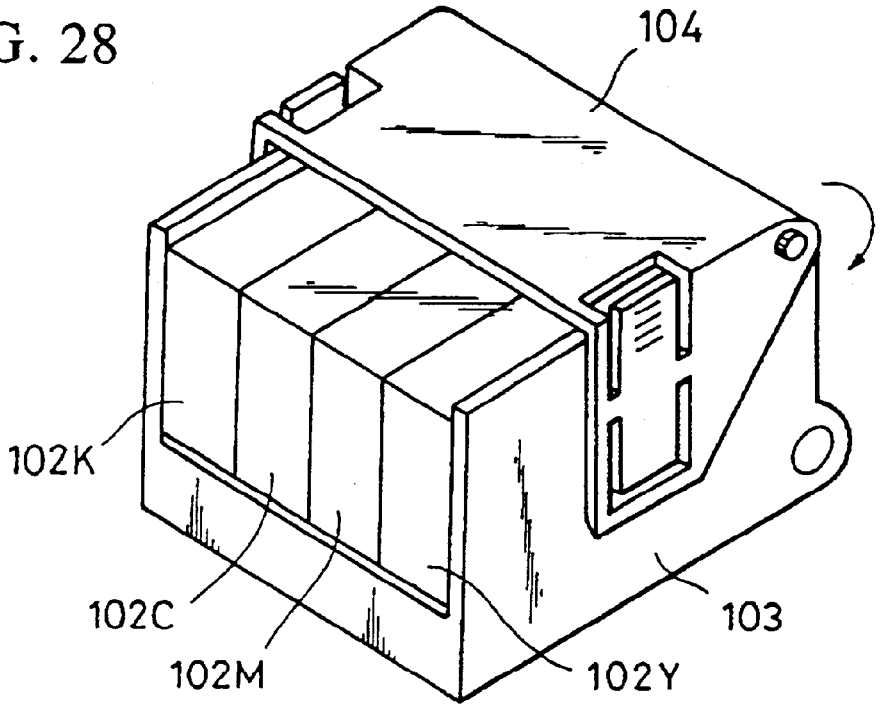
FIGS. 28 and 29 are schematic views showing a head, an ink tank, and a carriage of the printer for use in the embodiment of the present invention.

FIG. 28 shows the recording head 101 on the carriage 103.

The carriage 103 includes four recording heads for discharging black, cyan, magenta and yellow inks and ink tanks 102K, 102C, 102M and 102Y. Each of the four recording heads has 64 nozzles each of which discharges an ink droplet of about 40 ng per one discharge operation. The four ink tanks respectively are made detachable with respect to the carriage 103 so as to be changed for new ink tanks when ink has been depleted.

A recording-head fixing lever 104 is provided to locate and secure the recording head 101 onto the carriage 103 in such a manner that a boss 103*b* of the carriage 103 and a hole 104*a* of the recording-head fixing lever 104 are rotatively engaged to one another. Thus, the recording head 101 can be changed by opening/closing the recording-head fixing lever 104.

Figure 29:
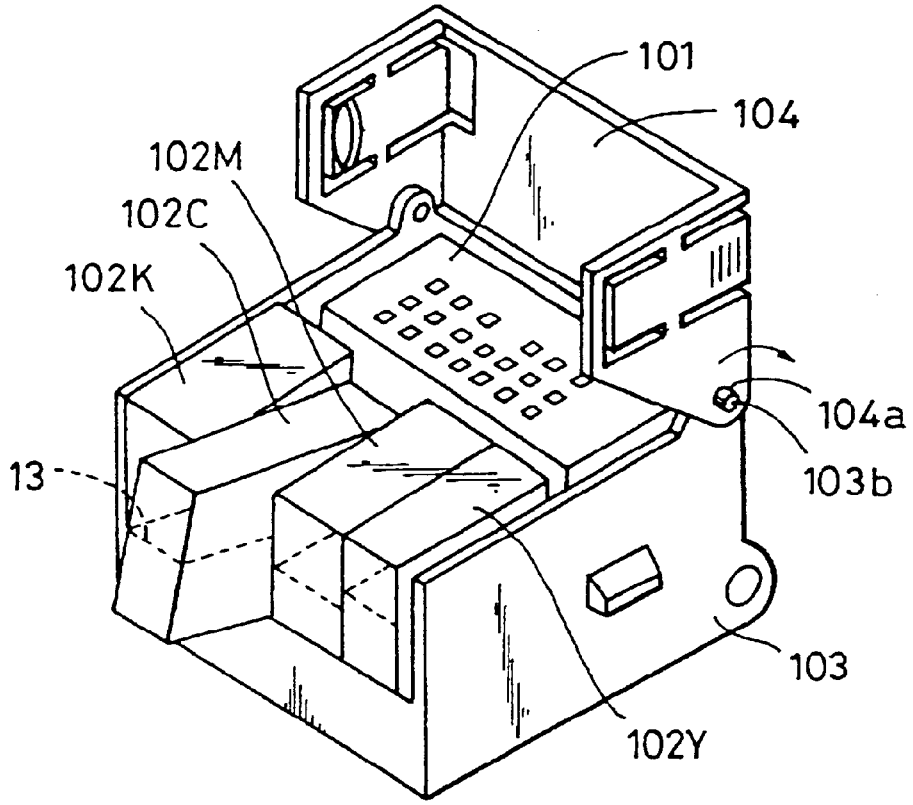

FIG. 29 is a diagram showing the ink tank 102. The ink tank 102 is, by a partition wall 121, divided into a portion in which ink is absorbed in an absorber 122 and a portion 123 (a raw ink portion) in which ink is not absorbed in the absorber. The ink tank 102 has a supply port 124 for supplying ink to the recording head 101 and an air communication port 125. By using the ink tank according to this embodiment, about 160 pages of A4 sheets each having an image of 10% duty formed thereon can be recorded.

Figure 30:
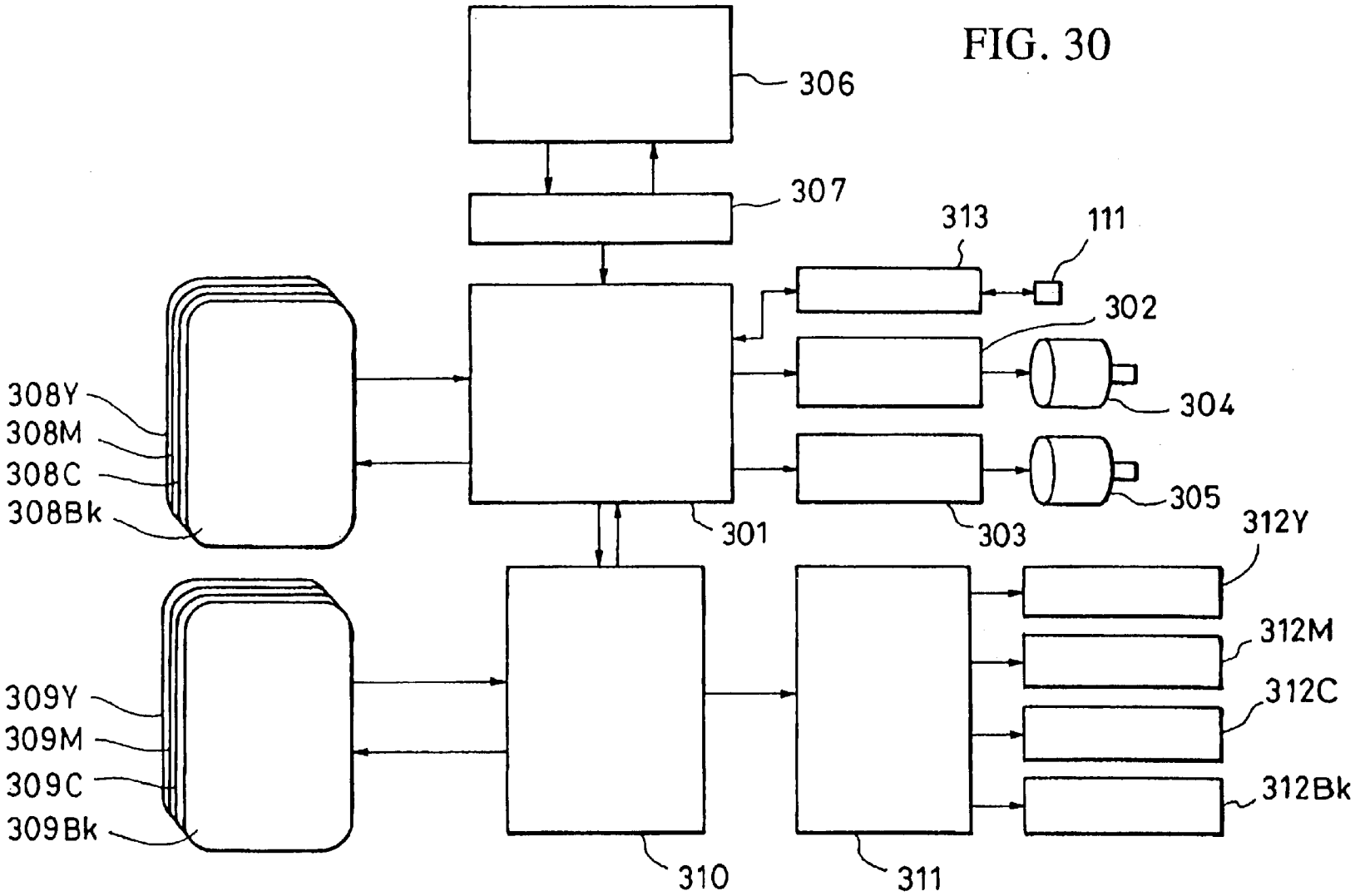
FIG. 30 is a block diagram showing the electrical control structure for the printer for use in the embodiment of the present invention.

FIG. 30 is a block diagram showing the electrical control structure of the foregoing ink jet printer.

Reference numeral 301 represents a system controller for totally controlling the ink jet. printer, the system controller 301 including a microprocessor, a storage device (a ROM) storing a control program, a storage device (a RAM) for use when the microprocessor performs a process, and the like.

Reference numeral 302 represents a driver for driving the recording head in the main scanning direction, and 303 represents a driver for moving a recording medium in the sub-scanning direction.

Reference numerals 304 and 305 represent motors corresponding to the drivers 302 and 303 and receiving information, such as the speed, the distance of movement, and the like, from the drivers 302 and 303.

Reference numeral 306 represents a host computer for transmitting information to be recorded to the recording apparatus according to the present invention.

Reference numeral 307 represents a receipt buffer for temporarily storing data from the host computer 306 in such a manner that it stores data until data is read from the system controller 301.

Reference numeral 308 represents a frame memory for developing data to be recorded into image data, the frame memory 308 having a memory size required to record data. Although the description is performed about the frame memory capable of storing data for one recording sheet, the present invention is not limited to the size of the frame memory.

Reference numeral 309 represents a storage device for temporarily storing data to be recorded, the required storage capacity being changed depending upon the number of nozzles of the recording head.

Reference numeral 310 represents a recording control portion for appropriately control the recording head in accordance with an instruction issued from the system controller, the recording control portion 310 controlling the recording speed, the number of data to be recorded, and the like. The recording control portion 310 counts the number of discharges of ink droplets performed by the recording heads 312Bk, 312C, 312M and 312Y and the number of suction operations performed for recovering the recording heads to convert the consumed cuantity of each color ink into number of ink droplets (the number of pulses).

Reference numeral 311 represents a driver for the recording heads for discharging black, cyan, magenta and yellow inks, the driver 311 being controlled in response to a signal supplied from the recording control portion 310. Note that FIG. 30 shows the recording head consists of recording heads 312Bk, 312C, 312M and 312Y for the corresponding colors.

Reference numeral 313 represents a detection portion for measuring the light reflectance at the bottom surface of the ink tank by the photointerrupter 123 to obtain the output value from the photointerrupter 123, the detection portion 313 being controlled by the system controller 301 to detect each color ink tank.

The method of detecting the residual quantity in the ink tanks will now be described.

Figure 31:
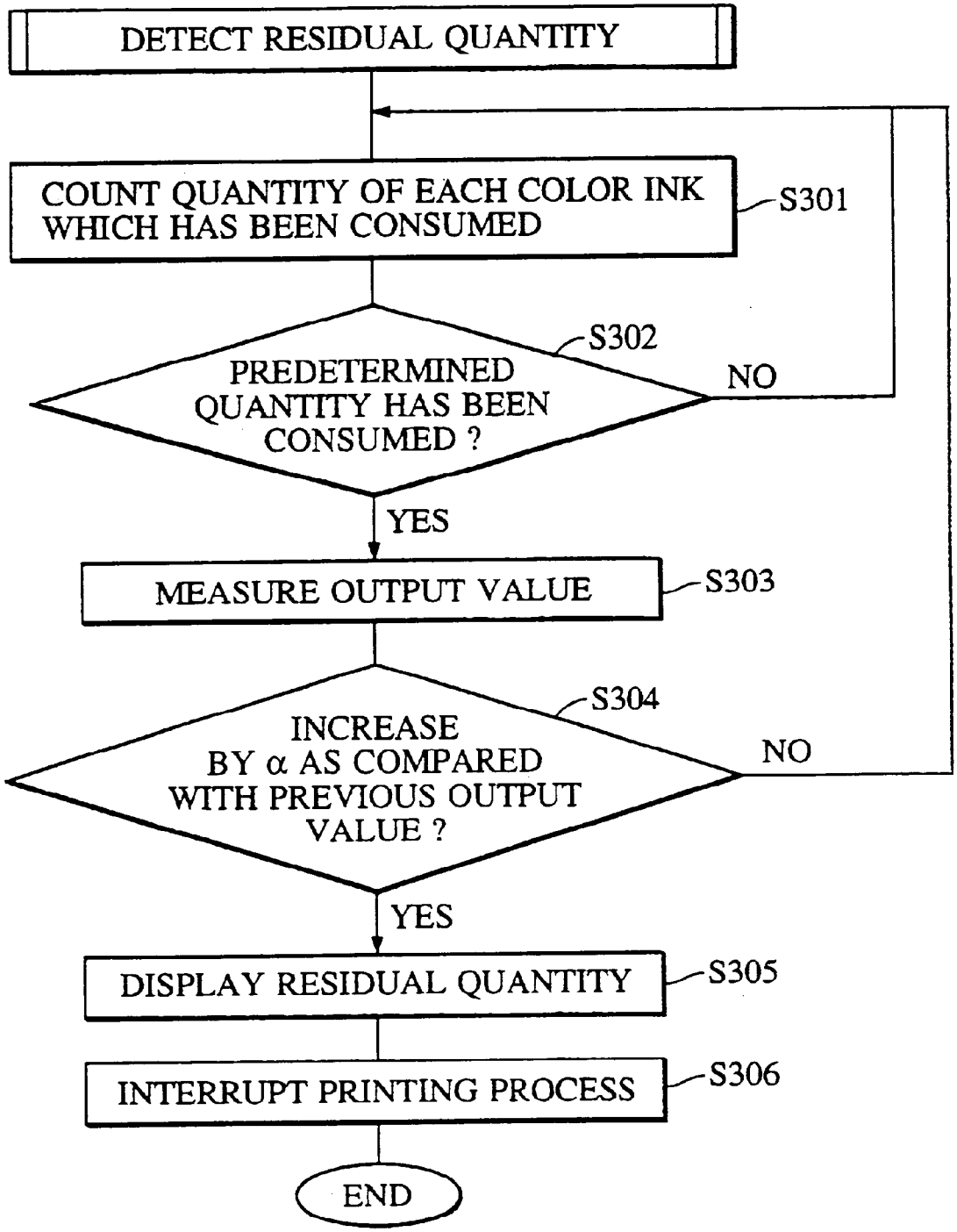
FIGS. 31 and 32 are flow charts of the operation according to the embodiment of the present invention.

FIG. 31 is a flow chart showing the operation for detecting the residual quantity of ink in the ink tank 102.

In step S301 the consumed quantity of each ink due to discharge of ink droplet for forming an image, idle discharge and suction for recovering the recording head is converted into pulses, and the pulses are counted. In this embodiment, counting is performed in such a manner that $3\times10^6$ pulses correspond to one suction operation.

In step S302 whether or not the number of pulses counted in step S301 reaches a predetermined number of pulses, which is $15\times10^6$ pulses set in this embodiment, is discriminated. If the number of pulses does not reach the predetermined number of pulses, counting is continued. If number of pulses reached the predetermined number of pulses, the light reflectance (the output value) of the absorber portion in the bottom of the ink tank 102 is measured in step S303. In this embodiment, the output is measured at a moment when the carriage 103 returns to the home position immediately after the number of pulses has reached the predetermined number of pulses. Therefore, if the recording operation is being performed when the number of pulses has reached the predetermined number of pulses, the output is measured after this scanning has been completed and before the next scanning starts.

The output value may be measured at another moment at which the final portion of a page is printed after the number of pulses has reached the predetermined number of pulses, or at which first idle discharge for recovery is performed after the number of pulses has reached the predetermined number of pulses.

In step S304 the output value obtained in step S303 and the previous output value are subjected to a comparison to discriminate whether or not the output value is larger than the previous output value by $\alpha$. If the output value is not larger than the previous output value by $\alpha$, the operation returns to step S301 in which counting of the number of pulses and obtaining of the output value are continued. If the output value is larger than the previous output value by $\alpha$ or more, the operation proceeds to step S305 in which depletion of ink in the ink tank 102 is indicated.

Then, an alarm lamp (not shown) is turned on, and then the scanning operation for recording is interrupted in step S306.

In this embodiment, $\alpha$ was set to 0.20 and images, the duty of each of which was 10%, were consecutively recorded after a plurality of new ink tanks had been mounted, thus resulting in that the alarm lamp was turned on at about 130 to 155 th pages.

The alarm lamp, which has been turned on, can be turned off by depressing an alarm-lamp suspension switch (not shown) provided for, for example, the printer.

As described above, according to this embodiment, a comparison with the previous output value is performed to discriminate whether or not change from the previous output value by a degree larger than a predetermined value has occurred. Therefore, even if the outputs from the photointerrupter scatter, or scatters in mounting or scatters in manufacturing the ink tank takes place, depletion of ink in the ink tank can always be detected with excellent accuracy.

Sixth Embodiment

A sixth embodiment of the present invention will now be described.

According to this embodiment, there is provided a method and an apparatus for detecting the residual quantity of ink which is capable of automatically canceling display or alarm sound if a new ink tank is mounted after depletion of ink has been indicated by the display or the alarm sound without providing a canceling means for the ink jet recording apparatus.

In this embodiment, a method of discriminating the detected quantity of residual ink, which is different from that according to the fifth embodiment, is employed and a structure is employed in which, if a new ink tank is mounted after the alarm lamp indicating depletion of ink has been turned on, the alarm lamp is automatically turned off.

Figure 32:
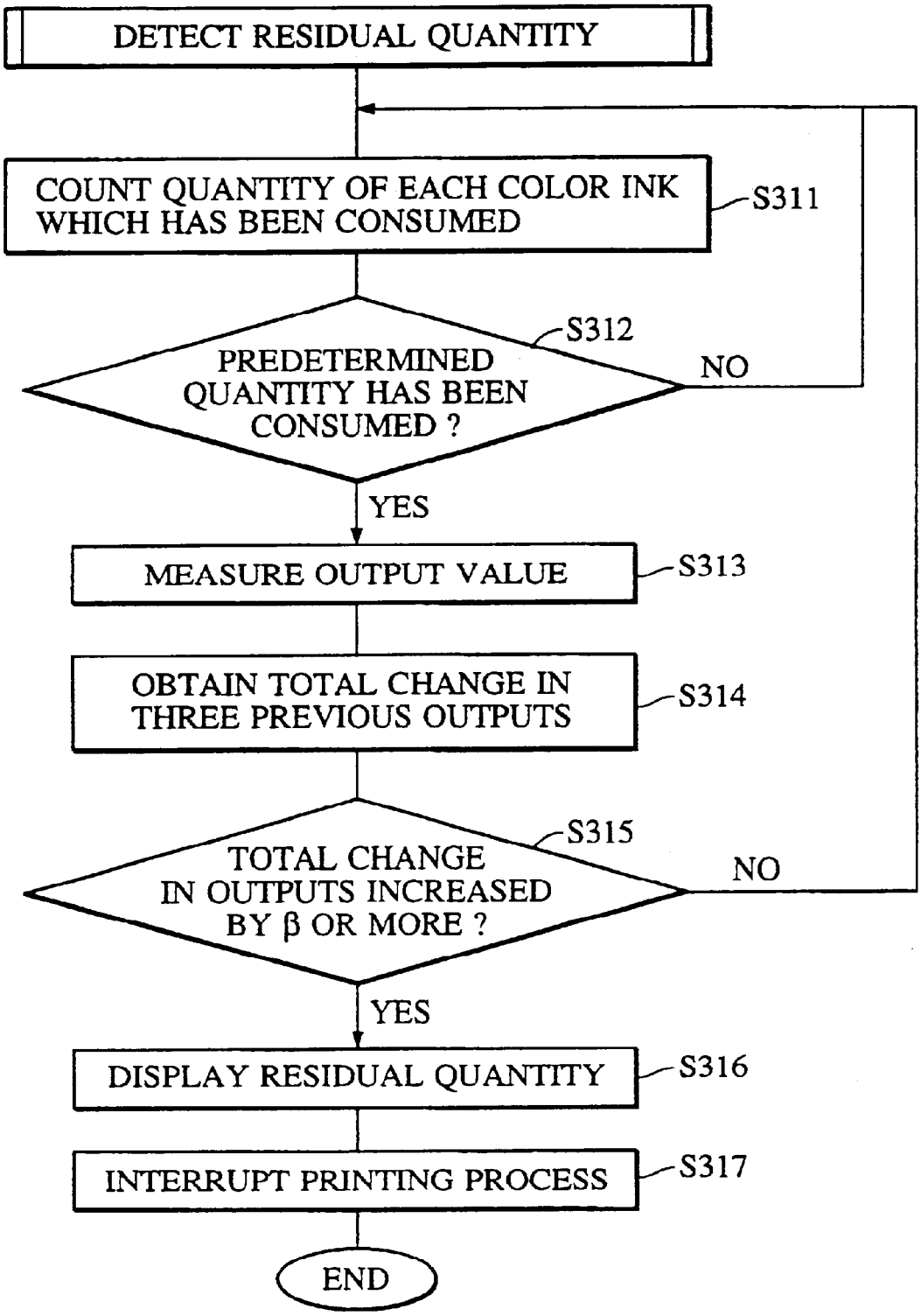

FIG. 32 is a flow chart showing the operation to be performed in the method of detecting the residual quantity of ink according to this embodiment.

The process according to this embodiment is different from the fifth embodiment in the process in step S312 and those from step S314.

In step S311 the same process as that in step S301 according to the fifth embodiment shown in FIG. 31 is performed. In step S312 the same process as that in step S302 according to the fifth embodiment is performed except the predetermined quantity of consumption being $5\times10^6$. The process in step S313 is the same as that in step S303 according. to the fifth embodiment.

In step S314 the quantity of change in the three previous outputs from the present output value is calculated. To obtain the quantity of the change in the three previous outputs, the present output value and the three previous output values, which have been stored, are required.

In step S315 a discrimination is performed whether or not the quantity of the change in the three outputs obtained in step S314 is larger than $\beta$. If the quantity is not larger than $\beta$, the operation returns to step S311. If the quantity is larger than $\beta$, display is performed in step S316 similarly to the fifth embodiment.

This embodiment is different from the fifth embodiment in that the predetermined quantity of consumption to be set in step S312 is made to be smaller than that set in the fifth embodiment; and the total quantity of change in the previous outputs is subjected to a comparison with a predetermined value. That is, this embodiment attains an effect of preventing an error in detecting the residual quantity because the output values are obtained at short intervals. However, if the predetermined number of pulses is set to be excessively small, the output values are obtained too many times whereby deteriorating the throughput.

Then, a case where a user of the printer has changed the ink tank for a new one after the alarm lamp has been turned on due to depletion of the ink tank will now be described.

If the ink tank is changed, a recovery operation is usually performed to prevent the following problem.

That is, if an ink tank containing ink in a small quantity is continuously used, ink supply to the nozzle of the recording head is inhibited due to depletion of ink, whereby stopping ink discharge. Even if a new ink tank is mounted, ink cannot be supplied to the nozzle in a case where the recovery operation is not performed. Thus, ink cannot be discharged continuously.

If an ink tank containing ink in a small quantity is changed to a new ink tank before ink discharge is stopped, ink is left in the nozzle. However, air can be introduced through the supply port of the recording head when the ink tank is changed, whereby allowing the recording operation to be performed for a certain period after the ink tank has been changed and inhibiting supply of ink from the ink tank to the recording head due to introduced air. As a result, ink cannot sometimes be discharged.

To prevent the foregoing problem, a recovery operation is usually performed when the ink tank is changed. In this embodiment, an attention is paid to the recovery operation, which is performed when the ink tank is changed to employ a structure in which the alarm lamp is automatically turned off when the ink tank is changed to a new ink tank.

Figure 33:
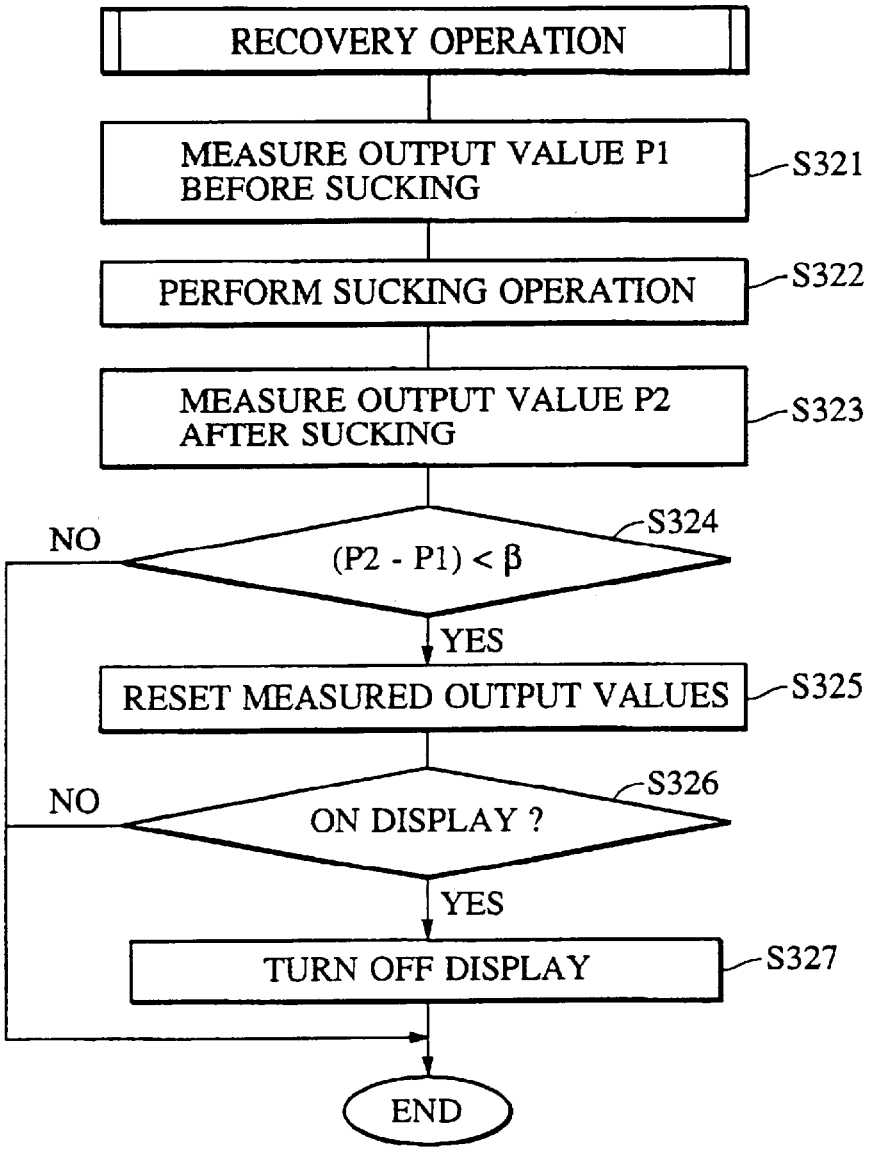
FIG. 33 is a flow chart of the operation for turning an alarm lamp off according to the embodiment of the present invention.

FIG. 33 is a flow chart showing the operation of the structure for turning the alarm lamp off.

In step S321 output value P1 is measured prior to performing the recovery operation. In step S322 the recovery operation is performed. The recovery operation to be performed here includes sucking for introducing ink from the ink tank to the nozzle portion of the recording head, wiping using a blade or the like to be performed after the sucking operation has been performed and idle discharge to be performed after the wiping operation has been performed.

After the recovery operation has been performed, output value P2 is measured in step S323.

In step S324 whether or not the difference (P2−P1) between output values measured in step S321 and S323 is smaller than a predetermined value β is discriminated. If the difference is smaller than β, the operation proceeds to step S325. If the difference is not smaller than β, the recovery operation is ended and the operation returns to the start position so that the detection of the ink consumption is continued.

In step S325 all output values obtained prior to performing the recovery operation are reset and cleared. The reason for this will be described later.

In step S326 whether or not the alarm lamp has been turned on before the recovery operation is performed is discriminated. If the alarm lamp has been turned on as described above, display is turned off in step S327 so that the recovery operation is ended. If the alarm lamp has not been turned on, the recovery operation is completed as it is, and the operation returns to the start.

The reason why the output value is reset in step S325 will now be described.

If change to a new ink tank is performed in a state where the alarm lamp is being turned on and the recovery operation is performed, the output voltage obtained prior to performing the recovery operation is not required because a new ink tank is used.

Figure 34:
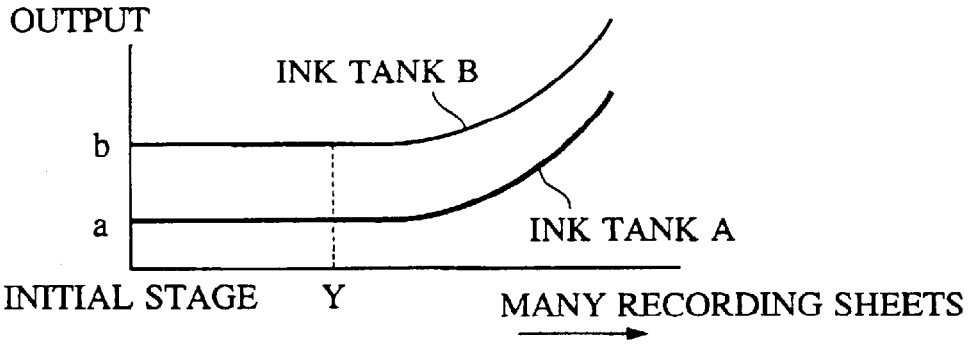
FIG. 34 is a graph showing difference in the output characteristic of the sensor for each of different ink tanks.

If a new ink tank is loaded in a state where the alarm lamp is not turned on and the recovery operation is performed, the output value is sometimes changed due to, for example, scattering in manufacturing the ink tank. Assuming that ink tank A is changed to ink tank B when Y recording sheets have been recorded as shown in FIG. 34, the output value of the ink tank B is larger than that of the ink tank A. Therefore, the output value is enlarged considerably as compared with the output value obtained with the ink tank A prior to performing the recovery operation. As a result, there arises a problem in that, if change to the ink tank B is performed, the alarm lamp is turned on although ink exists in a sufficiently large quantity.

If a structure is employed in which the output value prior to performing the recovery operation is reset, the foregoing problem can be prevented.

A structure may be employed in which, in a case where a usual recovery operation is performed in.a case except the change of the ink tank, a discrimination is performed that ink exists in a sufficiently large quantity if the output is not changed by a predetermined degree before and after the recovery operation is performed, and the output value obtained before the recovery operation is performed is reset.

As described above, if the change in the output value before and after the recovery operation is performed is always smaller than a predetermined value, the previous output values are reset. Thus, the residual quantity of ink can be detected without malfunction and as well as the alarm lamp can automatically be turned off.

When a was set to 0.20, β was set to 0.09 and an image, the duty of which for each color was 10%, was recorded consecutively, the alarm lamp was turned on at about 135 th to 150 th page. When change to a new ink tank was performed and the recovery operation was performed, the alarm lamp was turned off.

Although the method of discriminating the result of detection of the residual quantity employed in the fifth embodiment was described, the foregoing embodiments may be combined adequately.

Seventh Embodiment

A seventh embodiment of the present invention will now be described. This embodiment is an improvement in the method of discriminating the result of detection of the residual quantity according to the fifth embodiment. According to this embodiment, there is provided a method and an apparatus capable of accurately discriminating the result of detection of the residual quantity regardless of the position of the carriage even if the apparatus is adapted to an ink jet recording apparatus in which the carriage position can be selected from a plurality of positions to correspond to the thickness of the recording medium.

Figure 35:
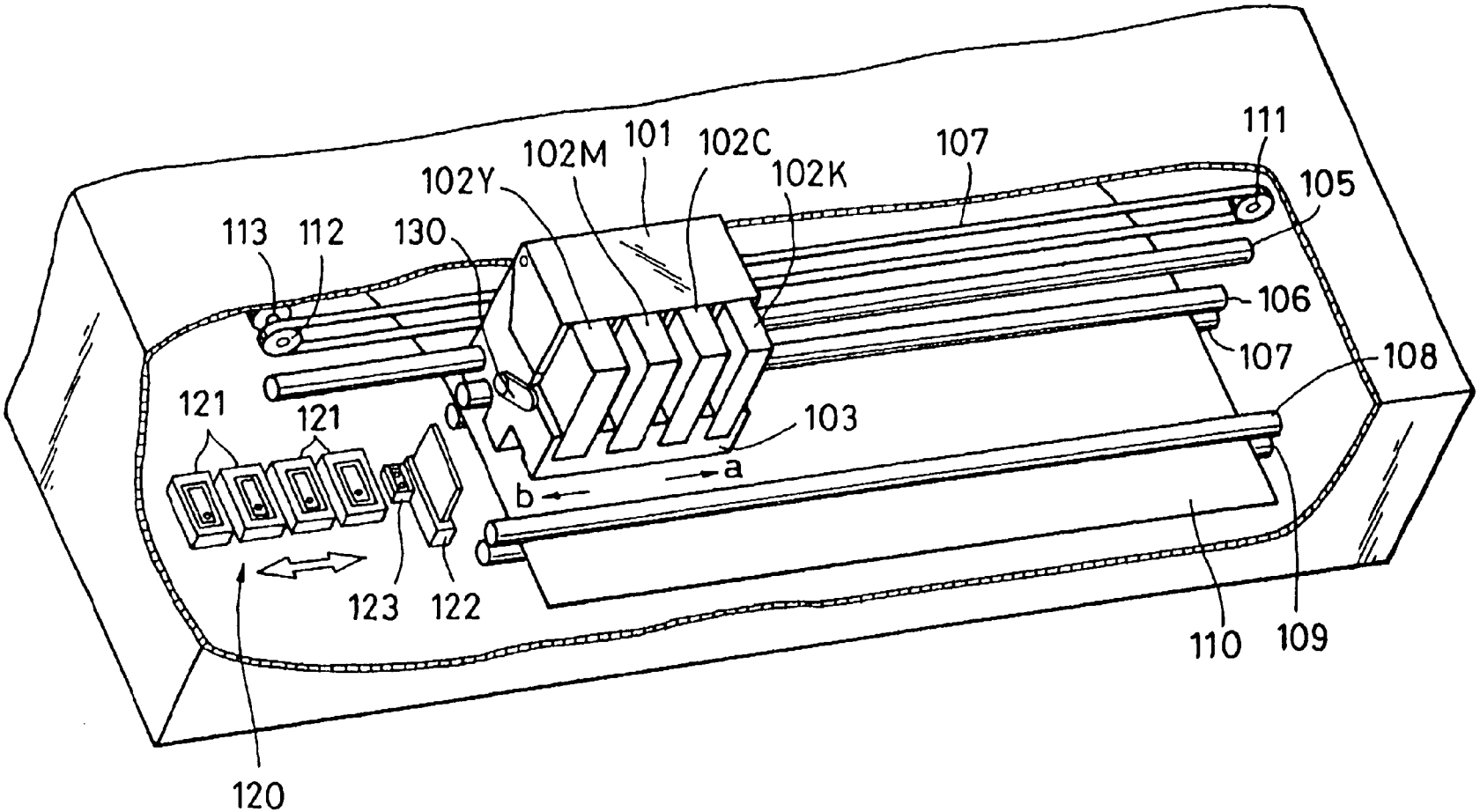
FIG. 35 is a schematic view of the printer for use in the embodiment of the present invention.

An ink jet printer shown in FIG. 35 is similar to that according to the fifth embodiment. The ink jet printer according to this embodiment is different from that according to the first embodiment in that an paper-distance position lever 130 is provided for the carriage 103 in order to select the carriage position from two positions.

Figure 36A:
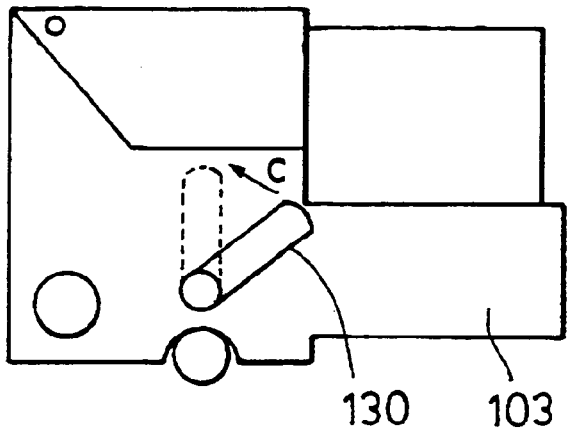
FIGS. 36A and 36B are diagrams showing two states of the relationship between the position corresponding to the adjustment of the distance from the head to paper and the position of the carriage according to the embodiment of the present invention.
Figure 36B:
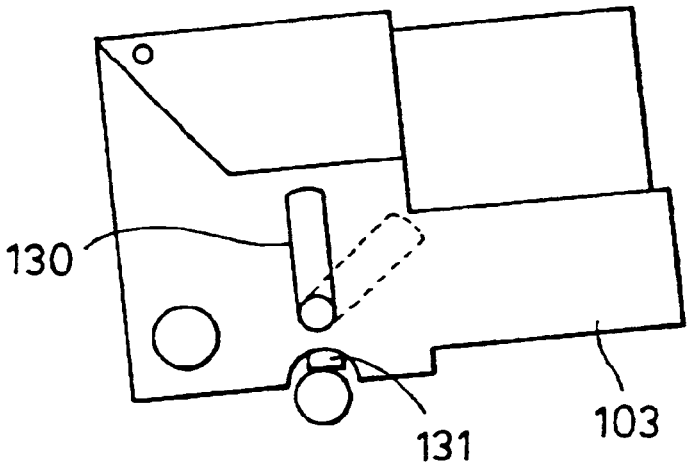

FIGS. 36A and 36B are a schematic cross sectional views showing a carriage 103 in a state where the paper-distance position is changed by operating the paper-distance position lever 130 shown in FIG. 35.

FIG. 36A shows a state where the paper-distance position is at the normal position which is used when an image is formed on a recording medium, such as a usual plain paper, a coat paper or an OHP film. When the paper-distance position lever 130 is inclined in a direction indicated by an arrow c in the foregoing state, a paper-distance position changing member 131 projects from the bottom portion of the carriage 103 toward the conveyance roller 106 as shown in FIG. 36B. Thus, the carriage 103 is moved upwards in such a manner that the guide shaft 105 is used as a support point so that the distance from the recording member is lengthened. The carriage position shown in FIG. 36B is called a thick-paper position which is used when an image is formed on paper thicker than usual paper or on a thick special film.

Figure 37:
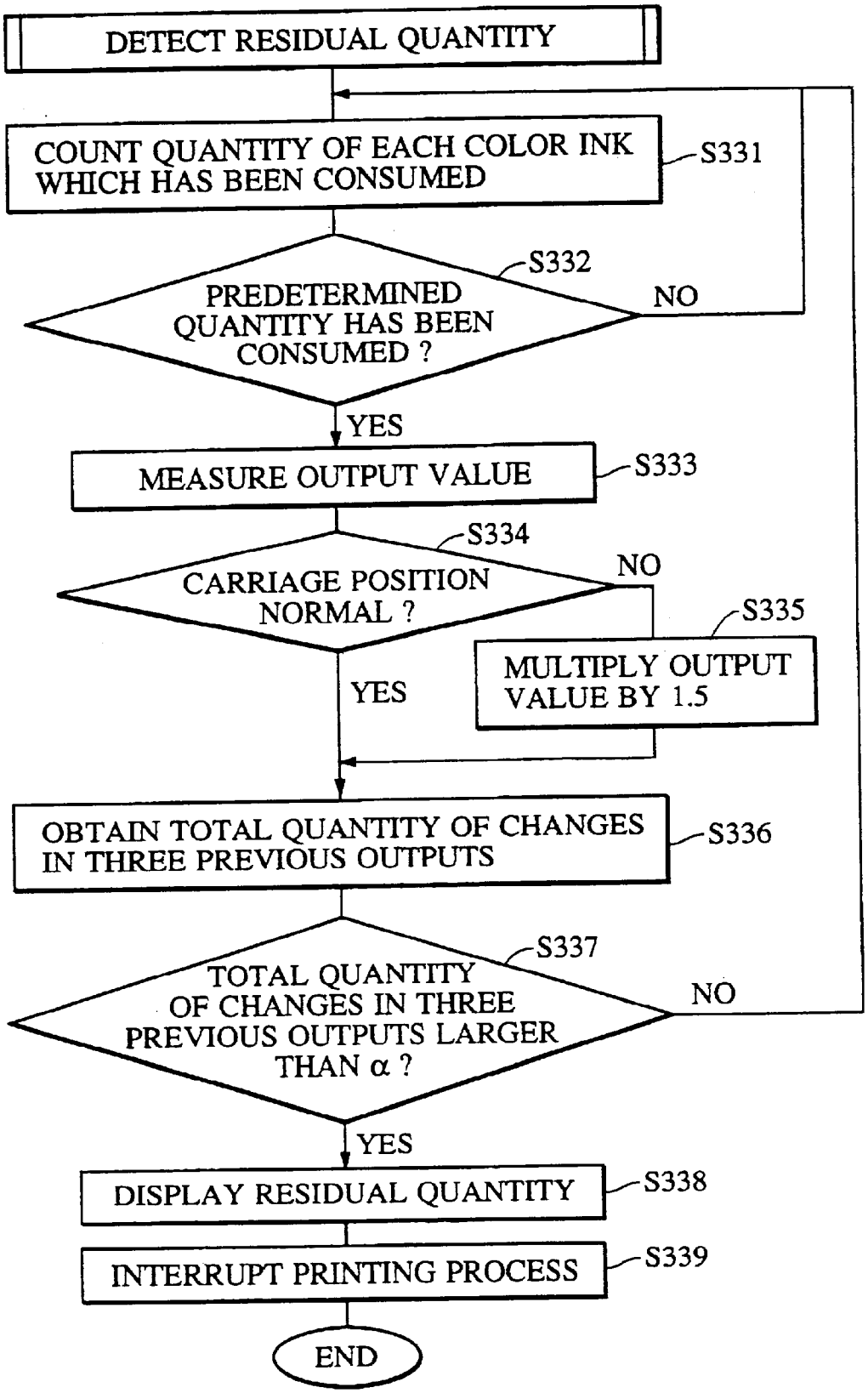
FIGS. 37, 38 and 39 are flow charts of the operation of the printer for use in the embodiment of the present invention.

FIG. 37 shows a flow chart of the operation of this embodiment, in which steps S331 to S333 are the same as steps S301 to S303 according to the fifth embodiment. Thus, the process in step S334 and ensuing processes are different from the fifth embodiment.

In step S334 whether the position of the carriage 103 is at the normal position or the thick-paper position is discriminated. If the carriage 103 is at the normal position, the operation proceeds to steps S336 to S339 in which processes similar to those in steps S304 to S306 according to the fifth embodiment are performed.

If the carriage 103 is at the thick-paper position, the operation proceeds to step S335 so that a value obtained by multiplying the output value obtained in step S333 by 1.5 is employed as a new output value, and the operation proceeds to steps S336 to S339.

Since the output value at the thick-paper position can be corrected by multiplying the output value at the thick-paper position by 1.5 to use it as the output value at the normal position, the residual quantity of ink can be detected similarly to the fifth embodiment regardless of the paper-distance position.

Note that the carriage position is recognized in step S334 as follows.

For example, the carriage position may be recognized by means of an paper-distance position input switch (not shown) provided for the ink jet printer or by setting performed from the printer driver. If switching of the paper-distance position lever 130 by a user of the printer is mechanically or optically detected, the input by means of the paper-distance position input switch or that by means of the printer driver can be omitted.

Since the carriage 103 is vertically moved by the paper-distance position lever 130, measurement of the light reflectance at a predetermined position on the reverse surface of the carriage 103 by the photointerrupter 123 enables the paper-distance position to be automatically detected.

Eighth Embodiment

An eighth embodiment will now be described which is an improvement in the third and seventh embodiments and which has a structure that the output value is not uniformly corrected in accordance with the carriage position but the output value is corrected for each ink tank which is being used. As a result, the residual quantity can be detected accurately even if the ink tank scatters due to manufacturing.

Figure 38:
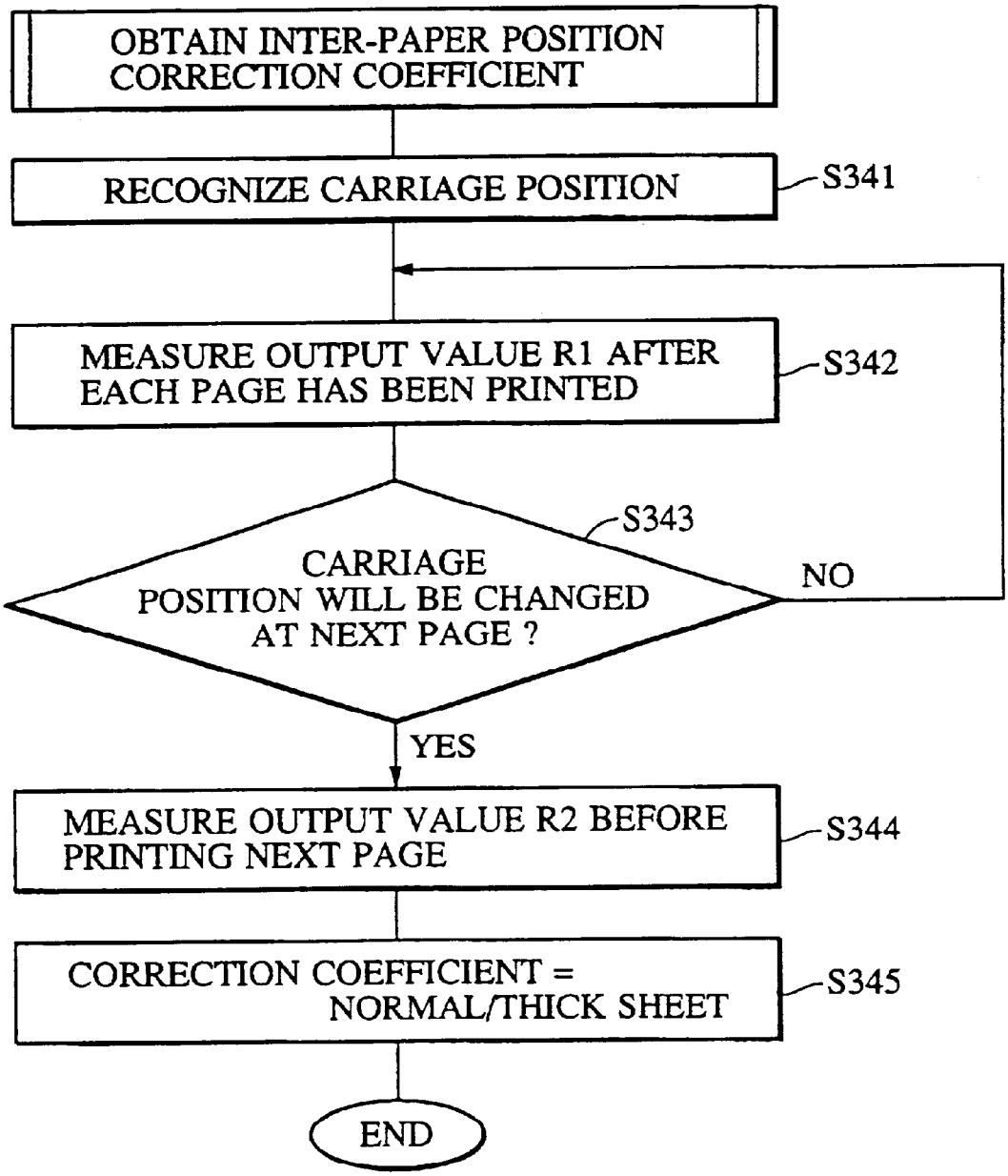

FIG. 38 is a flow chart for calculating a correction coefficient for the paper-distance position. In step S341 whether the carriage is at the normal position or the thick-paper position is recognized. The recognition may be performed by a method similar to that according to the seventh and eighth embodiments.

In step S342 output value R1 is measured after the recognized carriage position has been recorded.

In step S343 whether or not the carriage position is changed to record the next page is discriminated. If the position is not changed, the output value is not required to be changed and therefore the recording operation is continued. Then, the operation returns to step S342 so that output value R1 is measured after the recording operation has been completed. At this time, R1 is updated.

If a discrimination is performed in step S343 that the carriage position has been changed, output value R2 is measured in step S344 before the recording operation is performed, and the operation proceeds to step S345.

In step S345 correction coefficient=output value at normal position/output value at thick-paper position is calculated.

The calculated correction coefficient is used in place of uniform correction coefficient 1.5 in step S335 shown in FIG. 37.

Since the foregoing method enables the correction coefficient to be calculated for each of the ink tanks which are being used, the residual quantity of ink can be detected with a further improved accuracy.

Ninth Embodiment

A ninth embodiment of the present invention will now be described.

This embodiment has a structure for further reliably turning the alarm lamp off as compared with the sixth embodiment.

Although the sixth embodiment has the structure that if the ink tank is changed to a new ink tank, then the quantity of change in the output values before and after the recovery operation is detected, and the alarm lamp is turned off in accordance with the result of the detection, this embodiment has a structure such that, even if the recovery operation is not performed though the ink tank has been changed to a new ink tank, the alarm lamp is automatically turned off.

Figure 39:
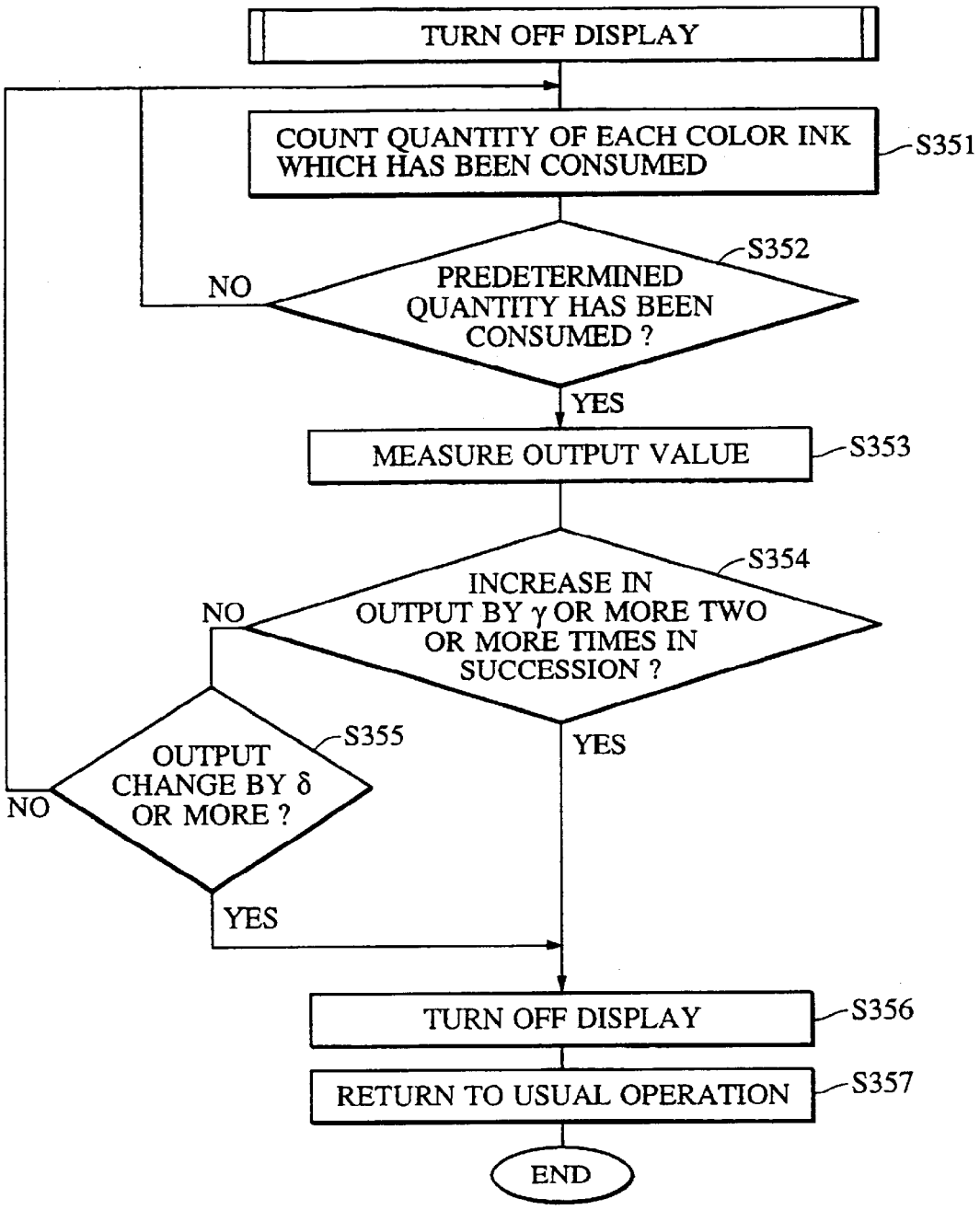

FIG. 39 illustrates the operation to be performed after the alarm lamp has been turned on due to depletion of ink. Since the operation to be performed before the alarm lamp is turn on is the same as that according to the sixth embodiment, the operation is omitted from the description here.

In step S351 the quantity of consumption of each color ink is counted after the alarm lamp has been turned on.

In step S352 it the quantity of consumption reaches a predetermined quantity, the operation proceeds to step S353 so that the output value is measured.

In step S354 whether or not the enlargement of the output value obtained in step S353 is larger than $\gamma$ or less two times consecutively is discriminated. If the enlargement is $\gamma$ or less, the operation proceeds to step S356 so that the alarm lamp is turned off.

In a case where the recovery operation is not performed though change to a new ink tank is performed, if the output value is not enlarged, a discrimination is performed that ink exists in a sufficient quantity in the absorber in the ink tank and therefore the ink tank has been changed. The reason why the output values are consecutively observed two times is that only one output value will raises a possibility of an error in detection. Although three or more output values may be observed, an excessively long time is required to turn the alarm lamp off in this case.

If the output values were not enlarged by $\gamma$ two times consecutively in step S354, the operation proceeds to step S355 so that whether or not the present output value is larger than the previous output value by $\delta$ or more is discriminated. If the enlargement is larger than $\delta$, the operation proceeds to step S356 so that the alarm lamp is turned off.

In this embodiment, if the output is enlarged or reduced by a degree larger than a predetermined value, a discrimination is performed that change to another ink tank has been performed.

In this embodiment, $\gamma$ was set to 0.07, $\delta$ was set to 0.15, the ink tank was changed immediately after the alarm lamp had been turned on and the recording operation was continued without performing the recovery operation. As a result, the alarm lamp was turned off after lapse of a certain time.

As described above, in this embodiment, even if the recovery operation is not performed when the ink tank was changed, detection of no change in the output value or detection of rapid change in the output value enables the alarm lamp to be automatically turned off.

Tenth Embodiment

A tenth embodiment of the present invention will now be described.

This embodiment is able to prevent scattering in the quantity of reflected light during a plurality of detection operations occurring due to scattering in the stop position for the carriage. That is, unsatisfactory reproductivity of the detected quantity of reflected light regardless of the residual quantity of ink is intended to be overcome. Although the output value was obtained in one measuring operation in the foregoing fifth embodiment, this embodiment has a structure (1) the average value of the previous data and present data is employed as the present output value or (2) the average value of values consecutively obtained m times is employed as the n-th output value.

In the case where the average value of the previous data and present data is employed as the present output value, the obtained value at the first time is employed as the first output value, the average value of the first output value and the second obtained value is employed as the second output value, the average value of the first and second output values and the third obtained value is employed as the third output value, and the average value of the n−2 and n−1 output values and the n-th obtained value is employed as the n-th output value.

In the case where the average value of values consecutively obtained m times is employed as the n-th output value, the average value of three values obtained for each color by scanning the carriage three times is employed as the output value. Although the throughput deteriorates in the foregoing case, change in the residual quantity of ink is detected in accordance with the change in the obtained values so that accurate detection is performed.

Although the fifth to tenth embodiments have been described about the case where substantially the same output values are obtained from ink tanks for the respective colors in the ink jet recording apparatus having ink tanks for the respective colors, the output value for each color sometimes is different depending upon the material of the wall of the ink tank, that of the ink absorber, and the characteristic of ink. In the foregoing case, the reference value for detecting the residual quantity of ink is required to be different for each color.

For example, $\alpha$, $\beta$, $\gamma$ and $\delta$ according to the first to sixth embodiments are required to be determined for each color. In the foregoing case, all of the four values may be different for each color. As an alternative to this, since $\beta$ and $\gamma$ are usually have small set values and therefore they are not required to be different for each color, only $\alpha$ and $\delta$ are made to be different for each color.

Although the preferred embodiments of the present invention have been described above, the present invention is not limited to the embodiments.

Eleventh Embodiment

An eleventh embodiment of the present invention will now be described.

According to this embodiment, there is provided an ink jet recording apparatus having a function of accurately detecting the residual quantity of ink in ink tanks each including a negative pressure generating member, such as a foaming material and a function of detecting the distance from a recording means and the recording paper.

The structure of the ink jet recording apparatus and its unit for detecting the residual quantity of ink according to this embodiment is the same as that according to the first embodiment and the fifth embodiment and the like.

This embodiment has a structure formed on the basis of each of the foregoing embodiments and has a characteristic that the photointerrupter 6 is used as a sensor for detecting the distance from the recording head to the paper.

In this embodiment, a reflection portion 1*a* for reflecting light supplied from the photointerrupter 6 is provided for the bottom portion of the carriage 1 shown in FIG. 1. The paper-position switch lever 5 shown in FIG. 1 is at the thin paper position. A case where thick paper is used as a recording medium will now be described briefly.

When the paper-position switch lever 5 provided for the carriage 1 is rotated in a direction indicated by an arrow X shown in FIG. 1 relative to the shaft 5*a*, a bottom portion 5*b* of the paper-position switch lever 5 is slid on an upper surface 4*a* of the carriage support plate 4. The carriage support plate 4 is pushed downwards in a direction indicated by an arrow B shown in FIG. 1 due to the difference in the distance from the shaft 5*a* to the bottom portion 5*b* of the paper-position switch lever 5. As a result, the carriage 1 including the paper-position switch lever 5 is pushed upwards relatively to the support shaft 3. As a result of upward pushing, the distance from a recording head (not shown) mounted on the carriage 1 to paper serving as the recording medium is lengthened as compared with the distance in the case of the thin paper position. The thick-paper position is a position selected when an image is formed on paper thicker than usual paper or a thick special film.

Figure 17:
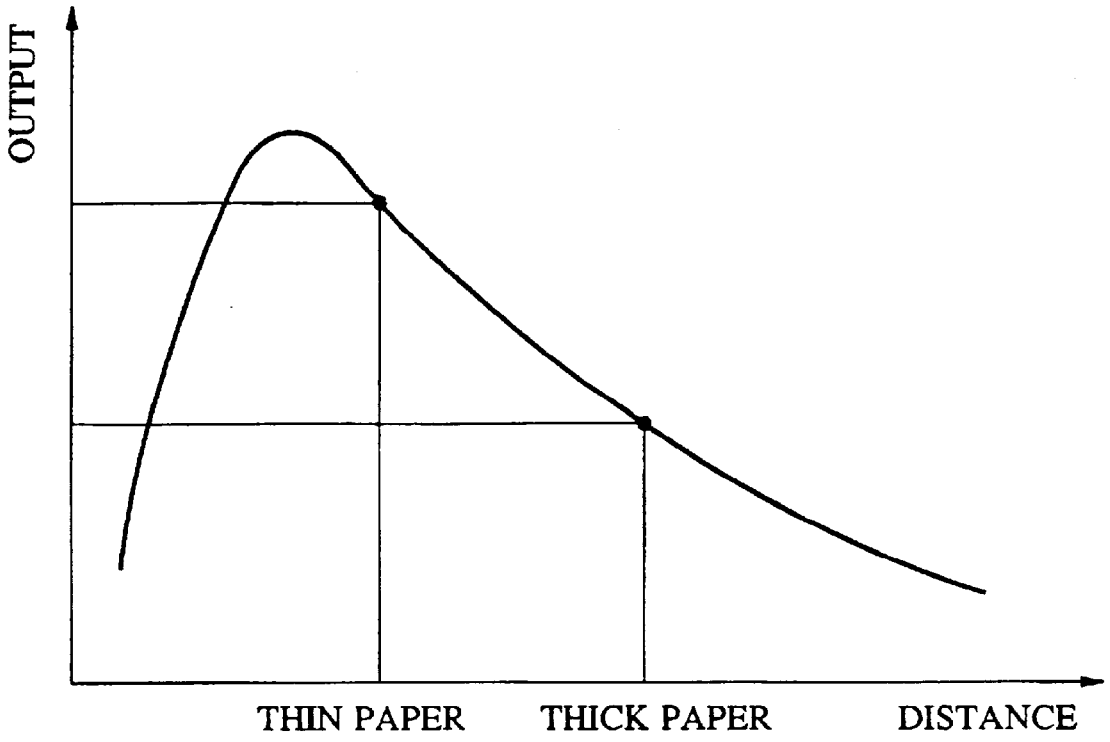
FIG. 17 is a graph showing the output characteristic of the photointerrupter corresponding to the distance according to the embodiment of the present invention.

The output from the photointerrupter 6 is made to be different between the thick-paper position and the thin-paper position. FIG. 17 is a characteristic graph showing the relationship between the output voltage from the photointerrupter and the distance from the photointerrupter to the subject article. As can be understood from FIG. 17, the characteristic between the output and the distance is such that the output voltage is high when the position is the thin-paper position, whereas the output voltage is low when the position is the thick-paper position.

Figure 18:
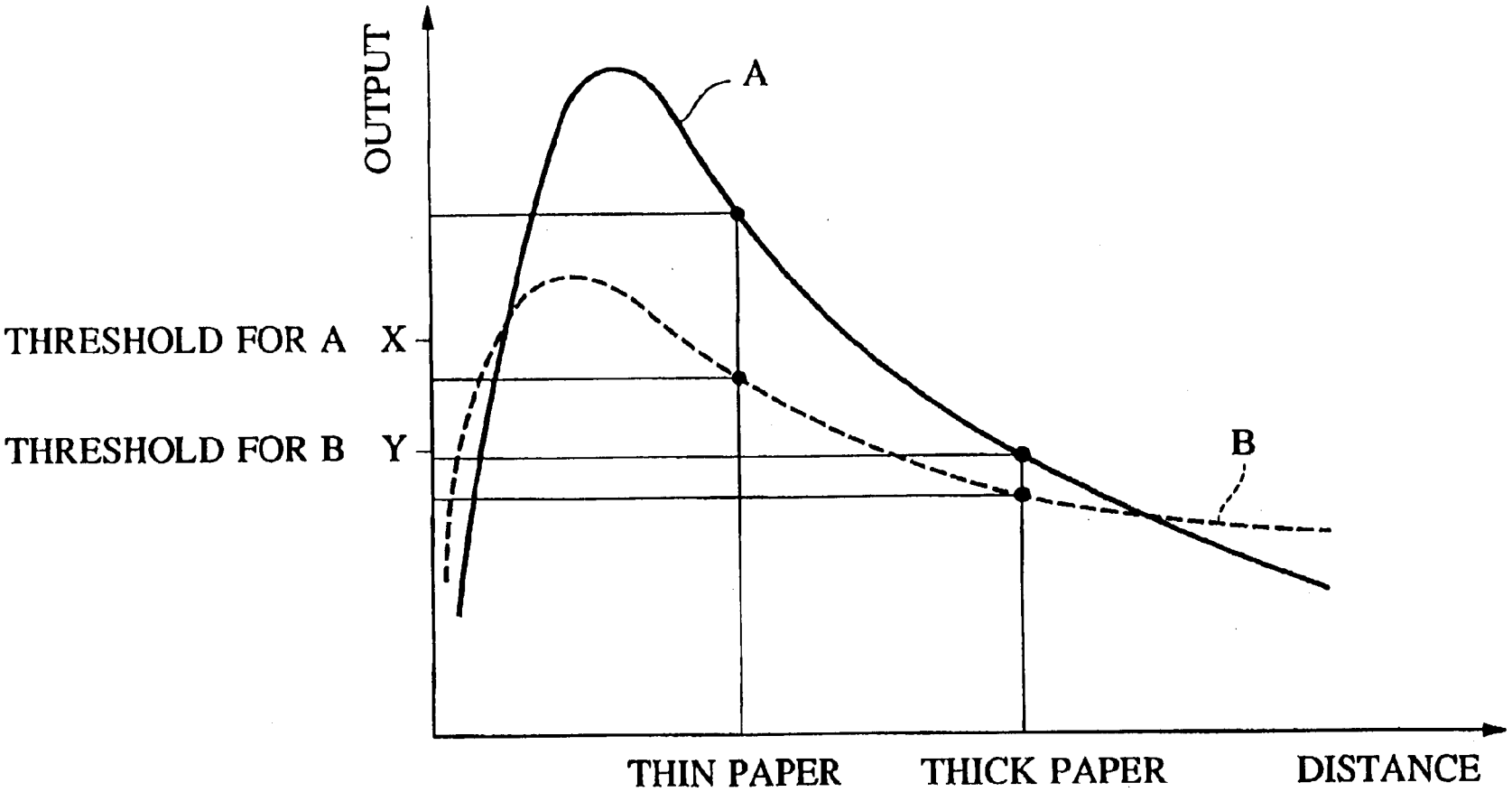
FIG. 18 is a graph showing the necessity of calibration of the output characteristic of the photointerrupter according to the embodiment of the present invention corresponding to the distance.

However, the photointerrupter having the foregoing characteristic between the output and the distance scatters undesirably as described with reference to FIG. 18. In a case where photointerrupters A and B are prepared, if a threshold for discriminating whether the paper is thick or thin is obtained to be adaptable to the characteristic (indicated by a continuous line) of A, output X is made. Since the output voltage at the thin-paper position is lower than X in the case of the characteristic of B (indicated by a dashed line), a discrimination is performed that the paper is thick paper. Furthermore, the threshold for B must be Y. Therefore, the threshold must be set to be adaptable to the characteristic of the photointerrupter.

Accordingly, in this embodiment, the photointerrupter 6 is disposed to be opposite to the reflection portion 1*a* of the carriage 1 when the carriage 1 is stopped at the capping position. Reflected light is detected at the foregoing capping position to perform calibration of the sensitivity. As a result, the outputs from the photointerrupter 6 can be made to be constant.

Figure 19A:
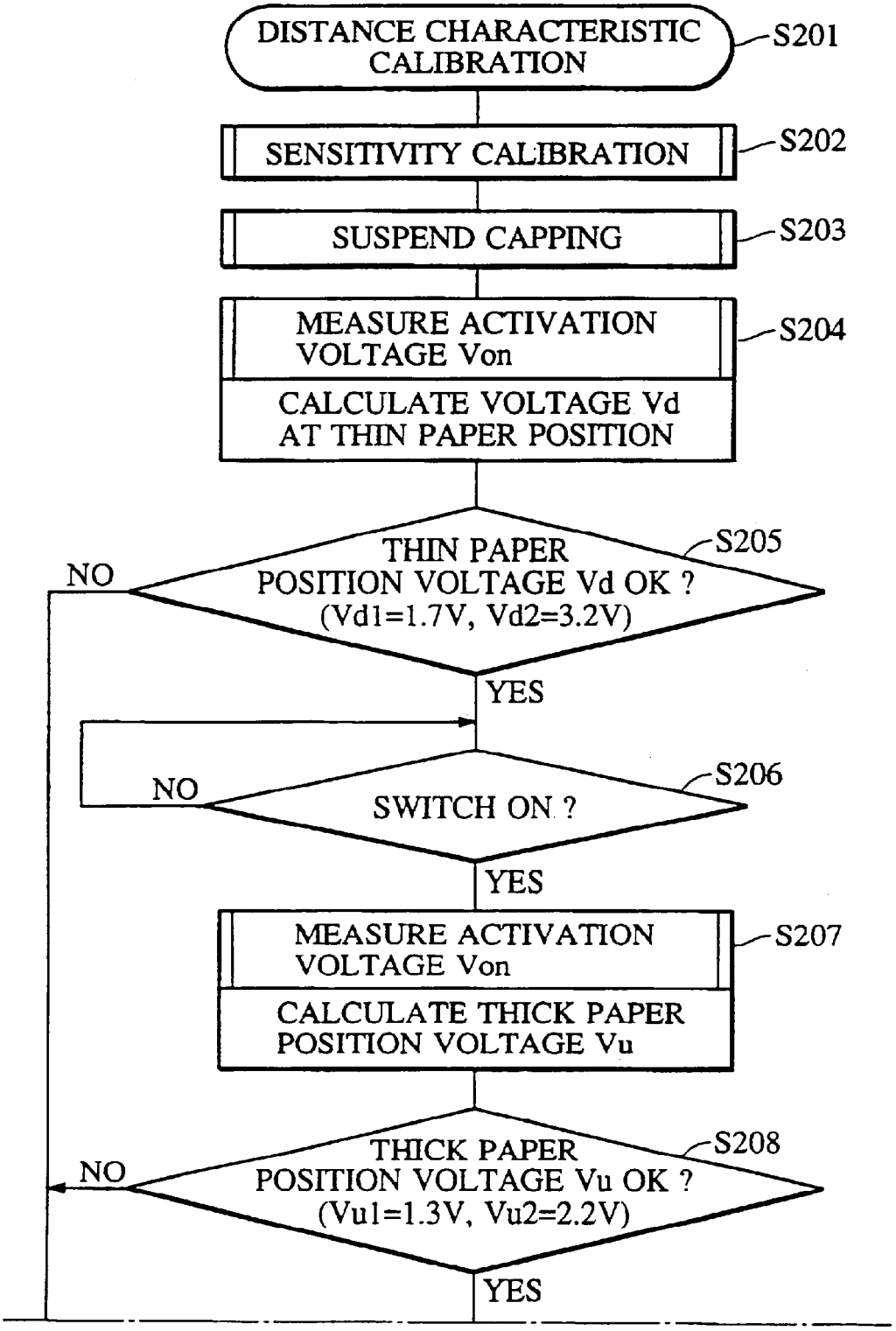
FIGS. 19A and 19B are flowcharts showing the sequence of the calibration for the photointerrupter according to the embodiment of the present invention.
Figures 19, 19B:
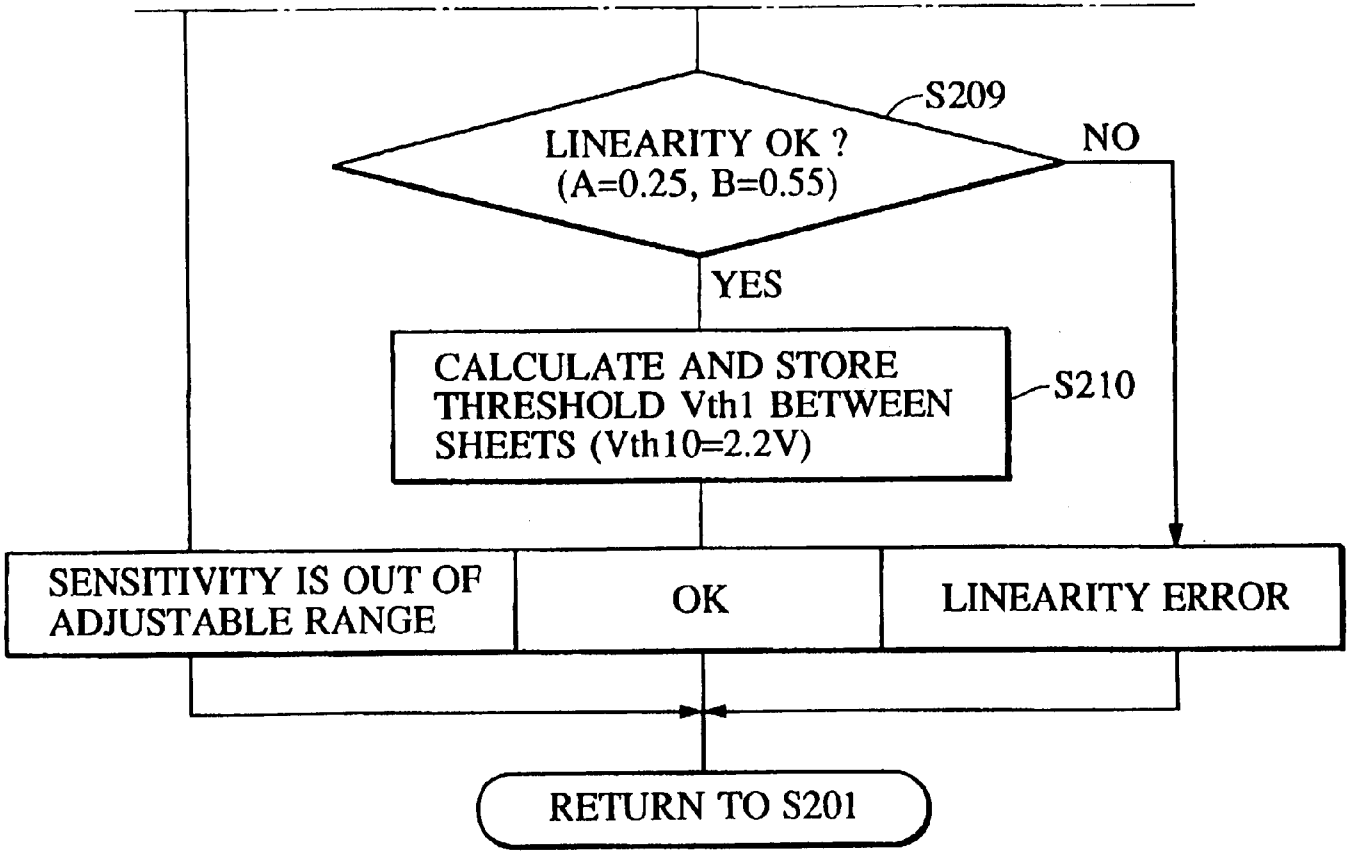
FIG. 19 is a block diagram showing that FIGS. 19A and 19B are to be read as connected flowcharts.

The sequence for the distance characteristic calibration and that for sensitivity calibration for the photointerrupter according to this embodiment will now be described with reference to FIG. 19.

In step S201 the carriage 1 is stopped at the capping position, and the paper-position switch lever 5 shown in FIG. 1 is set to the thin-paper position. Then, the distance characteristic calibration is performed.

Similarly to step S201, the sensitivity calibration of the photointerrupter 6 is performed at the capping position in step S202.

In step S203 capping is suspended, and activation voltage Von is measured in step S204 to calculate output voltage Vd at the thin-paper position by using the difference from Voff.

If output voltage Vd at the thin-paper position satisfies Vd1<Vd<Vd2 in step S205, the operation proceeds to step S206 so that the paper-position switch lever 5 is set to the thick-paper position and depression of the switch is waited for. If the foregoing inequality is not satisfied in step S205, the output voltage is out of the sensitivity adjustable range and the operation returns to step S201. The foregoing discrimination that the output voltage is out of the sensitivity adjustable range is performed due to an error in the reflectance of the carriage, the inclination and the like. In this embodiment, Vd1 was set to be 1.7 V and Vd2 was set to be 3.2 V.

If the switch is depressed in step S206, the operation proceeds to step S207 so that the activation voltage Von is measured to calculate output voltage Vu at the thick-paper position by using the difference from Voff.

If the output voltage Vu at the thick-paper position satisfies Vu1<Vu<Vu2 in step S208, the operation proceeds to step S209 so that the linearity is discriminated. If the foregoing inequality is not satisfied in step S208, a discrimination is performed that the output voltage is out of the sensitivity adjustable range, the operation returns to step S201. If the linearity (Vu−Vcal) does not satisfy (Vd−Vcal) A<(Vu−Vcal)<(Vd−Vcal) B, a discrimination is performed that a linearity error has taken place, and the operation returns to step S201. In this embodiment, A was set to 0.25 and B was set to 0.55.

If the linearity (Vu−Vcal) satisfies the foregoing inequality, the operation proceeds to step S210 so that the paper-distance threshold Vth1 is obtained from Vth1=(Vd+Vu)/2 and the result is stored. Note that Vth1 was 2.2 V in this embodiment.

After the foregoing sequence has been completed, the operation returns to step S201.

As described above, in this embodiment, the photointerrupter 6 for detecting the residual quantity of ink is as well as used as the sensor for detecting the distance from the head and the paper. Therefore, the cost and the space can be reduced.

Twelfth Embodiment

As described above, the structure for detecting the residual quantity of ink according to each of the foregoing embodiments sometimes encounters a difficulty in accurate detection due to irregular density in the absorber 7*a*. A structure for overcoming the problem due to irregular density of the absorber 7*a* according to this embodiment will now be described with reference to FIG. 41.

Figure 41:
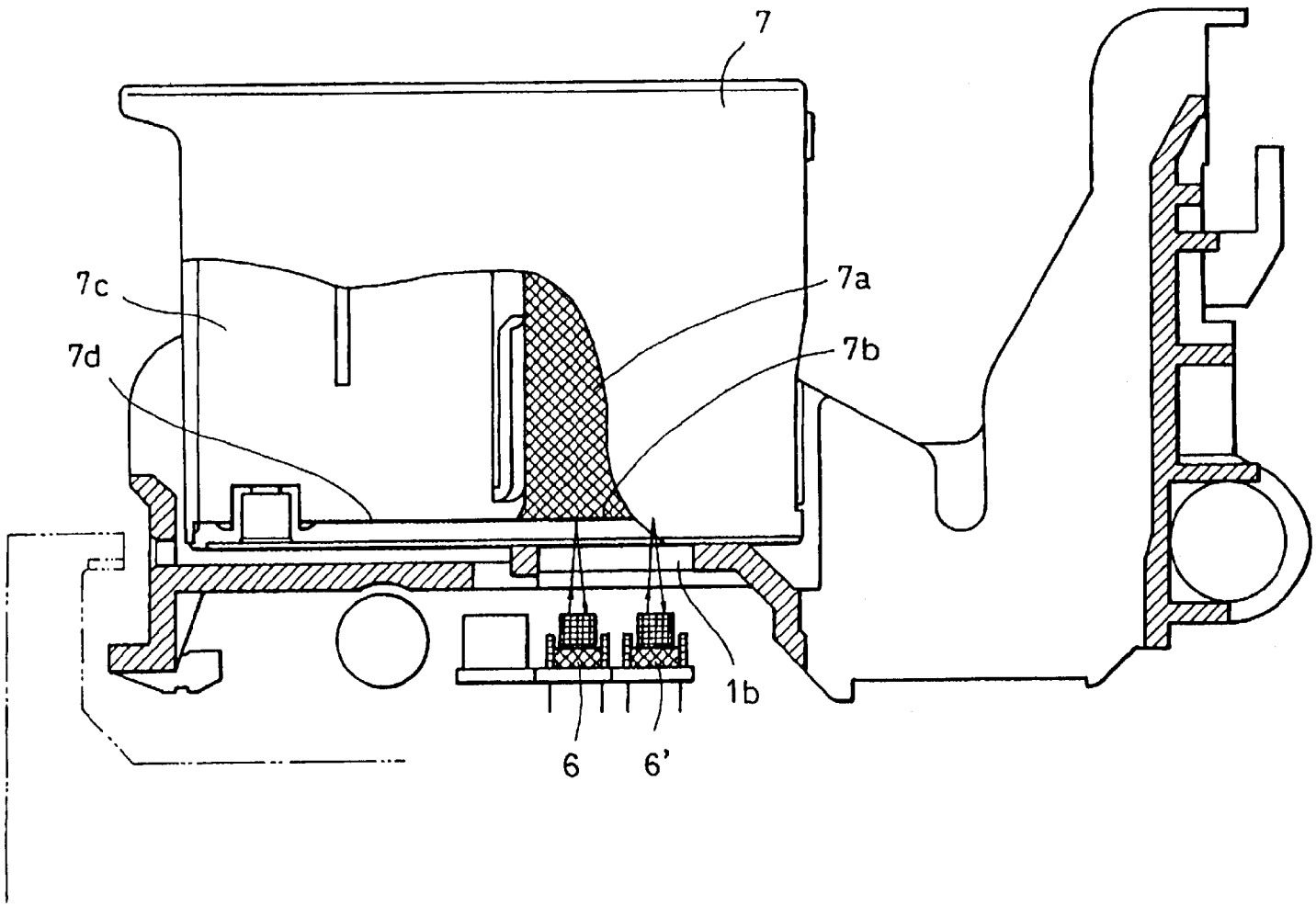
FIG. 41 is a diagram showing the structure of the sensor according to the embodiment of the present invention.

Referring to FIG. 41, the same elements as those shown in FIG. 6 are given the same reference numerals. Reference numeral 6' represents a photointerrupter serving as a second ink sensor and having the same structure as that of the photointerrupter 6. In this embodiment, the photointerrupter 6 is also called a first photointerrupter to simplify the description.

Although the first embodiment has the structure such that the residual quantity of ink is discriminated in accordance with the output from the photointerrupter 6, this embodiment has a structure such that the average value of the output from the first photointerrupter 6 and that from the second photointerrupter 6' is used to detect the depletion of ink. The average value may be a simple average or a weighted average. In this embodiment, since the second photointerrupter 6' is located near the supply port 24 as compared with the first photointerrupter 6, the output is changed when the recordable number of sheets has been further decreased. Therefore, the output to be weighted is determined in accordance with the residual number of sheets intended to be detected.

Since the sensors for detecting the residual quantity of ink are provided at a plurality of positions and the average value of the measured values obtained from the plural detection points is used, the residual quantity can be detected accurately even if the density of the absorber 7*a* is irregular because its influence can be eliminated.

Another method may be employed which is capable of preventing scattering in the detected values due to the influence of irregularity of the density of the absorber 7*a* and which has a structure such that the photointerrupter 6 shown in FIG. 6 is made to be movable to detect the residual quantity of ink at a plurality of points of the ink tank 7.

As an alternative to the structure in which the photointerrupter 6 is made to be movable, a plurality of points may be measured while moving the carriage 1 in such a manner that the photointerrupter 6 is fixed. In the foregoing case, the ink tank 7 must have a certain thickness in the moving direction to attain the effect intended to be obtained by increasing the number of detection points.

In this embodiment, the photointerrupter 6 and the carriage 1 are moved relatively to detect the residual quantity of ink at a plurality of detection points. Since the average value of the measured values at a plurality of detection points is employed, the residual quantity can be detected accurately even if the density of the absorber is irregular because its influence can be eliminated.

Thirteenth Embodiment

In each of the foregoing embodiments, the alarm is issued or the recording operation is interrupted if the depletion of ink has been detected in accordance with the output from the photointerrupter 6.

In this embodiment, the alarm issue or the interruption of the recording operation is not performed in the case where the output from the sensor exceeds a threshold. As an alternative to this, display corresponding to the output from the photointerrupter 6, that is, display in proportion to the output from the photointerrupter 6 or display which is monotonously changed is performed.

As can be understood from FIG. 8, when the residual quantity of ink in the ink tank 7 has been reduced, the output from the photointerrupter 6 is continuously changed. By displaying the residual quantity corresponding to the change in the output, display substantially corresponding to the recordable number of sheets can be performed continuously. Thus, further detailed information about the residual quantity of ink can be given to a user.

Figure 42:
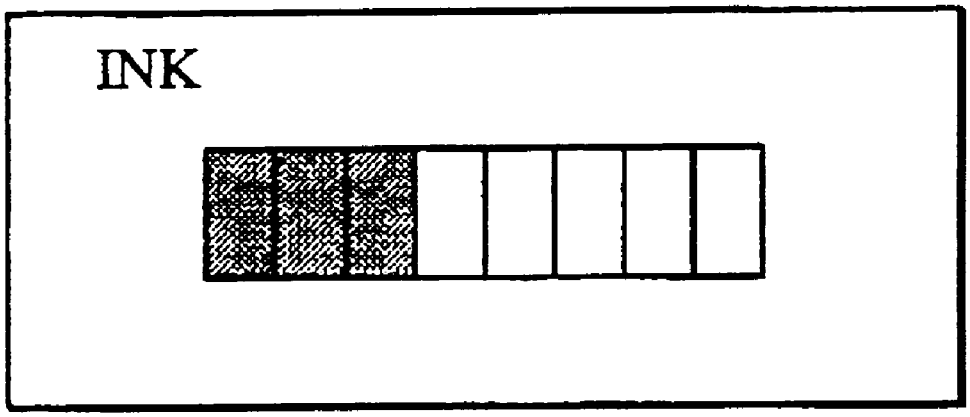
FIG. 42 is a diagram showing an example of display of the result of the detection of the residual quantity of ink according to the embodiment of the present invention.

FIG. 42 shows an example of display of the residual quantity of ink in the ink tank 7 on a display panel. The display on the display panel may be performed such that the level of a digital meter is changed to correspond to the number of recordable sheets as shown in FIG. 42 or the number of recordable sheets is displayed with figures. The display panel may be made of liquid crystal or a usual display unit.

As an alternative to the visual display means, voice guide of the number of recordable sheets, the length of the number of times of buzzer sounds corresponding to the number of recordable sheets may be employed.

As a result of the foregoing structure, detailed information about the residual quantity of ink corresponding to the output from the photointerrupter 6 can be given to a user. According to this embodiment, a user is able to recognize detailed information about the residual quantity of ink when the ink in the ink tank 7 has been depleted. Thus, the user is able to perform maintenance, such as change of the ink tank, at a proper timing.

Fourteenth Embodiment

In the first structure, the ink tank 7 comprises the absorber 7*a* and the raw ink accommodating portion 7*c*. The present invention is not limited to the foregoing structure. The present invention may be adapted to a structure shown in FIG. 43.

Figure 43:
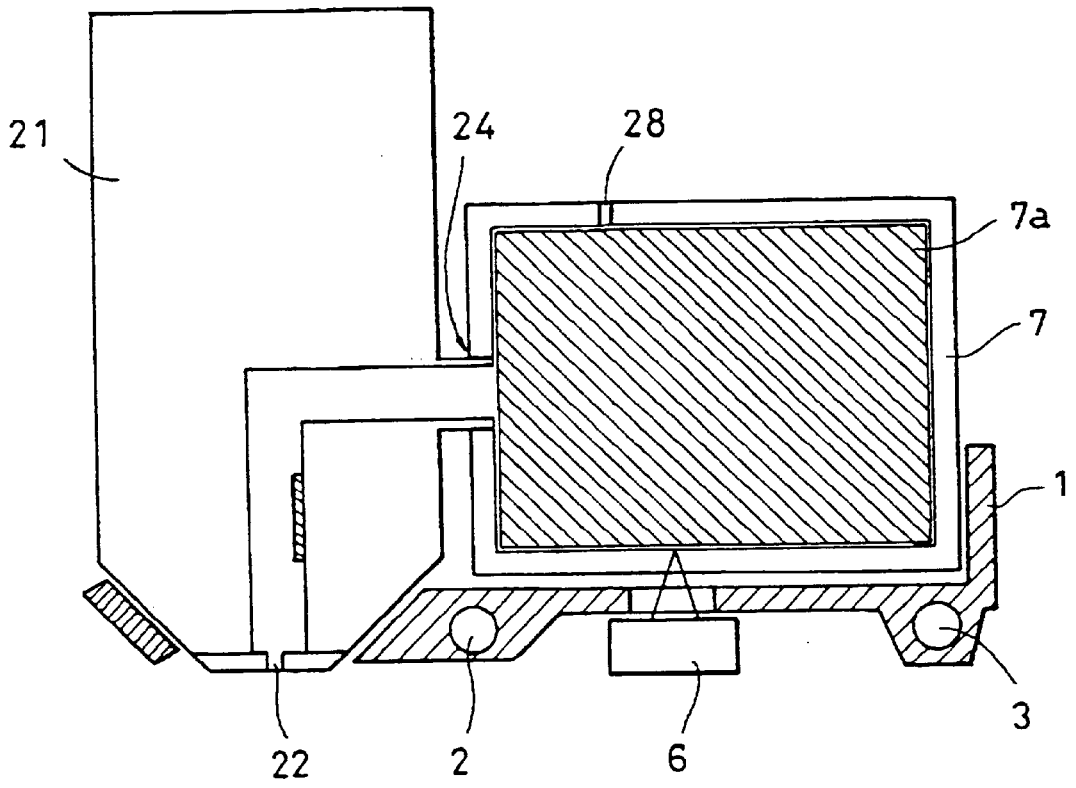
FIG. 43 is a diagram showing the structures of the carriage and the sensor according to the embodiment of the present invention.

Referring to FIG. 43, reference numeral 24 represents a supply port, 28 represents an air communication port, and 6 represents a photointerrupter, similarly to FIG. 2. The photointerrupter 6 is so disposed as to be capable of detecting change in the reflectance at the bottom surface of the absorber 7*a*, similarly to the first embodiment.

In the ink tank shown in FIG. 43, ink depletes in portions apart from the supply port 24 in the inside of the ink tank 7 as ink is consumed. Therefore, the photointerrupter 6 is caused to detect reflected light from the bottom portion of the ink tank 7 to detect the residual quantity in accordance with the change in the reflectance.

Fifteenth Embodiment

According to the present invention, no reflected light is obtained from the photointerrupter 6 if the ink tank 7 is not mounted. Therefore, a considerably low output level is realized as compared with the output level if ink exists in a sufficiently large quantity.

In this embodiment, the structure for detecting the residual quantity of ink according to the first embodiment is employed to detect whether or not the ink tank 7 exists by means of the photointerrupter 6.

By using the photointerrupter 6, the difference between the detected level in the case where the ink tank 7 is mounted and the detected level in the case where the ink tank 7 is not mounted is used to detect whether or not the ink tank 7 exists.

According to this embodiment, existence of the color ink tanks for a color printer can be detected respectively. Thus, if the ink tank is not mounted, the recording operation is inhibited.

According to the foregoing structure, any special structure for detecting existence of ink tank is not required to detect the existence of the ink tank. Thus, the residual quantity of ink in the ink tank and whether or not ink tank exists can be detected without cost enlargement and with a simple structure.

Other Embodiments

Among the ink jet recording methods, a recording apparatus of a type having a recording head having an arrangement that heat energy is utilized to form a flying fluid droplet so as to perform the recording operation causes an excellent effect to be obtained.

As for the typical structure and the principle, it is preferable that the basic structure disclosed in, for example, U.S. Pat. Nos. 4,723,129 or 4,740,796 is employed. The aforesaid method can be adapted to both a so-called on-demand type apparatus and a continuous type apparatus. In particular, a satisfactory effect can be obtained when the on-demand type apparatus is employed because of the structure arranged in such a manner that one or more drive signals, which rapidly raise the temperature of an electricity-to-heat converter disposed to face a sheet or a fluid passage which holds the fluid (ink) to a level higher than levels at which nucleate boiling takes place are applied to the electricity-to-heat converter so as to generate heat energy in the electricity-to-heat converter and to cause at the heat effecting surface of the recording head film boiling to take place so that bubbles can be formed in the fluid (ink) to correspond to the one or more drive signals. The enlargement/contraction of the bubble will cause the fluid (ink) to be discharged through a discharging opening so that one or more droplets are formed. If a pulse shaped drive signal is employed, the bubble can be enlarged/contracted immediately and properly, causing a further preferred effect to be obtained because the fluid (ink) can be discharged with excellent responsiveness. It is preferable that a pulse drive signal disclosed in U.S. Pat. Nos. 4,463,359 or 4,345,262 is employed. If conditions disclosed in U.S. Pat. No. 4,313,124, which relates to the temperature rising ratio at the heat effecting surface, are employed, a satisfactory recording result can be obtained.

As an alternative to the structure (linear fluid passage or perpendicular fluid passage) of the recording head disclosed in each of the aforesaid inventions and having an arrangement that discharge ports, fluid passages and electricity-to-heat converters are combined, a structure having an arrangement that the heat effecting surface is disposed in a bent region as disclosed in U.S. Pat. Nos. 4,558,333 or 4,459,600 may be employed. In addition, the following structures may be employed: a structure having an arrangement that a common slit is formed to serve as a discharge section of a plurality of electricity-to-heat converters as disclosed in Japanese Patent Laid-Open No. 59-123670; and a structure in which an opening for absorbing pressure waves of heat energy is disposed to correspond to the discharge section.

As a full-line type recording head having a length capable of covering the width of the largest recording medium which can be recorded by the recording apparatus, a structure enabled to have the length by combining a plurality of recording heads or a structure having a sole integrated recording head as disclosed in any of the aforesaid specifications may be employed.

A chip type recording head which can be electrically connected to the body of the apparatus or to which ink can be supplied from the body of the apparatus when it is fastened to the body of the apparatus may be employed. Furthermore, a cartridge recording head having an ink tank integrally formed with the recording head may be employed.

It is preferred to additionally employ the recording head restoring means and an auxiliary means provided as the component of the present invention because the effect of the present invention can be further stabilized. Specifically, it is preferable to employ any combination of a recording head capping means, a cleaning means, a pressurizing or suction means, an electricity-to-heat converter, an auxiliarly heating element or a sub-heating means constituted by combining the converter and the auxiliary heating element and a sub-discharge means with which a discharge is performed independently from the recording discharge.

As for the types and the number of the recording heads to be mounted, two or more recording heads may be provided to correspond to a plurality of different color inks or to inks having different concentrations. The recording apparatus may be arranged to be capable of recording a color-combined image composed of different colors or a full color image obtained by mixing colors to each other by integrally forming the recording head or by combining a plurality of recording heads as well as recording only a main color such as black.

The ink jet head recording apparatus according to the present invention may be in the form of a copying apparatus combined with a reader or the like, or a facsimile apparatus having a transmission/receiving function as well as the image output terminal equipment of information processing apparatus such as a computer.

As described above, the means is provided which detects change in the light reflectance at the boundary portion between the wall surface of the ink tank and the ink absorber through a portion of the wall surface of the ink tank to detect the residual quantity of ink in accordance with the difference between the reflectance obtained in the case where ink exists and that obtained in the case where no ink exists. As a result, a function for detecting the residual quantity of ink can be realized which is able to accurately display the residual quantity of ink at desired levels even if the ink tank includes an absorber.

A similar structure enables detection whether or not the ink tank is mounted.

According to the present invention, the pulse width modulation of the drive signal for operating the light emitting portion, such as the LED, is controlled to change the duty ratio of light emission of the light emitting portion so that the quantity of light, which is emitted by the light emitting portion, can automatically be adjusted. For example, the adjustment operation can be performed immediately after the power source for the apparatus has been turned on and thus the adjustment can be performed even after temperature apparatus has been shipped to the market. Therefore, the residual quantity of ink can stably be detected.

According to the present invention, a function for precisely detecting the residual quantity of ink can be realized and the distance from the recording head to paper can be detected. Thus, the cost and space can be reduced.

According to the present invention, the sensitivity of the photointerrupter of the foregoing mechanism for detecting the residual quantity of ink can easily be corrected so that a precise function for detecting the residual quantity is realized.

According to the present invention, the residual quantity of ink in an ink tank including an ink absorber can accurately be detected. Since the method of detecting the quantity of change in the light reflectance of the ink absorber is employed, the residual quantity of ink can always be detected with a constant accuracy even if the outputs from the sensor scatter, scatters take place due to the mounting accuracy or the reflectances of the ink tank scatter due to a manufacturing error.

Since the alarm lamp or the like for indicating depletion of ink can automatically be turned off without user's operation after a new ink tank has been mounted, the apparatus can be operated more easily.

Although the invention has been described in its preferred form with a certain degree of particularity, it is understood that the present disclosure of the preferred form can be changed in the details of construction and the combination and arrangement of parts may be resorted to without departing from the spirit and the scope of the invention as hereinafter claimed.

What is claimed is:

1. An ink jet recording apparatus having a recording head for discharging ink through a nozzle thereof and an ink tank for supplying ink to said recording head, said ink tank having a supply port for supplying ink to said recording head and including a negative pressure generating member for generating negative pressure so as to discharge ink from said nozzle of said recording head to print an image on a recording medium, said ink jet recording apparatus comprising:

light emitting means for emitting light to a portion of a wall surface in said ink tank at which said negative pressure generating member is located;

light receiving means for receiving reflected light of light emitted by said light emitting means; and discrimination means for discriminating a state of residual quantity of ink in said ink tank in accordance with a quantity of light received by said light receiving means, wherein light which is received by said light receiving means includes light reflected by an inside wall of said ink tank and light reflected by said negative pressure generating member.

2. An ink jet recording apparatus according to claim 1, wherein said light receiving means receives light emitted by said light emitting means and reflected by said wall surface, a boundary surface between said wall surface and said negative pressure generating member and said negative pressure generating member.

3. An ink jet recording apparatus according to claim 1, wherein wavelength of light emitted by said light emitting means is the wavelength which penetrates ink in said ink tank.

4. An ink jet recording apparatus according to claim 1, wherein said wall surface of said ink tank to which light emitted by said light emitting means is a bottom portion of said ink tank.

5. An ink jet recording apparatus according to claim 1, wherein said discrimination means discriminates that the residual quantity of ink in said ink tank is smaller than a predetermined quantity when the quantity of light received by said light receiving means is larger than a predetermined threshold.

6. An ink jet recording apparatus according to claim 1, wherein said discrimination means discriminates the residual quantity state of ink in said ink tank in accordance with change in the quantity of light received by said light receiving means.

7. An ink jet recording apparatus according to claim 1 further comprising:

reflectance calculating means for calculating the reflectance in accordance with light emitted by said light emitting means and light received by said light receiving means, wherein said discrimination means discriminates the residual quantity state of ink in said ink tank in accordance with said reflectance.

8. An ink jet recording apparatus according to claim 1 further comprising display means for displaying the residual quantity state of ink in accordance with discrimination performed by said discrimination means.

9. An ink jet recording apparatus according to claim 1 further comprising:

recording control means for interrupting a recording operation performed by said recording head when said discrimination means has discriminated that the residual quantity state of ink in said ink tank has been reduced to a level lower than a predetermined residual quantity.

10. An ink jet recording apparatus according to claim 1 further comprising:

a carriage on which both recording head and said ink tank can be mounted;

scanning means for scanning said carriage relatively to a recording medium; and control means for causing said scanning means to scan said carriage to a position, at which said light emitting means and said light receiving means face said wall surface of said ink tank, to discriminate the residual quantity state of ink in said ink tank.

11. An ink jet recording apparatus according to claim 10, wherein a plurality of said recording heads are provided, a plurality of said ink tanks are provided to correspond to said plurality of said recording heads, and said control means causes said scanning means to make the wall surface of each of said ink tanks to face said light emitting means and said light receiving means, and said discrimination means sequentially discriminates the residual quantity state of ink in said plurality of said ink tanks.

12. An ink jet recording apparatus according to claim 1, wherein said discrimination means causes said scanning means to relatively scan said carriage, said light emitting means and said light receiving means to perform discrimination at a plurality of positions of said wall surface in accordance with reflected light.

13. An ink jet recording apparatus according to claim 1 further comprising:

ink tank detection means for detecting whether or not said ink tank exists in accordance with light received by said light receiving means.

14. An ink jet recording apparatus according to claim 1, wherein said light emitting means and said light receiving means are formed integrally into a photointerrupter.

15. An ink jet recording apparatus according to claim 1 further comprising adjustment means which is capable of adjusting the quantity of light which is emitted by said light emitting means.

16. An ink jet recording apparatus according to claim 15, wherein said light emitting means emits light in response to an electric signal applied thereto, and said adjustment means modulates the pulse width of said electric signal to be supplied to said light emitting means to enable the quantity of light, which is emitted by said light emitting means, to be adjusted.

17. An ink jet recording apparatus according to claim 16, wherein said electric signal is a signal in the form of a pulse, and said adjustment means adjusts the width of said pulse.

18. An ink jet recording apparatus according to claim 16 further comprising:

reflecting portion so disposed as to be capable of reflecting light emitted by said light emitting portion to said light receiving portion; and means for causing said adjustment means to modulate said electric signal to be supplied to said light emitting means in response to light reflected by said reflecting portion in such a manner that the quantity of light received by said light receiving means is made to be constant.

19. An ink jet recording apparatus according to claim 16 further comprising:

storage means for storing information formed on the basis of said drive signal modulated by said adjustment means, wherein said discrimination means subjects information formed on the basis of the quantity of light emitted to said wall surface of said ink tank, reflected by the same and received by said receiving means and information stored in said storage means to a comparison to discriminate the residual quantity state of ink in said ink tank.

20. An ink jet recording apparatus according to claim 1 further comprising:

correction means for correcting a signal formed on the basis of the quantity of light received by said light receiving means.

21. An ink jet recording apparatus according to claim 1, wherein said recording head applies thermal energy to ink to cause ink to change the state thereof due to heat so that ink is discharged due to pressure generated due to change in the state of ink.

22. An ink jet recording apparatus according to claim 1, wherein said light emitting means and said light receiving means are comprised by a photointerrupt, the photointerrupt provided individually from a carriage, wherein the carriage has an opening portion for permitting light emitted from said light emitting means to pass through and a reflecting plate for reflecting said emitted light, and wherein sensitivities of said light emitting means and said light receiving means are controlled at a capping position at which a distance from the carriage to the photointerrupt is constant.

23. An ink jet recording apparatus according to claim 1, wherein said light receiving means receives, through the wall surface of said ink tank, a change in light reflectance of a boundary portion between the wall surface and the negative pressure generating member at a predetermined timing to output obtained data, and wherein said discrimination means compares a result of the n-th (n is an integer which satisfies $n \geqq 2$) output and a result of the (n−1)-th output, or results of outputs to (n−1)-th output, and discriminates that the residual quantity of ink in said ink tank has been reduced if the comparison indicates a change larger than a predetermined value $\alpha$.

24. An ink jet recording apparatus according to claim 1, further comprising:

a carriage on which said ink tank and said recording head are mounted; and means for vertically moving the carriage to a plurality of positions to be adaptable to a thickness of the recording medium, wherein said light receiving means receives, through a wall surface of said ink tank, a change in light reflectance of a boundary portion between the wall surface and the negative pressure generating member at a predetermined timing to output obtained data, and wherein said discrimination means compares a result of the n-th (n is an integer which satisfies $n \geqq 2$) output and a result of the (n−1)-th output, or results of outputs to (n−1)-th output, subjects the received light reflectance to a predetermined calculation corresponding to a position of the carriage, and discriminates that the residual quantity of ink in said ink tank has been reduced if the comparison indicates a change larger than a predetermined value $\alpha$.

25. A method of detecting residual quantity of ink in an ink tank of an ink jet recording apparatus, which has a recording head for discharging ink through a nozzle thereof and an ink accommodating portion for supplying ink to said recording head, said ink tank having a supply port for supplying ink to said recording head and including a negative pressure generating member for generating negative pressure so as to discharge ink from said nozzle of said recording head to print an image on a recording medium, said method of detecting residual quantity of ink comprising:

a light emitting step for emitting light from light emitting means to a portion of a wall surface in said ink tank at which said negative pressure generating member is located;

a light receiving step for receiving reflected light of light emitted in said light emitting step by light receiving means; and a discrimination step for discriminating a state of residual quantity of ink in said ink tank in accordance with a quantity of light received in said light receiving step, wherein said light which is received in said light receiving step includes light reflected by an inside wall of said ink tank and light reflected by said negative pressure generating member.

26. A method of detecting residual quantity of ink according to claim 25, wherein said light receiving step is a step for receiving light emitted in said light emitting step and reflected by said wall surface, a boundary surface between said wall surface and said negative pressure generating member and said negative pressure generating member.

27. A method of detecting residual quantity of ink according to claim 25, wherein wavelength of light emitted in said light emitting step is the wavelength which penetrates ink in said ink tank.

28. A method of detecting residual quantity of ink according to claim 25, wherein said wall surface of said ink tank to which light is emitted in said light emitting step is a bottom portion of said ink tank.

29. A method of detecting residual quantity of ink according to claim 25, wherein said discrimination step is a step for discriminating that the residual quantity of ink in said ink tank is smaller than a predetermined quantity when the quantity of light received in said light receiving step is larger than a predetermined threshold.

30. A method of detecting residual quantity of ink according to claim 25, wherein said discrimination step is a step for discriminating the residual quantity state of ink in said ink tank in accordance with change in the quantity of light received in said light receiving step.

31. A method of detecting residual quantity of ink according to claim 25 further comprising:

a reflectance calculating step for calculating the reflectance in accordance with light emitted in said light emitting step and light received in said light receiving step, wherein said discrimination step is a step for discriminating the residual quantity state of ink in said ink tank in accordance with said reflectance.

32. A method of detecting residual quantity of ink according to claim 25 further comprising:

a display step for displaying the residual quantity state of ink in accordance with discrimination performed in said discrimination step.

33. A method of detecting residual quantity of ink according to claim 25 further comprising:

a recording control step for interrupting a recording operation performed by said recording head when a discrimination has been performed in said discrimination step that the residual quantity state of ink in said ink tank has been reduced to a level lower than a predetermined residual quantity.

34. A method of detecting residual quantity of ink according to claim 25, wherein said ink jet recording apparatus to which said method is adapted comprises a carriage on which both recording head and said ink tank can be mounted; and scanning means for scanning said carriage relatively to a recording medium, and said method of detecting residual quantity of ink further comprising the step of:

a control step for causing said scanning means to scan said carriage to a position, at which said light emitting means and said light receiving means face said wall surface of said ink tank, to discriminate the residual quantity state of ink in said ink tank.

35. A method of detecting residual quantity of ink according to claim 34, wherein said ink jet recording apparatus to which said method is adapted comprises a plurality of said recording heads, a plurality of said ink tanks are provided to correspond to said plurality of said recording heads, said control step is a step for causing said scanning means to make the wall surface of each of said ink tanks to face said light emitting means and said light receiving means, and said discrimination step is a step for sequentially discriminating the residual quantity state of ink in said plurality of said ink tanks.

36. A method of detecting residual quantity of ink according to claim 25, wherein said discrimination step is a step for causing said scanning means to relatively scan said carriage, said light emitting means and said light receiving means to perform discrimination at a plurality of positions of said wall surface in accordance with reflected light.

37. A method of detecting residual quantity of ink according to claim 25 further comprising:

an ink tank detection step for detecting whether or not said ink tank exists in accordance with light received by said light receiving means.

38. A method of detecting residual quantity of ink according to claim 25, wherein said light emitting means and said light receiving means are formed integrally into a photointerrupter.

39. A method of detecting residual quantity of ink according to claim 25 further comprising:

an adjustment step in which the quantity of light emitted by said light emitting means can be adjusted.

40. A method of detecting residual quantity of ink according to claim 39, wherein said light emitting means emits light in response to an electric signal applied thereto, and said adjustment step is a step for modulating the pulse width of said electric signal to be supplied to said light emitting means to enable the quantity of light, which is emitted by said light emitting means, to be adjusted.

41. A method of detecting residual quantity of ink according to claim 40, wherein said electric signal is a signal in the form of a pulse, and said adjustment step is a step for adjusting the width of said pulse.

42. A method of detecting residual quantity of ink according to claim 40, wherein said ink jet recording apparatus to which said method is adapted has a reflecting portion so disposed as to be capable of reflecting light emitted by said light emitting means to said light receiving means; and said adjustment step is a step for modulating said electric signal to be supplied to said light emitting means in response to light reflected by said reflecting portion in such a manner that the quantity of light received by said light receiving means is made to be constant.

43. A method of detecting residual quantity of ink according to claim 40 further comprising:

a storage step for storing information formed on the basis of said drive signal modulated in said adjustment step, wherein said discrimination step is a step for subjecting information formed on the basis of the quantity of light emitted to said wall surface of said ink tank, reflected by the same and received by said receiving means and information stored in said storage means to a comparison to discriminate the residual quantity state of ink in said ink tank.

44. A method of detecting residual quantity of ink according to claim 25 further comprising:

a correction step for correcting a signal formed on the basis of the quantity of light received by said light receiving means.

45. A method of detecting residual quantity of ink according to claim 25, wherein said recording head applies thermal energy to ink to cause ink to change the state thereof due to heat so that ink is discharged due to pressure generated due to change in the state of ink.

46. A method according to claim 25, wherein, in said light receiving step, a quantity of reflected light is detected at a predetermined timing to transmit detected data, and wherein, in said discrimination step, a result of the n-th (n as an integer which satisfies $n \geqq 2$) output and a result of the (n−1)-th output, or results of output (n−1)-th output, are compared, and it is discriminated that the residual quantity of ink in said ink tank has been reduced if the comparison indicates a change larger than a predetermined value $\alpha$.

47. A method according to claim 25, wherein in said light receiving step, a quantity of reflected light is detected at a predetermined timing to transmit detected data, and wherein, in said discrimination step, a result of the n-th (n as an integer which satisfies $n \geqq 2$) output and a result of the (n−1)-th output, or results of output (n−1)-th output, are compared, the detected light reflectance is subjected to a predetermined calculation corresponding to a position of a carriage on which said ink tank and said recording head are mounted, and it is discriminated that the residual quantity of ink in said ink tank has been reduced if the comparison indicates a change larger than a predetermined value $\alpha$.

* * * * *

UNITED STATES PATENT AND TRADEMARK OFFICE

CERTIFICATE OF CORRECTION

PATENT NO. : 5,975,665

DATED : November 2, 1999

INVENTOR(S) : Makoto Torigoe, et al.

It is certified that error appears in the above-identified patent and that said Letters Patent is hereby corrected as shown below:

Column 3

Line 5, change "whereby" to --thereby--.

Column 5

Line 1, change "performed by," to --performed,--;
line 14, change "whereby" to --thereby--; and
line 19, change "whereby" to --thereby--.

Column 7

Line 51, delete "to a comparison".

Column 8

Figure 11A:
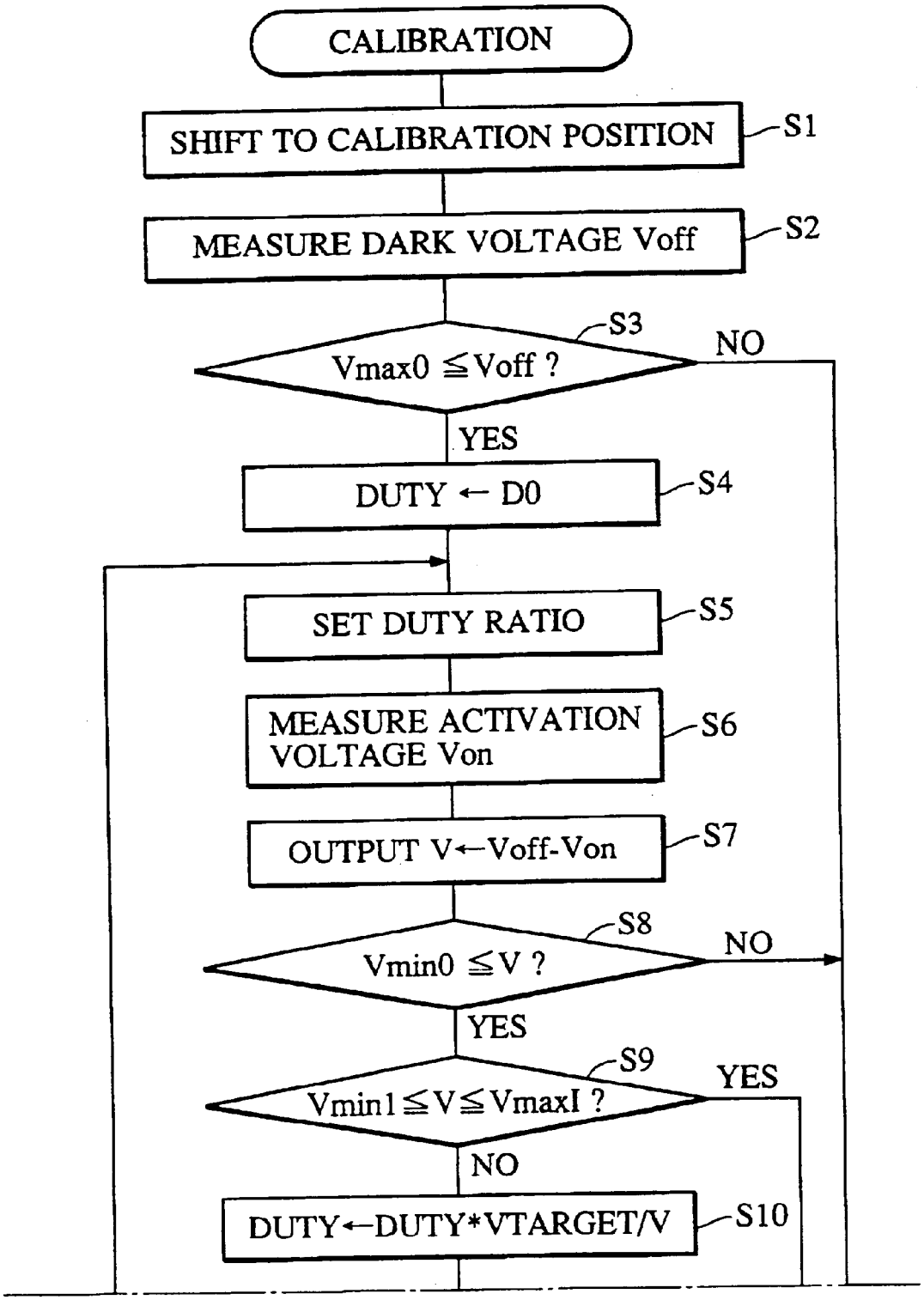
FIGS. 11A and 11B are flowcharts.
Figures 11, 11B:
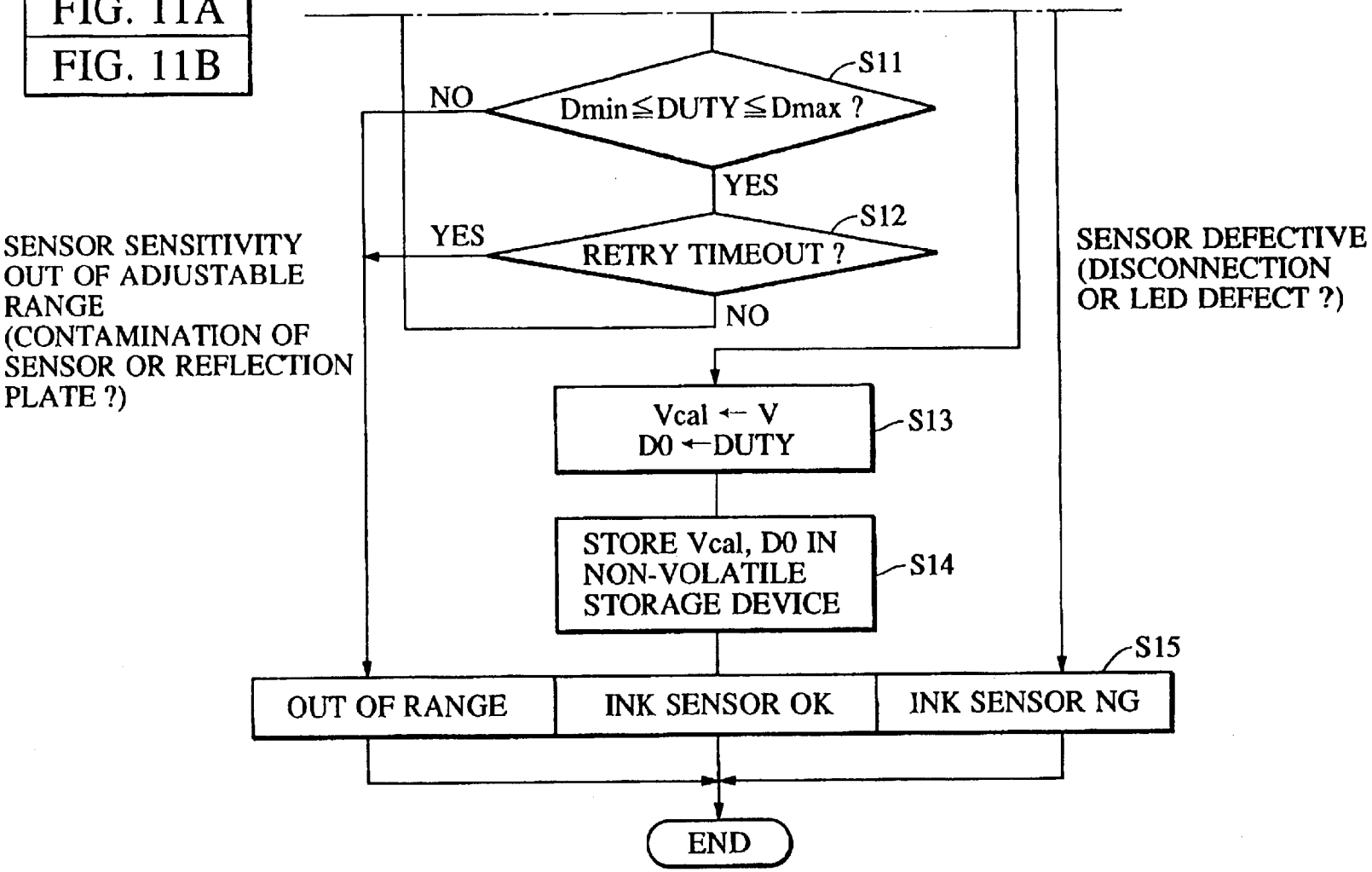
FIG. 11 is a block diagram showing that FIGS. 11A and 11B are to be as connected flowcharts; of a calibration method adapted to the residual quantity detection apparatus shown in FIG. 9.

Line 16, change "as" to --read as"; and insert a new paragraph beginning with --Figs. 11A and 11B are flowcharts-- before "of a calibration";
line 20 should be deleted in its entirety; and
line 25, insert a new paragraph beginning with --Figs. 13A and 13B are flowcharts-- before "of the calibration".

Column 10

Line 54, delete "as".

UNITED STATES PATENT AND TRADEMARK OFFICE

CERTIFICATE OF CORRECTION

PATENT NO. : 5,975,665

DATED : November 2, 1999

INVENTOR(S) : Makoto Torigoe, et al.

It is certified that error appears in the above-identified patent and that said Letters Patent is hereby corrected as shown below:

Column 11

Line 6, delete "as";
line 10, change "have the" to --has a--;
line 15, change "surface" to --surface be made--; and
line 44, delete "as", and change "heaters" to --heater--.

Column 12

Line 38, delete "with".

Column 13

Line 15, change "whereby" to --thereby--;
line 29, change "In actual" to --in operation--; and
line 45, delete "number" (second occurrence)

Column 14

Line 24, change "whereby" to --thereby--.

UNITED STATES PATENT AND TRADEMARK OFFICE

CERTIFICATE OF CORRECTION

PATENT NO. : 5,975,665

DATED : November 2, 1999

INVENTOR(S) : Makoto Torigoe, et al.

It is certified that error appears in the above-identified patent and that said Letters Patent is hereby corrected as shown below:

Column 15

Line 13, change "accormmodated" to --accommodated--;
line 37, change "as" to --the--; and
line 56, change "as" to --the--.

Column 20

Line 46, change "An" to --A--.

Column 22

Line 12, change "a" to --an--; and
line 52, change "whereby" to --thereby--.

Column 23

Line 62, change "whereby" to --thereby--.

Column 24

Line 67, change "control" to --controlling--.

Column 25

Line 8, change "cuantity" to --quantity--.

UNITED STATES PATENT AND TRADEMARK OFFICE

CERTIFICATE OF CORRECTION

PATENT NO. : 5,975,665

DATED : November 2, 1999

INVENTOR(S) : Makoto Torigoe, et al.

It is certified that error appears in the above-identified patent and that said Letters Patent is hereby corrected as shown below:

Column 26

Line 67, change "whereby" to --thereby--.

Column 27

Line 8, change "whereby" to --thereby--; and
line 17, change "whereby" to --thereby--.

Column 28

Line 15, change "in.a" to --in a--; and
line 52, change "an" to --a--.

Column 30

Line 46, change "raises" to --raise--.

Column 31

Line 50, delete "are".

Column 33

Line 42, change "is as well" to --can also be--; and
line 43, delete "as".

UNITED STATES PATENT AND TRADEMARK OFFICE

CERTIFICATE OF CORRECTION

PATENT NO. : 5,975,665

DATED : November 2, 1999

INVENTOR(S) : Makoto Torigoe, et al.

It is certified that error appears in the above-identified patent and that said Letters Patent is hereby corrected as shown below:

Column 44

Line 9, change "as" to --is--; and
line 20, change "as" to --is--.

Signed and Sealed this

Twenty-eighth Day of November, 2000

*Attest:*

Q. TODD DICKINSON

*Attesting Officer*

*Director of Patents and Trademarks*